US008555590B2

(12) United States Patent
Richardson et al.

(10) Patent No.: US 8,555,590 B2
(45) Date of Patent: Oct. 15, 2013

(54) PIVOTALLY ACTIVATED CONNECTOR COMPONENTS FOR FORM-WORK SYSTEMS AND METHODS FOR USE OF SAME

(75) Inventors: George David Richardson, Vancouver (CA); Semion Krivulin, Richmond (CA)

(73) Assignee: CFS Concrete Forming Systems Inc., Vancouver (CA)

( * ) Notice: Subject to any disclaimer, the term of this patent is extended or adjusted under 35 U.S.C. 154(b) by 470 days.

(21) Appl. No.: 12/742,082

(22) PCT Filed: Nov. 7, 2008

(86) PCT No.: PCT/CA2008/001951

§ 371 (c)(1),
(2), (4) Date: May 21, 2010

(87) PCT Pub. No.: WO2009/059410

PCT Pub. Date: May 14, 2009

(65) Prior Publication Data

US 2010/0251657 A1 Oct. 7, 2010

Related U.S. Application Data

(60) Provisional application No. 60/986,973, filed on Nov. 9, 2007, provisional application No. 61/022,505, filed on Jan. 21, 2008.

(51) Int. Cl.
*E04B 2/00* (2006.01)

(52) U.S. Cl.
USPC ..... 52/426; 52/421

(58) Field of Classification Search
USPC ..... 52/309.1, 309.4, 309.12, 309.17, 421, 52/425, 426, 439; 249/191, 194, 195, 213, 249/216
See application file for complete search history.

(56) References Cited

U.S. PATENT DOCUMENTS 154,179 A 8/1874 Hubert
374,826 A 12/1887 Clarke
(Continued)

FOREIGN PATENT DOCUMENTS

CA 0574720 4/1959
CA 0957816 11/1974
(Continued)

OTHER PUBLICATIONS

Vector Corrosion Technologies Marketing Materials, 2005.
(Continued)

*Primary Examiner* — William Gilbert
(74) *Attorney, Agent, or Firm* — Oyen Wiggs Green & Mutala LLP

(57) ABSTRACT

A stay-in-place form for casting concrete structures comprises a plurality of elongate panels interconnectable in edge-to-edge relationship via complementary connector components on their longitudinal edges to define at least a portion of a perimeter of the form. Each panel comprises a first contoured connector component comprising a protrusion on a first longitudinal edge thereof and a second contoured connector component comprising a receptacle on a second longitudinal edge thereof. The panels are connectable to one another in edge-to-edge relationship by positioning the protrusion of a first panel in or near the receptacle of a second panel and effecting relative pivotal motion between the first connector component of the first panel and the second connector component of the second panel to extend the protrusion of the first panel into the receptacle of the second panel.

26 Claims, 33 Drawing Sheets

(56) References Cited

U.S. PATENT DOCUMENTS

| | | | | |
|---|---|---|---|---|
| 510,720 | A | | 12/1893 | Stewart, Jr. |
| 820,246 | A | | 5/1906 | Nidds |
| 1,035,206 | A | | 8/1912 | Lewen |
| 1,080,221 | A | | 12/1913 | Jester |
| 1,244,608 | A | | 10/1917 | Hicks |
| 1,276,147 | A | | 8/1918 | White |
| 1,345,156 | A | | 6/1920 | Flynn |
| 1,423,879 | A | | 7/1922 | Potter |
| 1,637,410 | A | | 8/1927 | Corybell |
| 1,653,197 | A | | 12/1927 | Barnes |
| 1,715,466 | A | | 6/1929 | Miller |
| 1,820,897 | A | | 8/1931 | White et al. |
| 1,875,242 | A | | 8/1932 | Hathaway |
| 1,915,611 | A | | 6/1933 | Miller |
| 2,008,162 | A | | 7/1935 | Waddell |
| 2,050,258 | A | | 8/1936 | Bemis |
| 2,076,472 | A | | 4/1937 | London |
| 2,164,681 | A | | 7/1939 | Fould |
| 2,172,052 | A | | 9/1939 | Robbins |
| 2,326,361 | A | | 8/1943 | Jacobsen |
| 2,861,277 | A | | 11/1958 | Hermann |
| 2,892,340 | A | | 6/1959 | Fort |
| 3,063,122 | A | | 11/1962 | Katz |
| 3,100,677 | A | | 8/1963 | Frank et al. |
| 3,152,354 | A | | 10/1964 | Diack |
| 3,184,013 | A | | 5/1965 | Pavlecka |
| 3,196,990 | A | | 7/1965 | Handley |
| 3,220,151 | A | | 11/1965 | Goldman |
| 3,288,427 | A | | 11/1966 | Pluckebaum |
| 3,291,437 | A | | 12/1966 | Bowden et al. |
| 3,468,088 | A | | 9/1969 | Miller |
| 3,555,751 | A | | 1/1971 | Thorgusen |
| 3,588,027 | A | | 6/1971 | Bowden |
| 3,788,020 | A | | 1/1974 | Gregori |
| 3,886,705 | A | | 6/1975 | Cornland |
| 3,951,294 | A | | 4/1976 | Wilson |
| 3,991,636 | A | | 11/1976 | Devillers |
| 4,023,374 | A | | 5/1977 | Colbert et al. |
| 4,060,945 | A | | 12/1977 | Wilson |
| 4,104,837 | A | | 8/1978 | Naito |
| 4,106,233 | A | | 8/1978 | Horowitz |
| 4,180,956 | A | | 1/1980 | Gross |
| 4,276,730 | A | | 7/1981 | Lewis |
| 4,351,870 | A | | 9/1982 | English |
| 4,383,674 | A | | 5/1983 | Fricker |
| 4,433,522 | A | | 2/1984 | Yerushalmi |
| 4,434,597 | A | | 3/1984 | Fischer |
| 4,508,310 | A | | 4/1985 | Schultz |
| 4,532,745 | A | | 8/1985 | Kinard |
| 4,543,764 | A | | 10/1985 | Kozikowski |
| 4,550,539 | A | | 11/1985 | Foster |
| 4,553,875 | A | | 11/1985 | Casey |
| 4,575,985 | A | | 3/1986 | Eckenrodt |
| 4,581,864 | A | | 4/1986 | Shvakhman et al. |
| 4,606,167 | A | | 8/1986 | Thorne |
| 4,695,033 | A | | 9/1987 | Imaeda et al. |
| 4,703,602 | A | | 11/1987 | Pardo |
| 4,731,964 | A | | 3/1988 | Phillips |
| 4,731,971 | A | | 3/1988 | Terkl |
| 4,742,665 | A | | 5/1988 | Baierl |
| 4,856,754 | A | | 8/1989 | Yokota et al. |
| 4,866,891 | A | | 9/1989 | Young |
| 4,946,056 | A | | 8/1990 | Stannard |
| 4,995,191 | A | | 2/1991 | Davis |
| 5,014,480 | A | | 5/1991 | Guarriello et al. |
| 5,124,102 | A | | 6/1992 | Serafini |
| 5,216,863 | A | | 6/1993 | Nessa et al. |
| 5,243,805 | A | | 9/1993 | Fricker |
| 5,265,750 | A | | 11/1993 | Whiteley |
| 5,311,718 | A | | 5/1994 | Trousilek |
| 5,465,545 | A | | 11/1995 | Trousilek |
| 5,489,468 | A | * | 2/1996 | Davidson ..... 442/374 |
| 5,491,947 | A | | 2/1996 | Kim |
| 5,513,474 | A | | 5/1996 | Scharkowski |
| 5,516,863 | A | | 5/1996 | Abusleme et al. |
| 5,553,430 | A | | 9/1996 | Majnaric et al. |
| 5,591,265 | A | | 1/1997 | Tusch |
| 5,608,999 | A | | 3/1997 | McNamara |
| 5,625,989 | A | | 5/1997 | Brubaker et al. |
| 5,729,944 | A | | 3/1998 | De Zen |
| 5,740,648 | A | | 4/1998 | Piccone |
| 5,747,134 | A | | 5/1998 | Mohammed et al. |
| 5,791,103 | A | | 8/1998 | Coolman |
| 5,824,347 | A | | 10/1998 | Serafini |
| 5,860,262 | A | | 1/1999 | Johnson |
| 5,953,880 | A | | 9/1999 | De Zen |
| 5,987,830 | A | | 11/1999 | Worley |
| 6,161,989 | A | | 12/2000 | Kotani et al. |
| 6,167,669 | B1 | | 1/2001 | Lanc |
| 6,167,672 | B1 | | 1/2001 | Okitomo |
| 6,189,269 | B1 | | 2/2001 | De Zen |
| 6,212,845 | B1 | | 4/2001 | De Zen |
| 6,219,984 | B1 | | 4/2001 | Piccone |
| 6,220,779 | B1 | | 4/2001 | Warner et al. |
| 6,247,280 | B1 | | 6/2001 | Grinshpun et al. |
| 6,387,309 | B1 | | 5/2002 | Kojima |
| 6,435,470 | B1 | | 8/2002 | Lahham et al. |
| 6,435,471 | B1 | | 8/2002 | Piccone |
| 6,530,185 | B1 | | 3/2003 | Scott et al. |
| 6,622,452 | B2 | | 9/2003 | Alvaro |
| 6,694,692 | B2 | | 2/2004 | Piccone |
| 6,832,456 | B1 | | 12/2004 | Bilowol |
| 6,866,445 | B2 | | 3/2005 | Semler |
| 6,935,081 | B2 | | 8/2005 | Dunn et al. |
| 7,444,788 | B2 | | 11/2008 | Morin et al. |
| 2003/0009967 | A1 | | 1/2003 | Piccone |
| 2003/0155683 | A1 | | 8/2003 | Pietrobon |
| 2004/0010994 | A1 | | 1/2004 | Piccone |
| 2004/0093817 | A1 | | 5/2004 | Pujol Barcons |
| 2005/0016083 | A1 | | 1/2005 | Morin et al. |
| 2005/0016103 | A1 | * | 1/2005 | Piccone ..... 52/481.1 |
| 2006/0213140 | A1 | | 9/2006 | Morin et al. |
| 2009/0229214 | A1 | | 9/2009 | Nelson |
| 2010/0047608 | A1 | | 2/2010 | Seccombe |
| 2010/0050552 | A1 | | 3/2010 | David |
| 2010/0071304 | A1 | | 3/2010 | Richardson et al. |

FOREIGN PATENT DOCUMENTS

| | | |
|---|---|---|
| CA | 1316366 | 4/1993 |
| CA | 2097226 | 11/1994 |
| CA | 2141463 | 8/1996 |
| CA | 2070079 | 6/1997 |
| CA | 2170681 | 8/1997 |
| CA | 2218600 | 6/1998 |
| CA | 2215939 | 8/1999 |
| CA | 2226497 | 10/1999 |
| CA | 2243905 | 1/2000 |
| CA | 2255256 | 1/2000 |
| CA | 2244537 | 2/2000 |
| CA | 2418885 | 8/2003 |
| CA | 2502343 | 5/2004 |
| CA | 2502392 | 5/2004 |
| CA | 2499450 | 9/2005 |
| CA | 2577217 | 1/2006 |
| CA | 2629202 | 4/2008 |
| CA | 2681963 | 10/2008 |
| CH | 317758 | 1/1957 |
| DE | 1684357 | 4/1967 |
| DE | 1812590 | 6/1970 |
| DE | 2062723 | 8/1972 |
| DE | 3003446 | 8/1981 |
| DE | 3234489 | 3/1984 |
| DE | 3727956 | 5/1988 |
| DE | 29803155 | 6/1998 |
| EP | 0025420 | 3/1981 |
| EP | 0055504 | 7/1982 |
| EP | 0141782 | 5/1985 |
| EP | 0757137 | 2/1997 |
| FR | 0507787 | 7/1920 |
| FR | 1381945 | 11/1964 |
| FR | 1603005 | 4/1971 |
| FR | 2535417 | 5/1984 |
| FR | 2721054 | 6/1994 |

(56) References Cited

FOREIGN PATENT DOCUMENTS

| | | |
|---|---|---|
| FR | 2717848 | 9/1995 |
| GB | 779916 | 7/1957 |
| GB | 2205624 | 12/1988 |
| JP | 05133028 | 5/1993 |
| JP | 09041612 | 2/1997 |
| JP | 2008223335 | 9/2008 |
| SE | 206538 | 8/1966 |
| WO | 8204088 | 11/1982 |
| WO | 9500724 | 1/1995 |
| WO | 9607799 | 3/1996 |
| WO | 9635845 | 11/1996 |
| WO | 9743496 | 11/1997 |
| WO | 0163066 | 8/2001 |
| WO | 0173240 | 10/2001 |
| WO | 03006760 | 1/2003 |
| WO | 2004088064 | 10/2004 |
| WO | 2008119178 | 10/2008 |

OTHER PUBLICATIONS

Vector Corrosion Technologies Marketing Materials, 2007.

Vector Corrosion Technologies Marketing Materials, 2008.

Digigraph Brochure, Building Systems using PVC extrusions and concrete, accessed online Jan. 2012.

Digigraph Guide, Digigraph Systems Inc., Installation Guide for the Digigraph Construction System Composed of PVC Extrusions and Concrete, accessed online Jan. 2012.

The Digigraph System, http://www.digigraph-housing.com/web/system.ht, accessed online Jan. 2012.

* cited by examiner

PIVOTALLY ACTIVATED CONNECTOR COMPONENTS FOR FORM-WORK SYSTEMS AND METHODS FOR USE OF SAME

REFERENCE TO RELATED APPLICATIONS

This application claims priority from:

U.S. patent application Ser. No. 60/986973 filed 9 Nov. 2007 and entitled PIVOTALLY ACTIVATED CONNECTOR COMPONENTS FOR MODULAR STAY-IN-PLACE FORMS AND METHODS FOR USE OF SAME; and U.S. patent application Ser. No. 61/022505 filed 21 Jan. 2008 and entitled SLIDABLY AND PIVOTALLY ACTIVATED CONNECTOR COMPONENTS FOR FORM-WORK SYSTEMS AND METHODS FOR USE OF SAME.

For the purposes of the United States of America, this application claims the benefit under 35 U.S.C. §119 or 35 U.S.C. §120 (as the case may be) of:

U.S. patent application Ser. No. 60/986973 filed 9 Nov. 2007 and entitled PIVOTALLY ACTIVATED CONNECTOR COMPONENTS FOR MODULAR STAY-IN-PLACE FORMS AND METHODS FOR USE OF SAME which is hereby incorporated herein by reference; and U.S. patent application Ser. No. 61/022505 filed 21 Jan. 2008 and entitled SLIDABLY AND PIVOTALLY ACTIVATED CONNECTOR COMPONENTS FOR FORM-WORK SYSTEMS AND METHODS FOR USE OF SAME which is hereby incorporated herein by reference.

TECHNICAL FIELD

This invention relates to form-work systems for fabricating structural parts for buildings, tanks and/or other structures out of concrete or other similar curable construction materials. Particular embodiments of the invention provide connector components for modular stay-in-place forms and methods for providing connections between modular form units.

BACKGROUND

It is known to fabricate structural parts for buildings, tanks or the like from concrete using modular stay-in-place forms. Such structural parts may include walls, ceilings or the like. Examples of such modular stay in place forms include those described US patent publication No. 2005/0016103 (Piccone) and PCT publication No. WO96/07799 (Sterling). A representative drawing depicting a partial form 28 according to one prior art system is shown in top plan view in FIG. 1. Form 28 includes a plurality of wall panels 30 (e.g. 30A, 30B, 30D), each of which has an inwardly facing surface 31A and an outwardly facing surface 31B. Each of panels 30 includes a terminal male T-connector component 34 at one of its transverse, vertically-extending edges (vertical being the direction into and out of the FIG. 1 page) and a terminal female C-connector component 32 at its opposing vertical edge. Male T-connector components 34 slide vertically into the receptacles of female C-connector components 32 to join edge-adjacent panels 30 to form a pair of substantially parallel wall segments (generally indicated at 27, 29). Depending on the needs for particular wall segments 27, 29, different panels 30 may have different transverse dimensions. For example, comparing panels 30A and 30B, it can be seen that panel 30A has approximately ¼ of the transverse length of panel 30B.

Form 28 includes support panels 36 which extend between, and connect to each of, wall segments 27, 29 at transversely spaced apart locations. Support panels 36 include male T-connector components 42 slidably received in the receptacles of female C-connector components 38 which extend inwardly from inwardly facing surfaces 31A or from female C-connector components 32. Form 28 comprises tensioning panels 40 which extend between panels 30 and support panels 36 at various locations within form 28. Tensioning panels 40 include male T-connector components 46 received in the receptacles of female C-connector components 38.

In use, form 28 is assembled by slidable connection of the various male T-connector components 34, 42, 46 in the receptacles of the various female C-connectors 32, 38. Liquid concrete is then poured into form 28 between wall segments 27, 29. The concrete flows through apertures (not shown) in support panels 36 and tensioning panels 40 to fill the inward portion of form 28 (i.e. between wall segments 27, 29). When the concrete solidifies, the concrete (together with form 28) may provide a structural component (e.g. a wall) for a building or other structure.

One well-known problem with prior art systems is referred to colloquially as "unzipping". Unzipping refers to the separation of connector components from one another due to the weight and/or outward pressure generated by liquid concrete when it is poured into form 28. By way of example, unzipping may occur at connector components 32, 34 between panels 30. FIG. 2 schematically depicts the unzipping of a prior art connection 50 between male T-connector component 34 and corresponding female C-connector component 32 at the edges of a pair of edge-adjacent panels 30. The concrete (not explicitly shown) on the inside 51 of connection 50 exerts outward forces on panels 50 (as shown at arrows 52, 54). These outward forces tend to cause deformation of the connector components 32, 34. In the FIG. 2 example illustration, connector components 32, 34 exhibit deformation in the region of reference numerals 56, 58, 60, 62, 64, 68. This deformation of connector components 32, 34 may be referred to as unzipping.

Unzipping of connector components can lead to a number of problems. In addition to the unattractive appearance of unzipped connector components, unzipping can lead to separation of male connector components 34 from female connector components 32. To counteract this problem, prior art systems typically incorporate support panels 36 and tensioning panels 40, as described above. However, support panels 36 and tensioning panels 40 represent a relatively large amount of material (typically plastic) which can increase the overall cost of form 28. Furthermore, support panels 36 and tensioning panels do not completely eliminate the unzipping problem. Notwithstanding the presence of support panels 36 and tensioning panels 40, in cases where male connector components 34 do not separate completely from female connector components 32, unzipping of connector components 32, 34 may still lead to the formation of small spaces (e.g. spaces 70, 71) or the like between connector components 32, 34. Such spaces can be difficult to clean and can represent regions for the proliferation of bacteria or other contaminants and can thereby prevent or discourage the use of form 28 for particular applications, such as those associated with food storage or handling or other applications requiring sanitary conditions or the like. Such spaces can also permit the leakage of liquids and/or gasses between inside 51 and outside 53 of panels 30. Such leakage can prevent or discourage the use of faun 28 for applications where it is required that form 28 be impermeable to gases or liquids. Such leakage can also lead to unsanitary conditions on the inside of form 28.

There is a general desire to provide modular form components and connections therefor which overcome or at least ameliorate some of the drawbacks with the prior art.

BRIEF DESCRIPTION OF DRAWINGS

In drawings which depict non-limiting embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
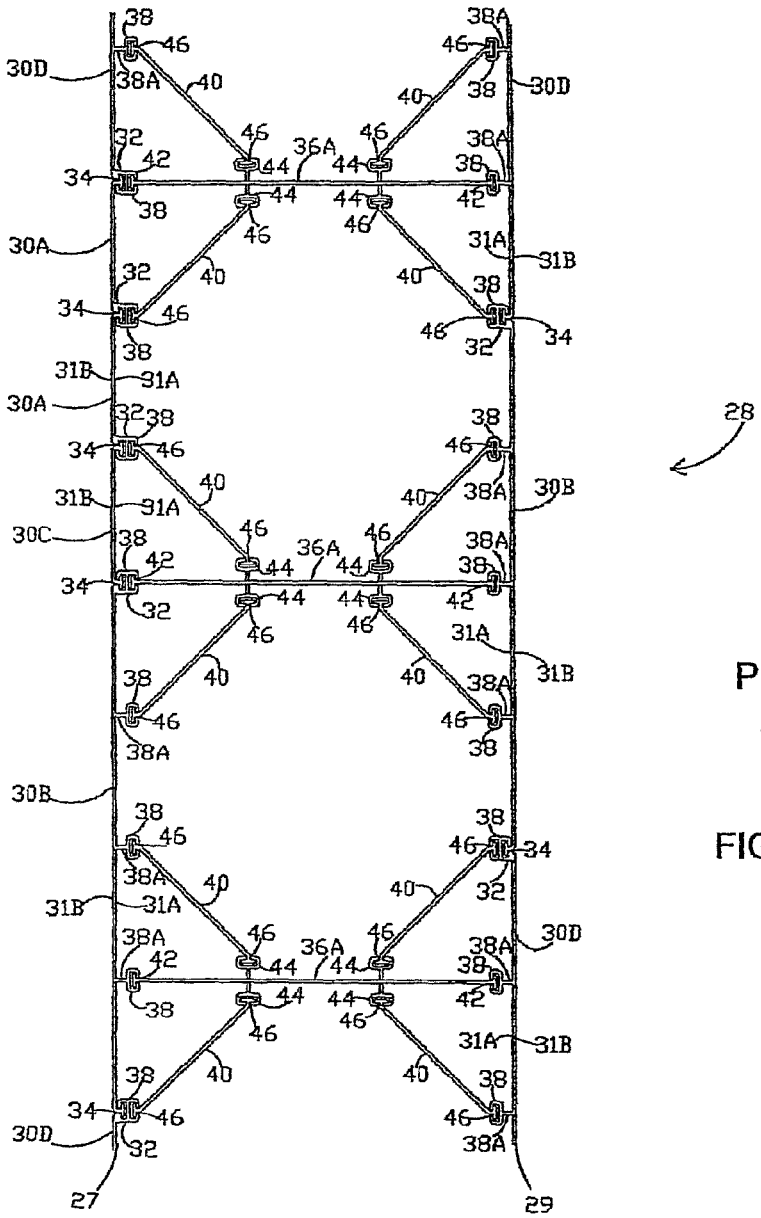
PRIOR ART FIGURE 1
FIG. 1 is a top plan view of a prior art modular stay-in-place form.
Figure 2:
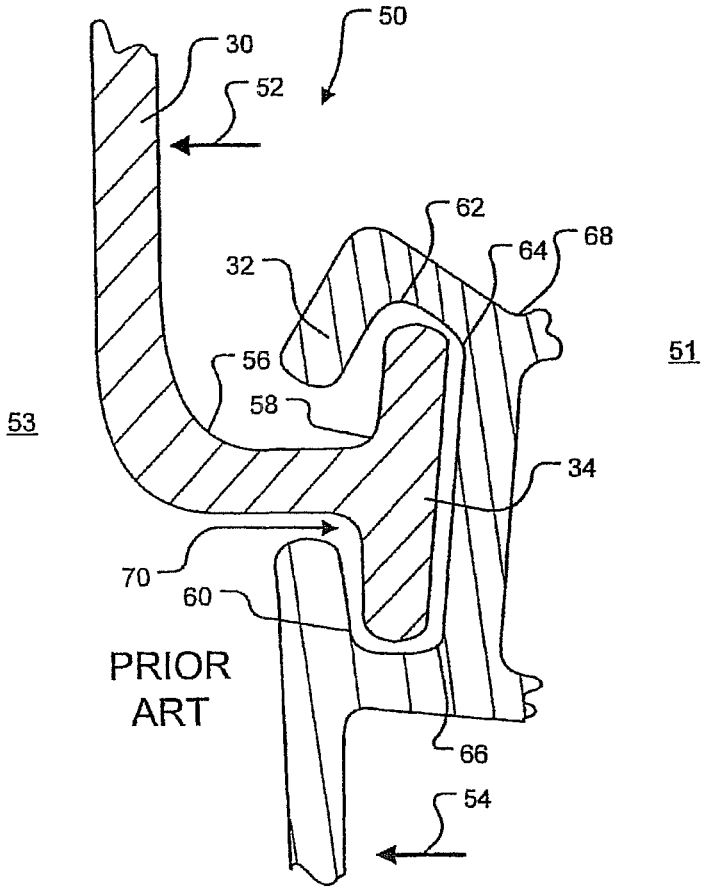
FIG. 2 is a magnified partial plan view of the FIG. 1 form, showing the unzipping of a connection between wall panels.
Figure 3:
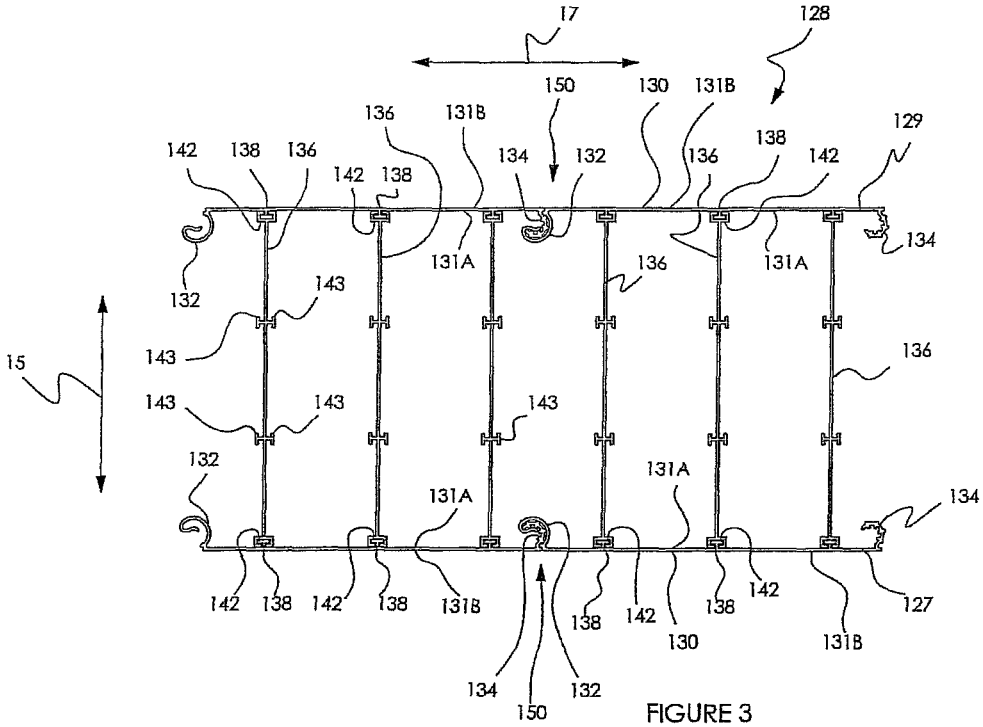
FIG. 3 is a top plan view of a modular stay-in-place form according to a particular embodiment of the invention.

FIG. 3 is a partial top plan view of a modular stay-in-place form 128 according to a particular embodiment of the invention which may be used to fabricate a portion of a wall of a building or other structure. Form 128 of the FIG. 3 embodiment includes wall panels 130 and support members 136. The components of form 128 (i.e. panels 130 and support members 136) are preferably fabricated from a lightweight and resiliently deformable material (e.g. a suitable plastic) using an extrusion process. By way of non-limiting example, suitable plastics include: poly-vinyl chloride (PVC), acrylonitrile butadiene styrene (ABS) or the like. In other embodiments, the components of form 128 may be fabricated from other suitable materials, such as steel or other suitable alloys, for example. Although extrusion is the currently preferred technique for fabricating the components of form 128, other suitable fabrication techniques, such as injection molding, stamping, sheet metal fabrication techniques or the like may additionally or alternatively be used.

Figure 6A:
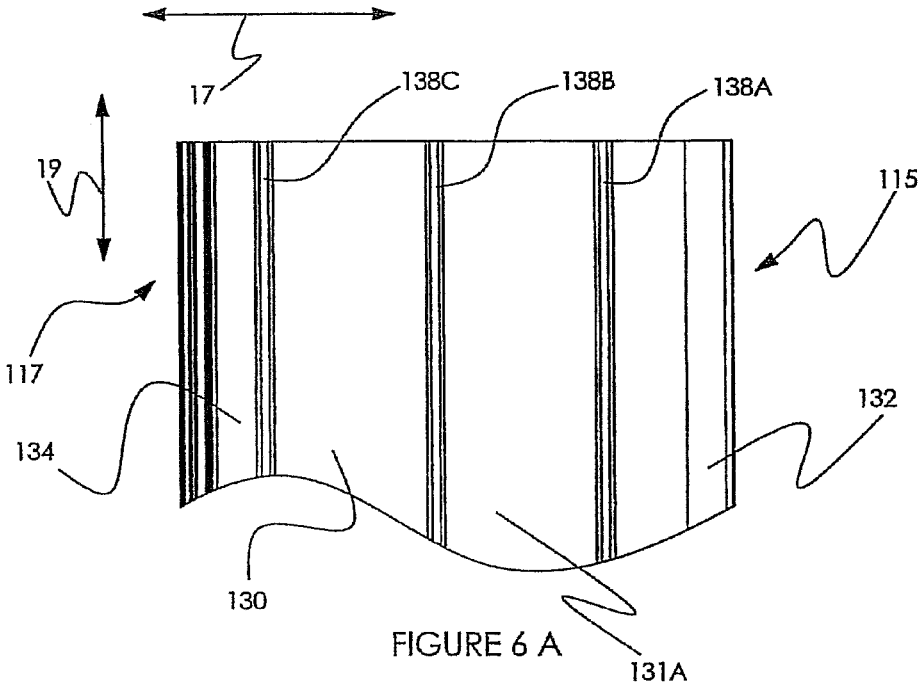
FIGS. 6A, 6B and 6C represent partial side plan views of the panels and the support members of the forms of FIGS. 3, 4, 5A and 5B and of the tensioning components of the FIGS. 4 and 5B form.
Figure 6B:
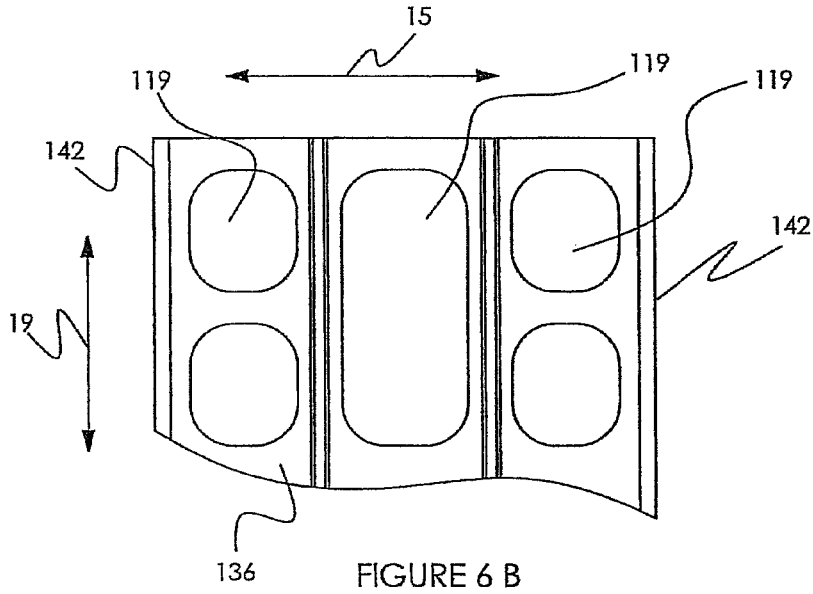

Form 128 comprises a plurality of panels 130 which are elongated in the vertical direction (i.e. the direction into and out of the page of FIG. 3 and the direction of double-headed arrow 19 of FIGS. 6A and 6B). Panels 130 comprise inward facing surfaces 131A and outward facing surfaces 131B. In the FIG. 3 illustration, all panels 130 are identical to one another, but this is not necessary. In general, panels 130 may have a number of features which differ from one another as explained in more particular detail below. As shown in FIGS. 3, 6A and 7A-7F, panels 130 incorporate first, generally female, curved connector components 132 at one of their edges 115 and second, generally male, curved connector components 134 at their opposing edges 117. In the illustrated embodiment, panels 130 (including first and second connector components 132, 134) have a substantially uniform cross-section along their entire vertical length, although this is not necessary.

In some embodiments, panels 130 are prefabricated to have different vertical dimensions. In other embodiments, the vertical dimensions of panels 130 may be cut to length. Preferably, panels 130 are relatively thin in the inward-outward direction (shown by double-headed arrow 15 of FIGS. 3) in comparison to the inward-outward dimension of the resultant walls fabricated using form 128. In some embodiments, the ratio of the inward-outward dimension of a structure formed by form 128 to the inward-outward dimension of a panel 130 is in a range of 10-600. In some embodiments, the ratio of the inward-outward dimension of a structure formed by form 128 to the inward-outward dimension of a panel 130 is in a range of 20-300.

As shown in FIG. 3 and explained further below, connector components 132, 134 may be joined together to form connections 150 at edges 115, 117 of panels 130. Panels 130 may thereby be connected in edge-adjacent relationship to form wall segments 127, 129. In the FIG. 3 illustration, form 128 comprises a pair of wall segments 127, 129 which extend in the vertical direction and in the transverse direction (shown by double headed arrows 17 in FIGS. 3 and 6A). This is not necessary. As explained in more particular detail below, forms used for tilt-up walls according to the invention need only comprise a single wall segment. In addition, structures fabricated using forms according to the invention are not limited to walls. In such embodiments, groups of edge-adjacent panels 130 connected in edge-to-edge relationship at connections 150 may be more generally referred to as form segments instead of wall segments. In the illustrated embodiment, wall segments 127, 129 are spaced apart from one another in the inward-outward direction by an amount that is relatively constant, such that wall segments 127, 129 are generally parallel. This is not necessary. In some embodiments, wall segments 127, 129 need not be parallel to one another and different portions of forms according to the invention may have different inward-outward dimensions.

FIGS. 7A-7E schematically illustrate represent magnified partial plan views of the connector components 132, 134 for implementing connections 150 between edge-adjacent panels 130A, 130B of form 128 and a method of coupling connector components 132, 134 to form such edge-to-edge connections 150. Generally speaking, rather than sliding panels relative to one another to form connections between connector components, edge-adjacent panels 130A, 130B are pivoted relative to one another such that second, generally male, curved connector component 134 pivots into receptacle 154 of first, generally female, curved connector component 132. The coupling of second connector component 134 to first connector component 132 may also involve resilient deformation of various features of connector components 132, 134 such that resilient restorative forces tend to lock connector components 132, 134 to one another (i.e. snap-together fitting).

Figure 7A:
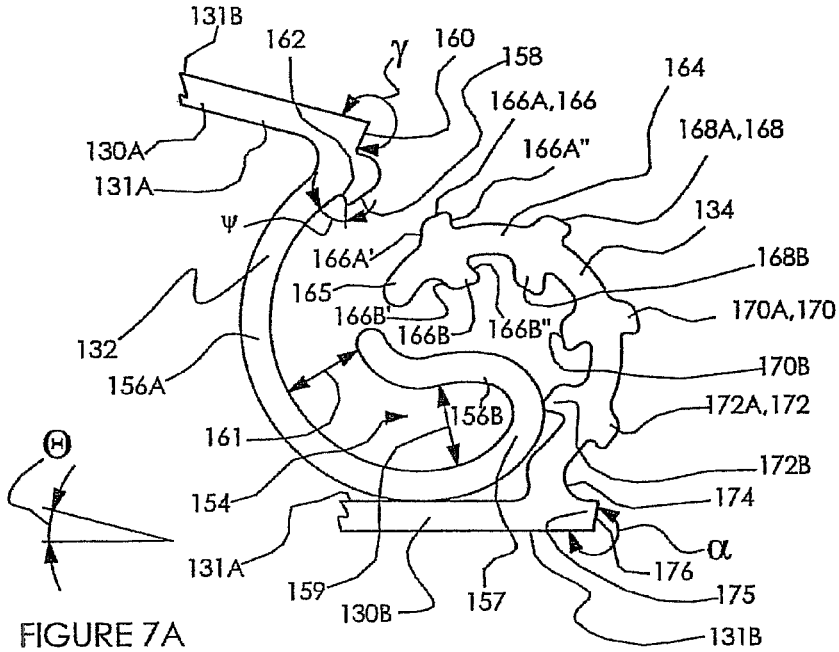
FIGS. 7A-7E represent magnified partial plan views of the connector components for implementing the edge-to-edge connections between edge-adjacent panels of the forms of FIGS. 3, 4, 5A and 5B and a method of coupling the connector components to form such edge-to-edge connections.
Figure 7B:
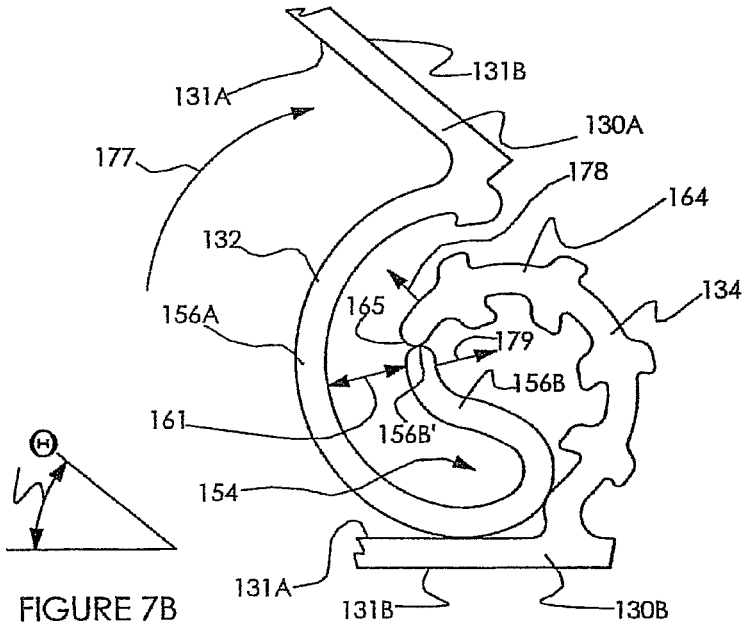

The features of connector components 132, 134 are shown best in FIGS. 7A and 7B. Connector component 132 is a part of (i.e. integrally formed with) panel 130A and includes a pair of curved arms 156A, 156B which join one another in region 157 to form a curved receptacle or channel 154 therebetween. Region 157 may be referred to as bight 157. Proximate arm 156A extends generally away from panel 130A toward bight 157 and distal arm 156B extends generally from bight 157 back toward panel 130A to form receptacle 154. Receptacle 154 comprises an open end 161 at an end opposite that of bight 157. In currently preferred embodiments, the curvatures of arms 156A, 156B are not concentric and distal arm 156B extends slightly toward proximate arm 156A as arms 156A, 156B extend away from bight 157. That is, the dimension of receptacle 154 (i.e separation of arms 156A, 156B) is wider in a central portion 159 of receptacle 154 than at opening 161 of receptacle 154.

In the illustrated embodiment, proximate arm 156A comprises a protrusion 158 in a vicinity of inward surface 131A of panel 130A. Protrusion 158 extends away from inward surface 131A of panel 130A. In the illustrated embodiment, protrusion 158 comprises a hook portion 162. The open angle $\Psi$ between the surface of proximate arm 156A and hook portion 162 may be less than 90°. Connector component 132 also comprises a beveled surface 160 which joins outward facing surface 131B of panel 130A. The open angle $\gamma$ between beveled surface 160 and outward facing surface 131B of panel 130A may be greater than 270°.

Connector component 134 is part of panel 130B and comprises a curved protrusion or prong 164 which initially extends away from inward facing surface 131A of panel 130B. The radius of curvature of prong 164 may vary along the length of prong 164. Depending on the curvature of prong 164, a distal portion of prong 164 may curve back toward inward facing surface 131A of panel 130. Connector component 134 also comprises a plurality of projections 166, 168, 170, 172 which extend from prong 164 at spaced apart locations therealong. In the illustrated embodiment, each of projections 166, 168, 170, 172 comprises a distal lobe 166A, 168A, 170A, 172A and a proximate lobe 166B, 168B, 170B, 172B. Distal lobe 166A may comprise a forward surface 166A' (closer to the end 165 of prong 164) for which the open angle (not explicitly enumerated) between forward surface 166A' and the surface of the central shaft of prong 164 is greater than 90°. Distal lobe 166A may comprise a rearward surface 166A" (further from the end 165 of prong 164) for which the open angle (not explicitly enumerated) between rearward surface 166W and the surface of the central shaft of prong 164 is less than 90°.

Proximate lobe 166B may comprise similar forward and rearward surfaces 166W', 166B" which exhibit similar angular properties as forward and rearward surface 166A', 166A" with respect to the surface of prong 164. Furthermore, although not explicitly enumerated for the sake of clarity, distal lobes 168A, 170A, 172A and proximate lobes 168B, 170B, 172B may comprise forward and rearward surfaces (similar to forward and rearward surfaces 166A', 166A") which exhibit similar angular properties with respect to the surface of prong 164. The relative size of projections 166, 168, 170, 172 (i.e. the distance between the extremities of proximate lobes 166B, 168B, 170B, 172B and distal lobes 166A, 168A, 170A, 172A) may increase as projections 166, 168, 170, 172 are spaced further from the end 165 of prong 164. That is, projection 172 (lobes 172A, 172B) may be larger than projection 170 (lobes 170A, 170B), projection 170 (lobes 170A, 170B) may be larger than projection 168 (lobes 168A, 168B) and projection 168 (lobes 168A, 168B) may be larger than projection 166 (lobes 166A, 166B).

In the illustrated embodiment, connector component 134 also comprises a receptacle 174 in a vicinity of inward surface 131A of panel 130B. Receptacle 174 opens away from inward surface 131A of panel 130B. Connector component 134 also comprises a thumb 175 that extends transversely beyond the region at which prong 164 extends from inward facing surface 131A of panel 130B. Thumb 175 terminates in a beveled surface 176 which joins outward facing surface 131B of panel 130B. The open angle α between beveled surface 176 and outward facing surface 131B of panel 130B may be less than 270°. As explained in more detail below, the angles α, γ of beveled surfaces 176, 160 may be selected such that beveled surface 176 of connector component 134 abuts against beveled surface 160 of connector component 132 when connector components 132, 134 are coupled to one another to form connection 150 (e.g. when outward facing surfaces 131B of panels 130A, 130B are parallel to one another to form a portion of wall segments 127, 129).

The coupling of connector components 132, 134 to one another to form connection 150 between wall segments 130A, 130B is now described with reference to FIG. 7A-7E. A user starts by placing wall segments 130A, 130B into the configuration shown in FIG. 7A. In the FIG. 7A configuration, the end 165 of prong 164 is clear of receptacle 154 between arms 156A, 156B. In the illustrated embodiment, the angle θ between the inward facing surfaces 131A of panel 130A and panel 130B may be less than about 45° when panels 130A, 130B are in the FIG. 7A configuration.

As shown in FIG. 7B, a user then starts effecting a relative pivotal (or quasi-pivotal) motion between panel 130A and panel 130B as shown by arrow 177. The end 165 of prong 164 approaches the end 156B' of arm 156B and opening 161 of receptacle 154. Contact between the end 165 of prong 164 and the end 156B' of arm 156B may cause deformation of prong 164 (e.g. in the direction of arrow 178) and/or the deformation of arm 156B (e.g. in the direction of arrow 179). Contact between the end 165 of prong 164 and the end 156W of arm 156B is not necessary. In some embodiments, the relative pivotal movement between panel 130A and panel 130B may cause the end 165 of prong 164 to project at least partially into opening 161 of receptacle 154 without contacting arms 156A, 156B. In the FIG. 7B configuration, the angle θ between the inward facing surfaces 131A of panel 130A and panel 130B may be in a range of 30°-75°.

Figure 7C:
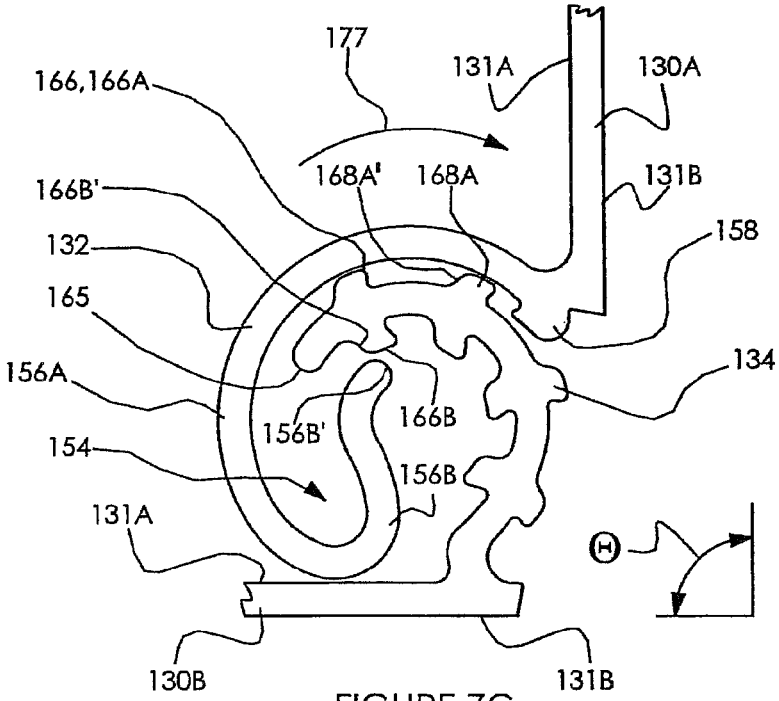

As shown in FIG. 7C, the user continues to effect relative pivotal (or quasi-pivotal) motion between panel 130A and panel 130B as shown by arrow 177. As a consequence of this relative pivotal motion, end 165 of prong 164 begins to project past the end 156W of arm 156B and through opening 161 of curved receptacle or channel 154. As projection 166 enters curved receptacle 154, distal lobe 166A may contact proximate aim 156A while proximate lobe 166B may contact distal arm 156B. This contact may cause deformation of proximate arm 156A, distal arm 156B and/or prong 164 as curved prong 164 moves into curved receptacle 154. The angle (greater than 90°) of forward surface 166W of proximate lobe 166B may facilitate this deformation as forward surface 166B' contacts the end 156W or arm 156B. In addition, as curved prong 164 enters curved receptacle 154, there may be contact between distal lobes 166A, 168A and protrusion 158. Such contact may cause deformation of proximate arm 156A, distal arm 156B and/or prong 164. The angle (greater than 90°) of forward surfaces 166A', 168A' of distal lobes 166A, 168A may facilitate this deformation as forward surfaces 166A', 168A' contact protrusion 158. In the FIG. 7C configuration, the angle θ between the inward facing surfaces 131A of panel 130A and panel 130B may be in a range of 75°-105°.

Figure 7D:
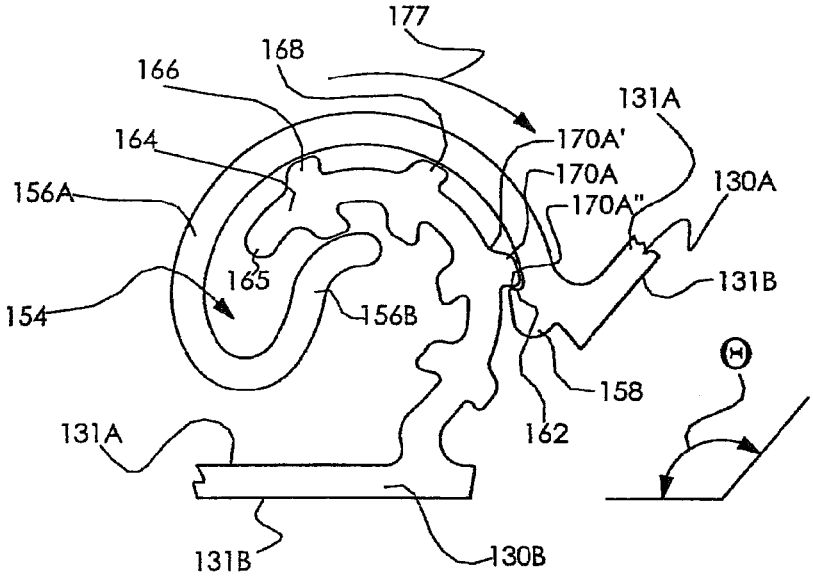

In the illustrated view of FIG. 7D, the user continues to effect relative pivotal (or quasi-pivotal) motion between panel 130A and panel 130B as shown by arrow 177. The FIG. 7D configuration is similar in many respects to the FIG. 7C configuration, except that curved prong 164 projects further into curved receptacle 154. As prong 164 continues to project into receptacle 154, there may be contact between distal lobe 170A and protrusion 158. Such contact may cause the deformation of proximate arm 156A, distal arm 156B and/or prong 164. The angle (greater than 90°) of forward surface 170A' of distal lobe 170A may facilitate this deformation as forward surface 170A' contacts protrusion 158. In addition, once protrusion 158 has cleared distal lobe 170A, rearward surface 170A" may interact with hook 162 of protrusion 158 to make it more difficult to decouple connector components 132, 134. More particularly, the angle (less than 90°) between rearward surface 170A" and the surface of the shaft of prong 164 and the angle Ψ (FIG. 7A, less than 90°) of hook 162 tend to prevent pivotal motion of panel 130A with respect to panel 130B in a direction opposite that of arrow 177. While the interaction between rearward surface 170A" and hook 162 is explained above, it will be appreciated that the rearward surfaces 166A", 168A", 172A" could also interact with hook 162 in a similar manner to help prevent pivotal motion of panel 130A with respect to panel 130B in a direction opposite that of arrow 177. In the FIG. 7D configuration, the angle θ between the inward facing surfaces 131A of panel 130A and panel 130B may be in a range of 105°-150°.

Figure 7E:
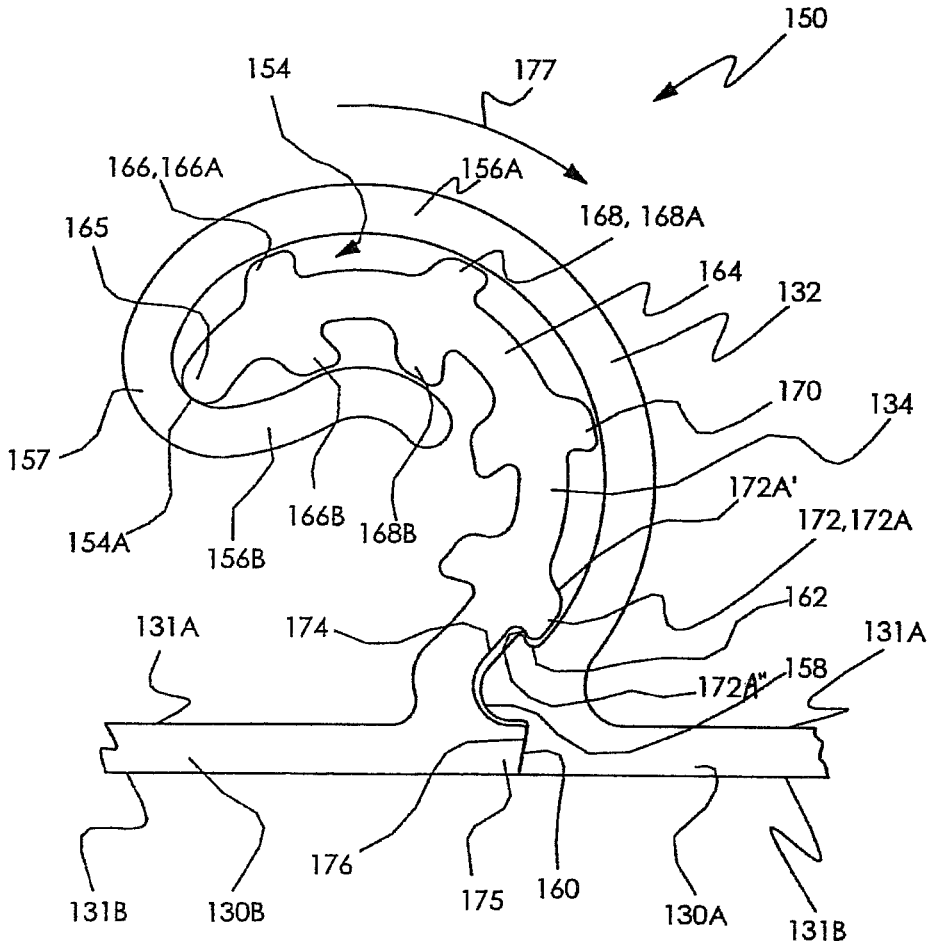

The user continues to effect relative pivotal (or quasi-pivotal) motion between panel 130A and panel 130B as shown by arrow 177 until panels 130A and 130B reach the configuration of FIG. 7E. In the configuration of FIG. 7E, the inward facing surfaces 131A and outward facing surfaces 131B of panels 130A, 130B are generally parallel (i.e. the angle between inward facing surfaces 131A of panels 130A, 130B is at or near 180°. As prong 164 continues to project into receptacle 154, there may be contact between distal lobe 172A and protrusion 158. Such contact may cause the deformation of proximate arm 156A and/or prong 164. The angle (greater than 90°) of forward surface 172A' of distal lobe 172A may facilitate this deformation as forward surface 172A' contacts protrusion 158. In addition, once protrusion 158 has cleared distal lobe 172A, protrusion 158 may snap (e.g by restorative deformation force) into receptacle 174. In the illustrated embodiment, a portion of receptacle 174 comprises rearward surface 172A" of distal lobe 172A. Once received in receptacle 174, rearward surface 172A" of distal lobe 172A interacts with hook 162 of protrusion 158 to lock connector components 132, 134 to one another. More particularly, the angle (less than 90°) between rearward surface 172A" and the surface of prong 164 and the angle Ψ (less than 90°) of hook 162 tend to prevent pivotal motion of panel 130A with respect to panel 130B in a direction opposite that of arrow 177. In addition, receptacle 174 comprises a depression into the distal surface of prong 164. The "snapping" (e.g by restorative deformation force) of protrusion 158 into the depression of receptacle 174 tends to help prevent pivotal motion of panel 130A with respect to panel 130B in a direction opposite that of arrow 177.

In the FIG. 7E configuration, there is preferably contact between a plurality of distal lobes (e.g. distal lobes 166A, 168A) and proximate arm 156A within receptacle 154 and there is preferably contact between a plurality of proximate lobes (e.g. proximate lobes 166B, 168B) and distal arm 156B. For clarity, this contact is not explicitly shown in the FIG. 7E illustration. Such contact may cause deformation of arm 156A, arm 156B and/or prong 164. In this manner, restorative deformation forces tend to force proximate arm 156A against distal lobes 166A, 168A and distal arm 156B against proximate lobes 166B, 168B. In some embodiments, projections 166, 168 and arms 156A, 156B are dimensioned such that contact between projection 166 and arms 156A, 156B and contact between projection 168 and arms 156A, 156B occur at approximately the same relative orientation of panels 130A, 130B. In particular embodiments, the restorative deformation forces at the points of contact between projection 166 and arms 156A, 156B and the restorative deformation forces at the points of contact between projection 168 and arms 156A, 156B are approximately equal or within 20% of one another.

In the illustrated embodiment, there is also contact between end 165 of prong 164 and the end 154A of curved receptacle 154 (i.e. in bight 157 between arms 156A, 156B). The contact between projections 166, 168 and arms 156A, 156B, between the end 165 of prong 164 and the end 154A of curved receptacle 154 and between protrusion 158 and receptacle 174 may provide a seal that is impermeable to liquids (e.g. water) or gasses (e.g. air). In some embodiments, the surfaces of arms 156A, 156B, projections 166, 168, 170, 172, protrusion 158 and/or receptacle 174 may be coated with suitable material(s) which may increase this impermeability. Non-limiting examples of such material(s) include silicone, urethane, neoprene, polyurethane, food grade plastics and the like. In addition to being coated with suitable coating materials, the contact surfaces between arms 156A, 156B and projections 166, 168 may be provided with friction enhancing surface textures (e.g. ridges having saw-tooth shapes or other shapes), which may help to prevent pivotal motion of panel 130A with respect to panel 130B in a direction opposite that of arrow 177.

In the configuration of FIG. 7E, beveled surface 176 of male connector component 134 abuts against beveled surface 160 of female connector component 132. As discussed above, the respective angles $\phi$, $\alpha$ of beveled surface 160, 176 with respect to outward facing surfaces 131B of their corresponding panels 130A, 130B are selected such that beveled surfaces 160, 176 abut against one another when connector components 132, 134 are in the FIG. 7E configuration (i.e. when panels 130A, 130B are generally parallel to one another). Beveled surfaces 160, 176 may also be coated with suitable coating materials or provided with friction enhancing surface textures to improve the impermeability or increase the friction of the abutment joint therebetween. It will be appreciated that connecting panels 130A, 130B to form connection 150 need not proceed through all of the steps shown in FIGS. 7A-7E. Panels 130A, 130B may start in a configuration similar to that of FIG. 7C and then proceed through the configurations of 7D and 7E, for example.

Figure 7F:
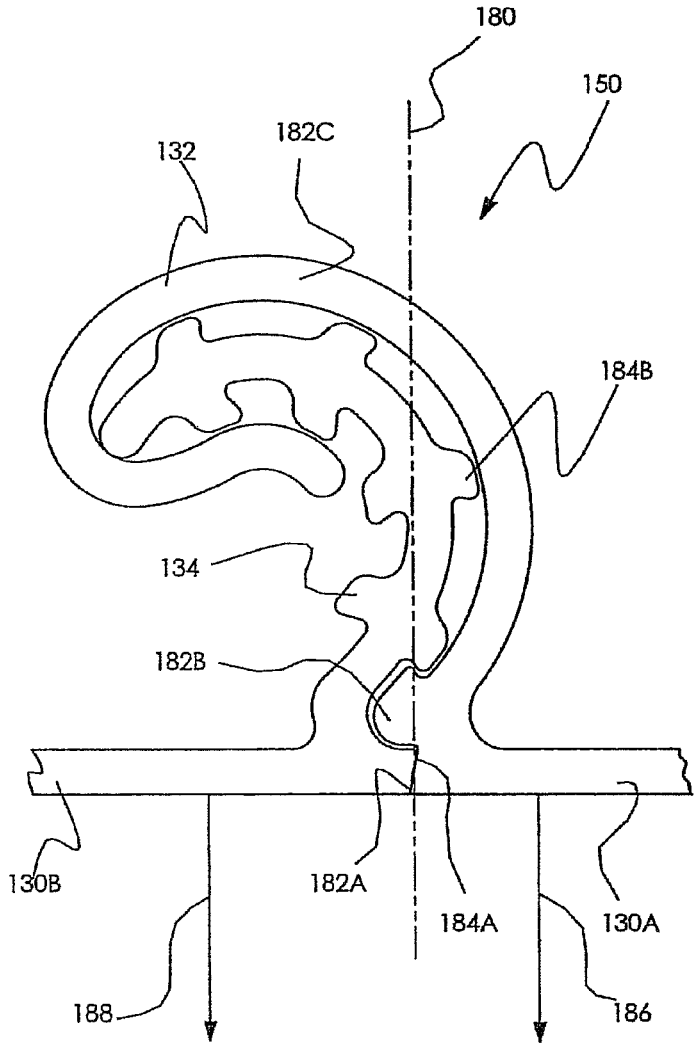
FIG. 7F is a magnified partial plan view of the connector components for implementing edge-to-edge connections between edge-adjacent panels of the forms of FIGS. 3, 4, 5A and 5B which shows the interleaved protrusions between the connector components.

FIG. 7F is another schematic view of connection 150 between connector components 132, 134 of panels 130A, 130B which shows a transverse midplane 180 of connection 150. It can be seen from FIG. 7F that connector component 132 comprises a plurality of projecting elements 182A, 182B, 182C which project transversely from one side of midplane 180 (i.e. the side of panel 130A) to the opposing side of midplane 180 Similarly, connector component 134 comprises a plurality of projecting elements 184A, 184B which project transversely from one side of midplane 180 (i.e. the side of panel 130B) to the opposing side of midplane 180. These projecting elements 182A, 182B, 182C, 184A, 184B interleave with one another to provide multiple points of contact (abutments) which tend to prevent connection 150 from unzipping. More particularly, as shown in FIGS. 7E and 7F, projecting element 182A corresponds to the abutment between beveled surfaces 176, 160, projecting element 184A corresponds to the abutment of protrusion 158 and thumb 175, projecting element 182B corresponds to the abutment of hook 162 of protrusion 158 and rearward surface 172A" of projection 172A and projecting elements 184B, 182C correspond to the interaction between projections 166, 168, 170 on prong 164 and arms 156A, 156B.

Interleaved projecting elements 182A, 182B, 182C, 184A, 184B tend to prevent connection 150 from unzipping. More particularly, if a disproportionately large amount of outward force 186 is applied to panel 130A (relative to panel 130B), then the contact between protrusion 158 and thumb 175 and the contact between proximate arm 156A and prong 164 both tend to prevent unzipping of connection 150. Similarly, if a disproportionately large amount of outward force 188 is applied to panel 130B (relative to panel 130A), then the contact between beveled surfaces 160, 176, the contact between rearward surface 172A" of distal lobe 172A and hook 162 of protrusion 158 and the contact between prong 164 and distal arm 156B all tend to prevent unzipping of connection 150.

In addition, when connection 150 formed by interleaved projecting elements 182A, 182B, 182C, 184A, 184B is encased in concrete and the concrete is allowed to solidify, the solid concrete may exert forces that tend to compress interleaved projecting elements 182A, 182B, 182C, 184A, 184B toward one another.

In the FIG. 3 embodiment, form 128 comprises support members 136 which extend between wall segments 127, 129. Support members 136 are also shown in FIG. 6B. Support members 136 comprise connector components 142 at their edges for connecting to corresponding connector components 138 on inward surfaces 131A of panels 130. Support members 136 may brace opposing panels 130 and connect wall segments 127, 129 to one another.

In the illustrated embodiment, connector components 138 on inward surfaces 131A of panels 130 are male T-shaped connector components 138 which slide into the receptacles of female C-shaped connector components 142 at the edges of support members 136. This is not necessary. In general, where form 128 includes support members 136, connector components 138,142 may comprise any suitable complementary pair of connector components and may be coupled to one another by sliding, by deformation of one or both connector components or by any other suitable coupling technique. By way of non-limiting example, connector components 138 on panels 130 may comprise female C-shaped connectors and connector components 142 on support members 136 may comprise male T-shaped connectors which may be slidably coupled to one another.

In the illustrated embodiment of FIG. 3, each panel 130 comprises three connector components 138 between its edges 115, 117 (i.e. between connector components 132, 134), which facilitate the connection of up to three support members 136 to each panel 130. This is not necessary. In general, panels 130 may be provided with any suitable number of connector components 138 to enable the connection of a corresponding number of support members 136, as may be necessary for the particular strength requirements of a given application. In addition, the mere presence of connector components 138 on panels 130 does not necessitate that support members 136 are connected to each such connector component 138. In general, the spacing of support members 136 may be determined as necessary for the particular strength requirements of a given application and to minimize undesirably excessive use of material.

Support members 136 are preferably apertured (see apertures 119 of FIG. 6B) to allow liquid concrete to flow in the transverse directions between wall segments 127, 129. Although not explicitly shown in the illustrated views, reinforcement bars (commonly referred to as rebar) may also be inserted into form 128 prior to pouring the liquid concrete.

Where required or otherwise desired, transversely extending rebar can be inserted so as to extend through apertures 119 in support members 136. If desired, vertically extending rebar can then be coupled to the transversely extending rebar.

Figure 4:
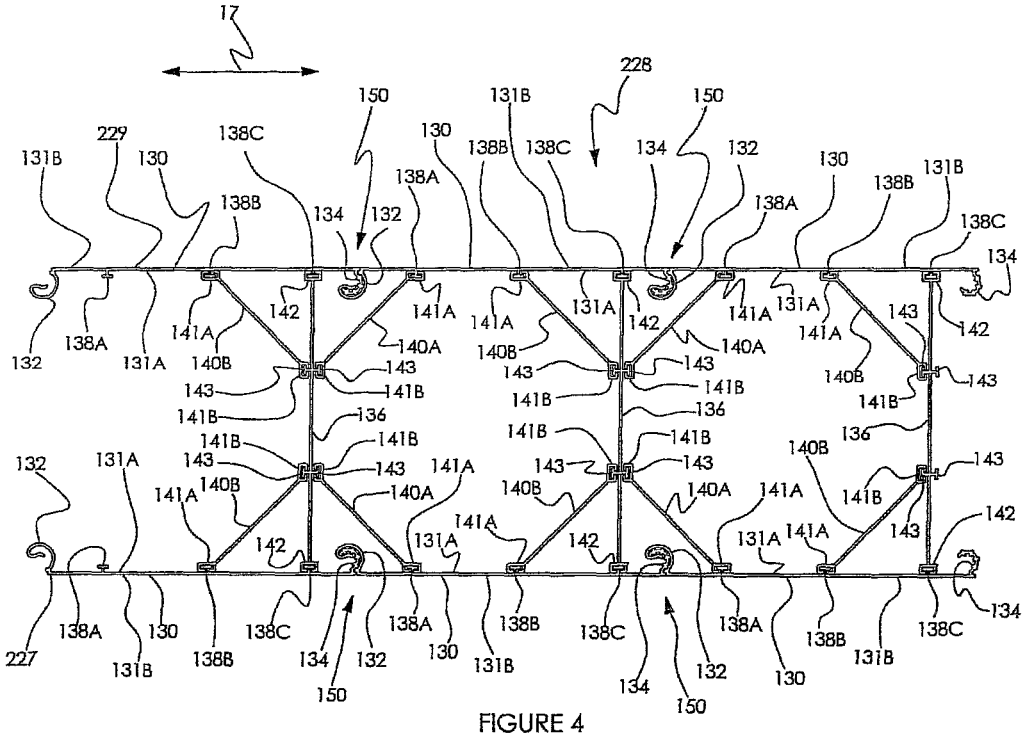
FIG. 4 is a top plan view of a modular stay-in-place form according to another particular embodiment of the invention.

FIG. 4 is a partial top plan view of a modular stay-in-place form 228 according to another particular embodiment of the invention which may be used to form a wall of a building or other structure. Form 228 of FIG. 4 incorporates panels 130 and support members 136 which are substantially identical to panels 130 and support members 136 of form 128 and similar reference numbers are used to refer to the similar features of panels 130 and support members 136. Panels 130 are connected as described above (at connections 150) in edge-adjacent relationship to provide wall segments 227, 229. Form 228 differs from form 128 in relation to the spacing in the transverse direction (arrow 17) between adjacent support members 136. Form 228 also incorporates tensioning members 140A, 140B (collectively, tensioning members 140) which are not present in form 128. Tensioning members 140 are also illustrated in FIG. 6C.

In the FIG. 4 embodiment, connector components 138 on inward surfaces 131A of panels 130 are referred to individually using reference numerals 138A, 138B, 138C. Connector component 138A is most proximate to first, generally female connector component 132 on edge 115 (FIG. 6A) of panel 130, connector component 138C is most proximate to second, generally male connector component 134 on edge 117 (FIG. 6A) of panel 130 and connector component 138B is located between connector components 138A, 138C. In the illustrated embodiment of FIG. 4, support members 136 extend between every third connector component 138 to provide one support member 136 per panel 130. More particularly, in the FIG. 4 embodiment, support members 136 extend between connector components 138C of opposing panels 130 on wall segments 227 and 229. The connection between connector components 142 of support members 136 (which, in the illustrated embodiment are female C-shaped connector components) and connector components 138C of panels 130 (which in the illustrated embodiment are male T-shaped connector components) may be substantially similar to the connections discussed above for form 128. However, this is not necessary. In general, connector components 138 and 142 may be any complementary pairs of connector components and may be coupled to one another by sliding, by deformation of one or both connector components or by any other suitable coupling technique.

Form 228 incorporates tensioning members 140 which extend angularly between support members 136 and panels 130. In the illustrated embodiment, tensioning members 140 comprise connector components 141A, 141B at their opposing edges. Connector components 141A are complementary to connector components 138A, 138B on inward surfaces 131A of panels 130 and connector components 141B are complementary to connector components 143 on support members 136. In the illustrated embodiment, connector components 138A, 138B of panels 130 and connector components 143 of support members 136 are male T-shaped connector components which slide into the receptacles of female C-shaped connector components 141A, 141B of tensioning members 140. However, this is not necessary. In general, connector components 138 and 141A and connector components 143 and 141B may be any complementary pairs of connector components and may be coupled to one another by sliding, by deformation of one or both connector components or by any other suitable coupling technique.

Figure 6C:
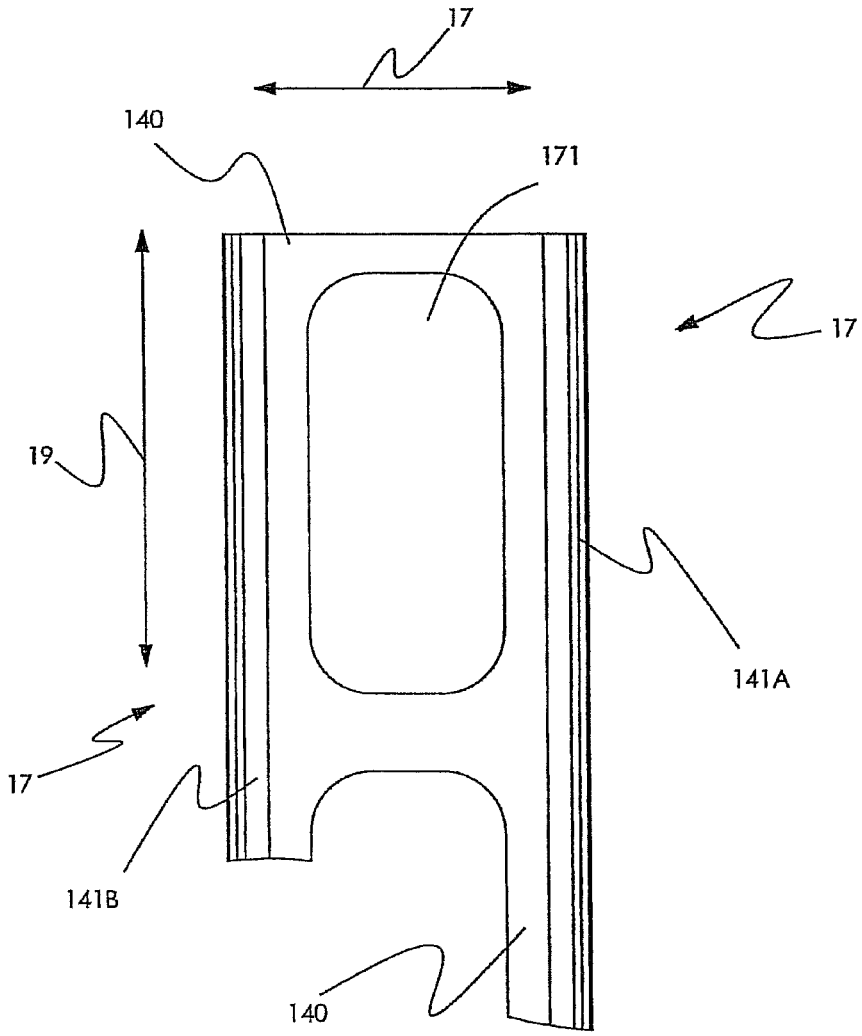

Tensioning members 140 preferably comprise apertures 171 which allow concrete flow and for the transverse extension of rebar therethrough (see FIG. 6C).

As mentioned above, in the illustrated embodiment, support members 136 extend between connector components 138C of opposing panels 130 of wall segment 229 and wall segment 227. With this configuration of support members 136 relative to panels 130, one tensioning member 140A out of every pair of tensioning members 140 can be made to reinforce connections 150 between panels 130. More particularly, tensioning members 140A may extend at an angle from support member 136 (i.e. at the connection between connector components 141B, 143) on one transverse side of connection 150 to panel 130 (i.e. at the connection between connector components 141A, 138A) on the opposing transverse side of connection 150. The other tensioning member 140B of each pair of tensioning members 140 may extend at an angle between support member 136 (i.e. at the connection between connector components 141B, 143) to panel 130 (i.e. at the connection between connector components 141A, 138B).

Tensioning members 140A, which span from one transverse side of connections 150 to the opposing transverse side of connections 150, add to the strength of connections 150 and help to prevent unzipping of connections 150. However, it is not necessary that tensioning members 140A span connections 150 in this manner. In other embodiments, support members 136 may extend between wall segments 227, 229 at different connector components. By way of non-limiting example, support members 136 may extend between wall segments 227, 229 at the midpoint of each panel 130, such that connector components 142 of support members 136 are coupled to connector components 138B of panels 130. With this configuration of support members 136 relative to panels 130, tensioning members 140 may extend at angles between support members 136 (i.e. a connection between connector components 141A, 143 and a connection between connector components 141B, 143) and panels 130 (i.e. a connection between connector components 141A, 138A and a connection between connector components 141A, 138C).

In some embodiments, tensioning members 140 are not necessary. Tensioning members 140 need not generally be used in pairs. By way of non-limiting example, some forms may use only tensioning members 140A which may or may not be configured to span connections 150. In some embodiments, support members 136 and/or tensioning members 140 may be employed at different spacings within a particular form. Form 228 incorporates components (i.e. panels 130 and support members 136) which are substantially similar to the components of form 128 described herein. In various different embodiments, form 228 may be modified as discussed herein for any of the modifications described for form 128.

In operation, forms 128, 228 may be used to fabricate a wall by pivotally connecting panels 130 to make connections 150 between edge-adjacent panels 130 and by slidably connecting connector components 142 of support members 136 to connector components 138 of panels 130 to connect wall segments 127, 129 to one another. If it is desired to include tensioning members 140, tensioning members 140 may then be attached between connector components 143 of support members 136 and connector components 138 of panels 130. Panels 130 and support members 136 may be connected to one another in any orientation and may then be placed in a vertical orientation after such connection. Walls and other structures fabricated from panels 130 generally extend in two dimensions (referred to herein as the vertical dimension (see arrow 19 of FIGS. 6A and 6B) and the transverse dimension (see arrow 17 of FIG. 3)). However, it will be appreciated that walls and other structures fabricated using forms 128, 228 can be made to extend in any orientation and, as such, the terms "vertical" and "transverse" as used herein should be understood to include other directions which are not strictly limited to the conventional meanings of vertical and transverse. In some embodiments, panels 130 may be deformed or may be prefabricated such that their transverse extension has some curvature.

If necessary or otherwise desired, transversely extending rebar and/or vertically extending rebar can then be inserted into form 128, 228. After the insertion of rebar, liquid concrete may be poured into form 128, 228. When the liquid concrete solidifies, the result is a wall or other structure that has two of its surfaces covered by stay-in-place form 128, 228.

Figure 10A:
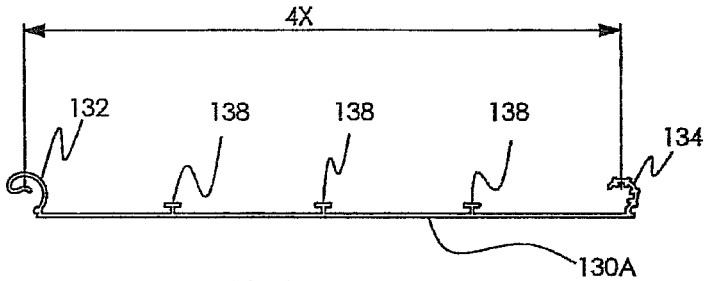
FIGS. 10A-10D are plan views showing modular panels used in the forms of FIGS. 3 and 4 and having different transverse dimensions.
Figure 10B:
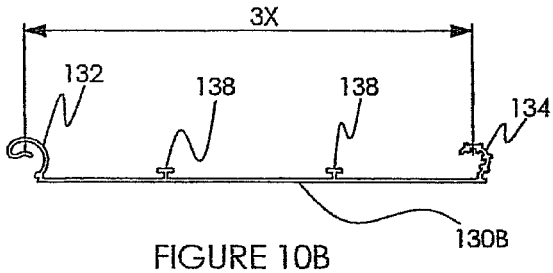
Figure 10C:
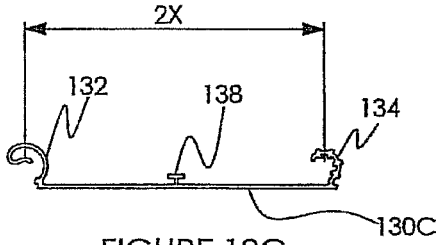
Figure 10D:
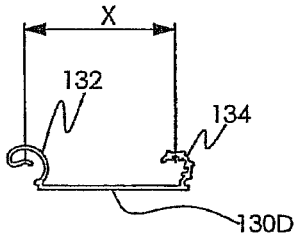

Panels 130 of forms 128, 228 may be provided in modular units with different transverse dimensions as shown in FIGS. 10A, 10B, 10C and 10D. Panel 130D of FIG. 10D has a transverse dimension X between connector components 132, 134 and has no connector components 138 for connection to support members 136 or tensioning members 140. Panel 130D may be referred to as a single-unit panel. Panel 130C of FIG. 10C is a double-unit panel, with a transverse dimension 2× between connection components 132, 134 and a single connector component 138 for possible connection to a support member 136 or a tensioning members 140. Similarly, panels 130B, 130A of FIGS. 10B, 10A are triple and quadruple-unit panels, with transverse dimensions 3×, 4× between connector components 132, 134 and two and three connector components 138 respectively for possible connection to support members 136 or tensioning members 140.

Figure 11A:
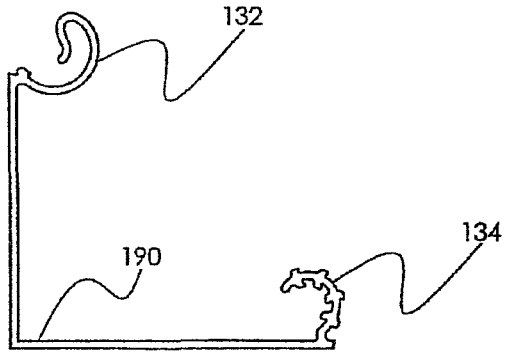
FIGS. 11A and 11B are plan views of an inside corner element and an outside corner element suitable for use with the forms of FIGS. 3 and 4.
Figure 11B:
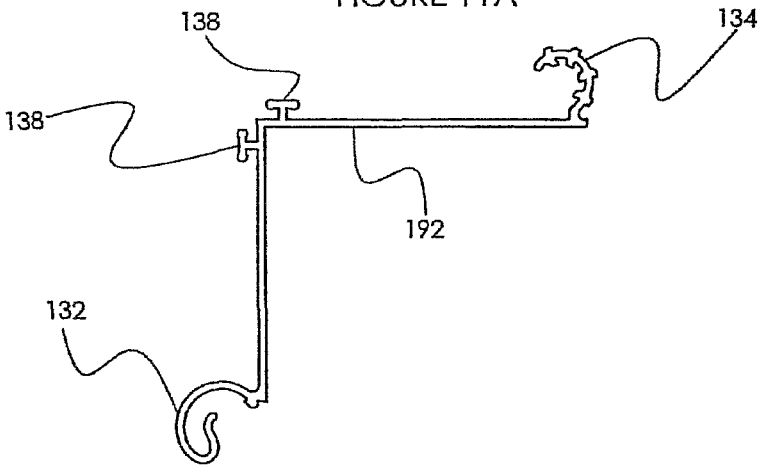
Figure 11C:
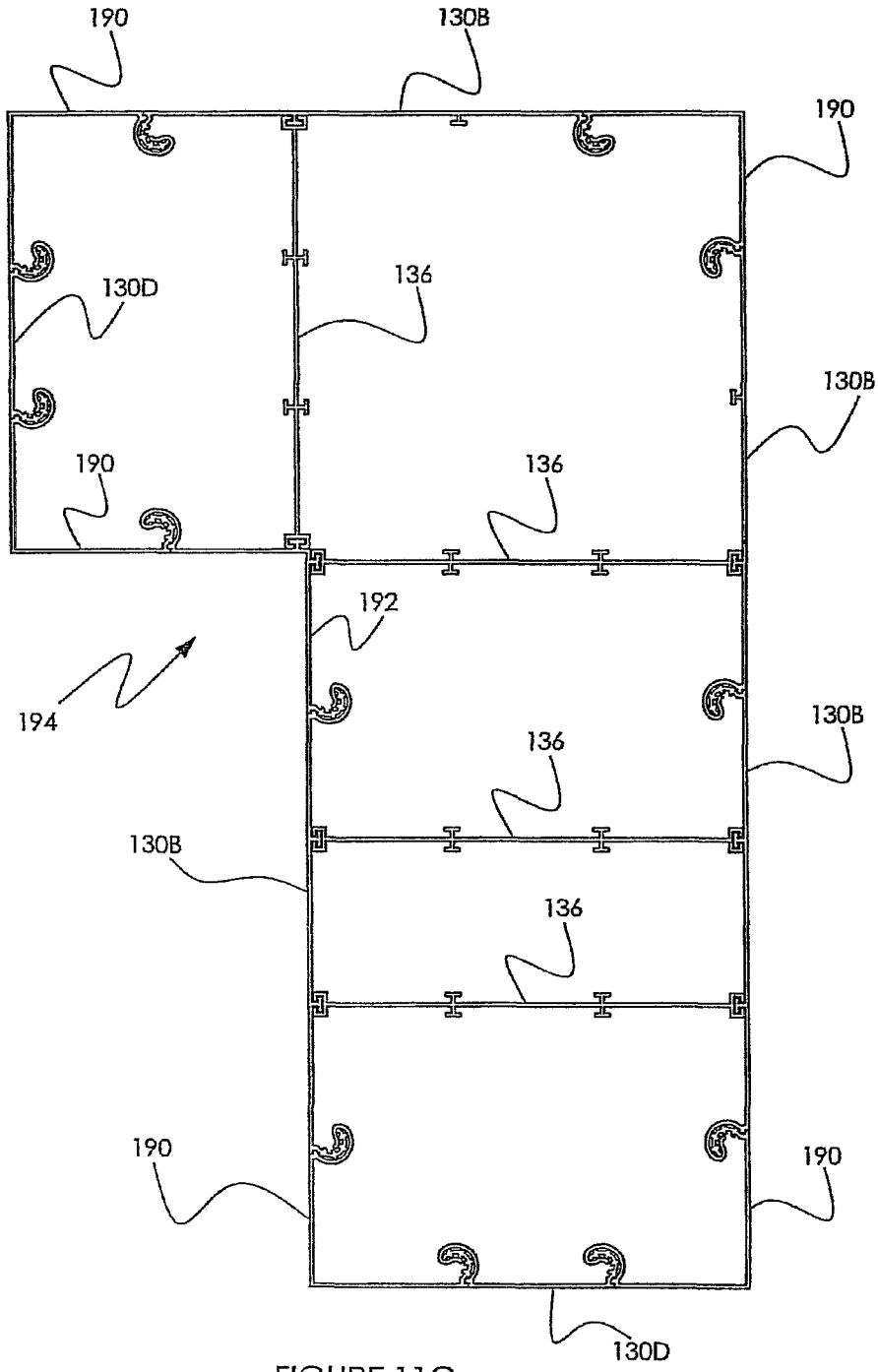
FIG. 11C is a plan view of a complete wall form incorporating the inside and outside corner elements of FIGS. 11A and 11B.

FIGS. 11A and 11B are plan views of an inside 90° corner element 190 and an outside 90° corner element 192 suitable for use with the forms of FIGS. 3 and 4 and FIG. 11C is a plan view of a complete wall form 194 incorporating the inside and outside corner elements 190, 192 of FIGS. 11A and 11B. In the illustrated embodiment, inside corner element 190 comprises a generally female curved connector component 132 at one of its edges and a generally male curved connector component 134 at is opposing edge Similarly, the illustrated embodiment of outside corner element 192 comprises a generally female curved connector component 132 at one of its edges and a generally female curved connector component 134 at is opposing edge. Connector components 132, 134 are substantially similar to connector components 132, 134 on panels 130 and are used in a manner similar to that described above to connect corner components 190, 192 to panels 130 or to other corner components 190, 192. In the illustrated embodiment, outside corner element 192 also comprises a pair of connector components 138 for connection to support members 136 or tensioning members 140.

FIG. 11C schematically illustrates a complete wall form 194 fabricated using a series of panels 130, inside and outside corner components 190, 192 and support members 136. In the particular example form 194 of FIG. 11C, panels 130 include single-unit panels 130D and triple-unit panels 130B. It will be appreciated that wall form 194 of FIG. 11C represents only one particular embodiment of a wall form assembled according to the invention and that wall forms having a wide variety of other shapes and sizes could be assembled using the components described herein. In the illustrated example of FIG. 11C, wall form 194 is assembled without tensioning members 140. In other embodiments, tensioning members 140 may be used as described above.

Figure 5A:
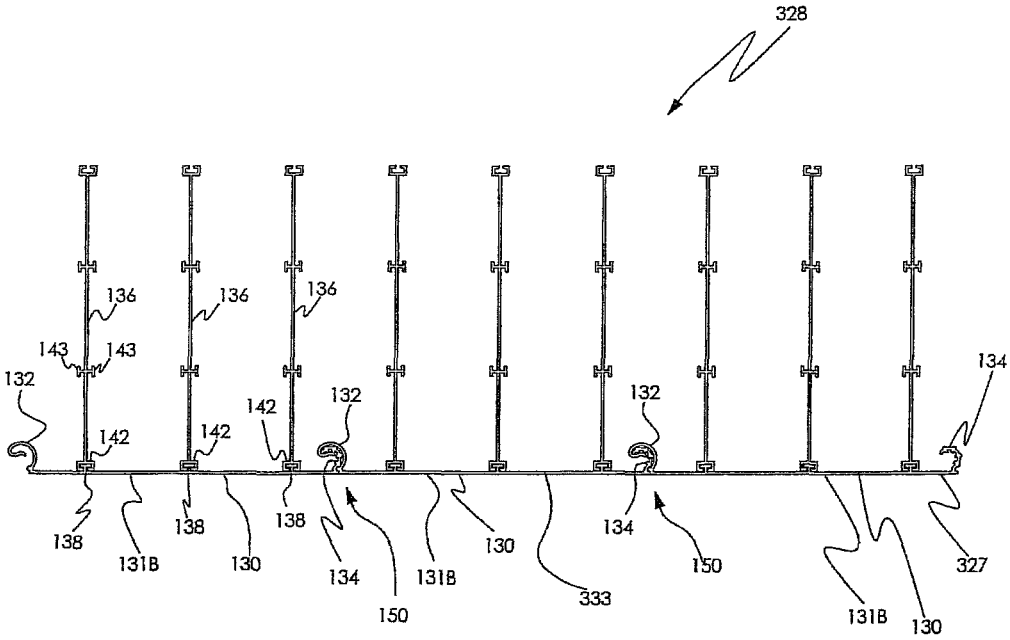
FIGS. 5A and 5B are plan views of modular stay-in-place forms which may be used to fabricate a tilt-up wall according to other particular embodiments of the invention.
Figure 5B:
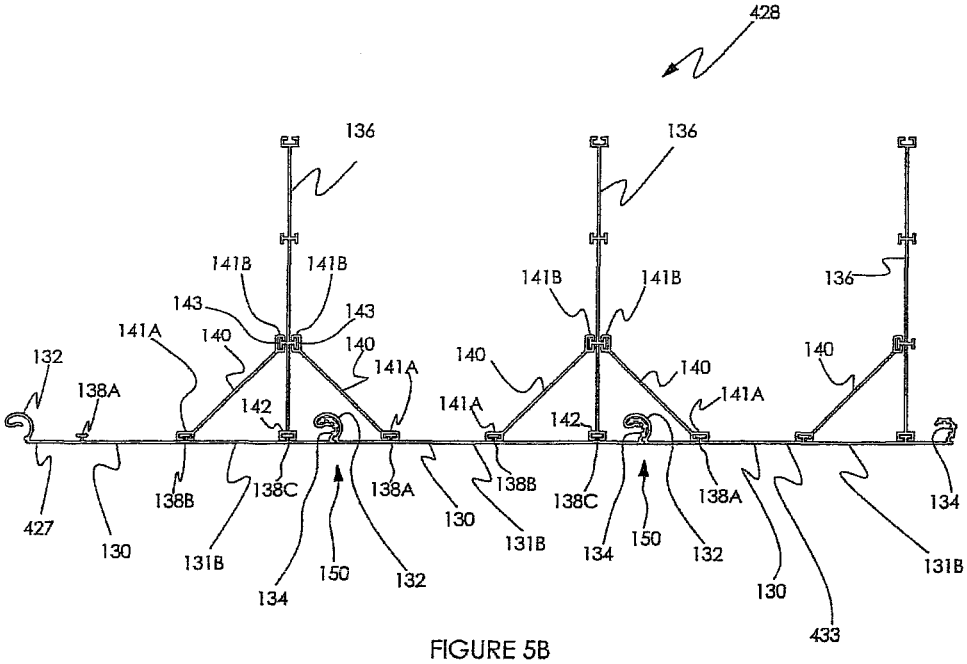

FIGS. 5A and 5B respectively represent modular stay-in-place forms 328, 428 which may be used to fabricate tilt-up walls according to other particular embodiments of the invention. The modular components of form 328 (FIG. 5A) and their operability are similar in many respects to the modular components of form 128 (FIG. 3). In particular, form 328 (FIG. 5A) incorporates panels 130 and support members 136 which are similar to panels 130 and support members 136 of form 128 and are connected to one another as described above to form a single wall segment 327 that is substantially similar to wall segment 127 of form 128. Form 328 differs from form 128 in that form 328 does not include panels 130 to form a wall segment that opposes wall segment 327 (i.e. form 328 comprises a single-sided form and does not include an opposing wall segment like wall segment 129 of form 128).

The modular components of form 428 (FIG. 5B) and their operability are similar in many respects to the modular components of form 228 (FIG. 4). In particular, form 428 (FIG. 5B) incorporates panels 130, support members 136 and tensioning members 140 which are similar to panels 130, support members 136 and tensioning members 140 of form 228 and are connected to one another as described above to form a single wall segment 427 that is substantially similar to wall segment 227 of form 228. Faun 428 differs from form 228 in that form 428 does not include panels 130 to form a wall segment that opposes wall segment 427 (i.e. form 428 comprises a single-sided form and does not include an opposing wall segment like wall segment 229 of form 228). In addition, form 428 differs from form 228 in that form 428 only includes tensioning members 140 that connect to wall segment 427 (i.e. form 428 does not include tensioning members 140 that attach to an opposing wall segment like wall segment 229 of form 228).

In operation, forms 328, 428 are assembled by coupling connector components 132, 134 of panels 130 together as described above to fabricate a single wall segment 327, 427. In form 328, support members 136 are then coupled to panels 130 as described above for form 128, except that the coupling between connector components 142 and connector components 138 is made at one side only. In form 428, support members 136 and tensioning members 140 are then coupled to panels 130 as described above for form 228, except that the coupling between connector components 142 and connector components 138C is made at one side only and tensioning members 140 are coupled to support members 136 (at connector components 141B, 143) and to panels 130 (at connector components 141A, 138B, 138A) at one side only.

Forms 328, 428 may be assembled on, or otherwise moved onto, a generally horizontal table or the like, such that outward facing surfaces 131B of panels 130 are facing downward and the vertical and transverse extension of panels 130 is in the generally horizontal plane of the table. The table may be a vibrating table. In some embodiments a table is not required and a suitable, generally horizontal surface may be used in place of a table. If required, rebar may be inserted into form 328, 428 while the form is horizontally oriented. Transversely extending rebar may project through apertures 119 of support members 136 and apertures 171 of tensioning members 140. Edges (not shown) of form 328, 428 may be fabricated on the table in any suitable manner, such as using conventional wood form-work. Concrete is then poured into form 328, 428 and allowed to flow through apertures 119 of support members 136 and through apertures 171 of tensioning members 140. The liquid concrete spreads to level itself (perhaps with the assistance of a vibrating table) in form 328, 428.

The concrete is then allowed to solidify. Once solidified, the resultant wall is tilted into a vertical orientation. The result is a concrete wall segment (or other structure) that is coated on one side with the panels 130 of form 328, 428. Panels 130 are anchored into the concrete wall by support members 136 and tensioning members 140. Structures (e.g. building walls and the like) may be formed by tilting up a plurality of wall segments in place. Advantageously, the outward facing surfaces 131B of panels 130 provide one surface of the resultant wall made using forms 328, 428. Outward facing surfaces 131B of panels 130 may provide a finished wall surface 333, 433. In some applications, such as in warehouses and box stores for example, it may be desirable to have finished wall surface 333, 433 on the exterior of a building, whereas the finish of the interior wall surface is relatively less important. In such applications, wall segments fabricated using form 328, 428 can be tilted up such that panels 130 have outward facing surfaces 131B oriented toward the exterior of the building. In other applications, such as where hygiene of the interior of a building is important (e.g. food storage), it may be desirable to have finished wall surface 333, 433 on the interior of a building, whereas the finish of the exterior wall surface is relatively less important. In such applications, wall segments fabricated using form 328, 428 can be tilted up such that panels 130 have outward facing surfaces 131B oriented toward the interior of the building.

The use of forms 328, 428 to fabricate tilt-up walls may involve the same or similar procedures (suitably modified as necessary) as those described for the fabrication of tilt-up walls or lined concrete structures using modular stay-in-place forms in the co-owned PCT application No. PCT/CA2008/000608 filed 2 Apr. 2008 and entitled "METHODS AND APPARATUS FOR PROVIDING LININGS ON CONCRETE STRUCTURES" (the "Structure-Lining PCT Application"), which is hereby incorporated herein by reference. Form 328 may be anchored to the concrete by support members 136, by connector components 138 and by connector components 132, 134 of connections 150. Similarly, form 428 may be anchored to the concrete by support members 136, by connector components 138, by connector components 132, 134 of connections 150 and by tensioning members 140. Other anchoring components similar to any of the anchoring components disclosed in the Structure-Lining PCT Application may additionally or alternatively be used.

Figure 8A:
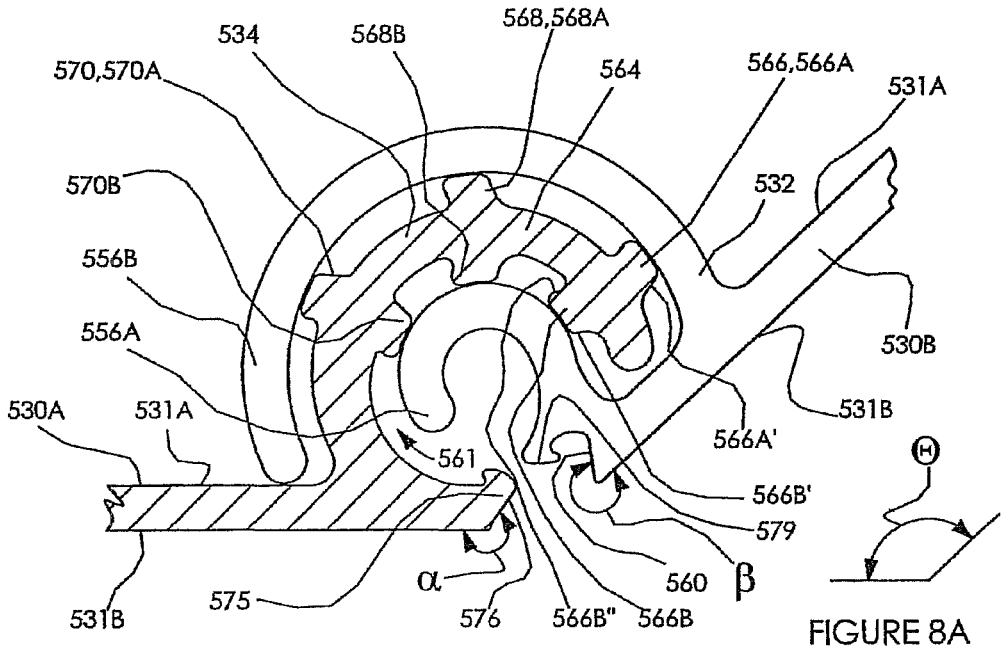
FIGS. 8A-8C represent magnified partial views of curved connector components for implementing edge-to-edge connection between edge-adjacent panels according to another particular embodiment of the invention and a method of coupling the connector components to form such edge-to-edge connections.
Figure 8B:
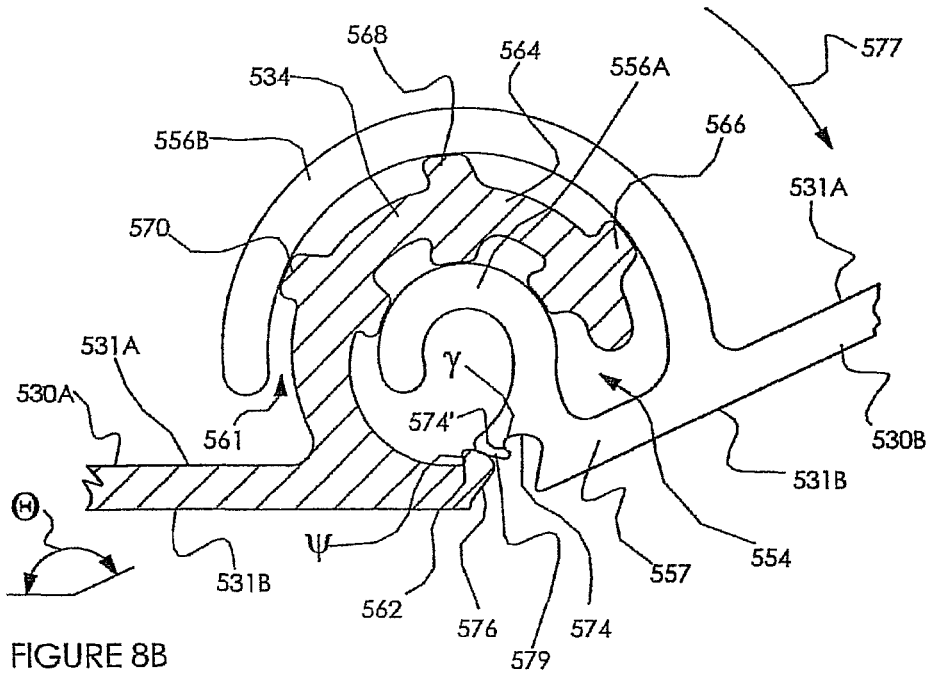
Figure 8C:
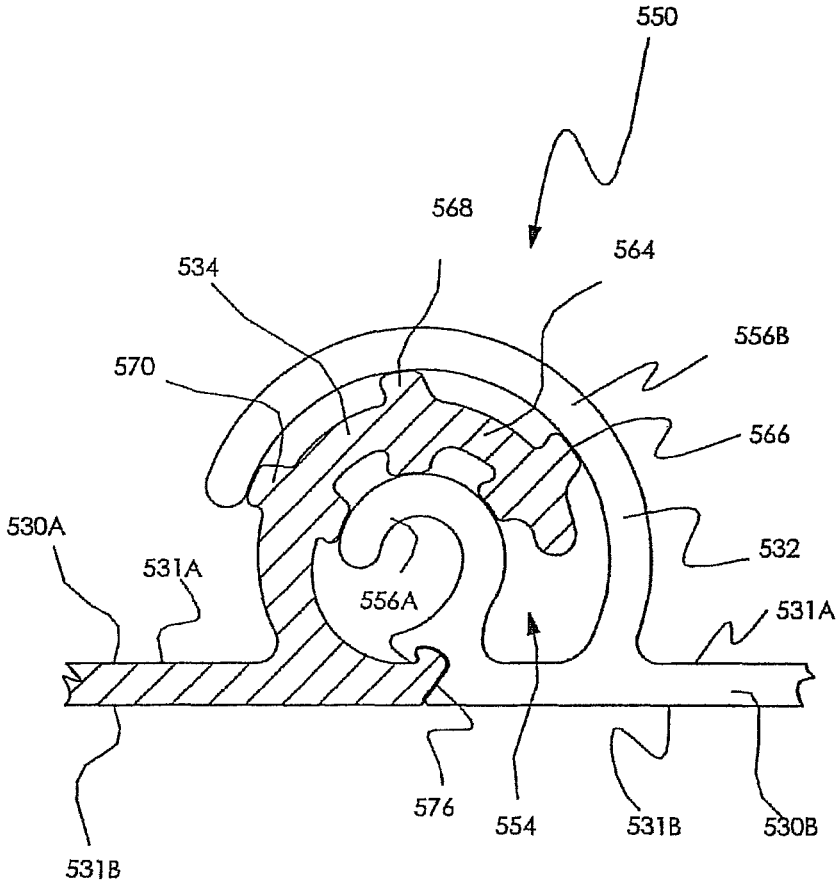

FIGS. 8A-8C schematically illustrate another embodiment of curved connector components 532, 534 and the coupling of first, generally male connector component 534 to second, generally female connector component 532 to make a connection 550 between panels 530A, 530B. For clarity, only portions of panels 530A, 530B are shown in FIGS. 8A-8C, it being understood that panels 530A, 530B may be substantially similar to panels 130 described above, except for connector components 532, 534. Curved connector components 532, 534 and their use to make connection 150 are similar in many respects to connector components 132, 134 described above. For brevity only the differences between connector components 532, 534 and connector components 132, 134 are detailed herein. In other respects, connector components 532, 534 should be understood to be similar to, operate in a manner similar to and incorporate variations which are similar to those of connector components 132, 134.

Male connector component 534 comprises a prong 564. Unlike prong 164 of male connector component 134, prong 564 of male connector component 534 extends generally away from panel 530A in the transverse direction, whereas prong 164 of male connector component 134 generally curves back toward a central portion (not specifically enumerated) of panel 130. Male connector component 534 also comprises a plurality of protrusions 566, 568, 570 having proximate lobes 566A, 568A, 570A and distal lobes 566B, 568B, 570B. As shown in FIG. 8A, lobes 566A, 566B include forward surfaces 566A', 566B' and rearward surfaces 566A", 566B". The angular features of forward surfaces 566A', 566B' and rearward surfaces 566W , 566B" relative to the surface of the shaft of prong 564 may be similar to those of forward surfaces 166A', 166W and rearward surfaces 166W, 166W described above. Furthermore, although not explicitly enumerated for the sake of clarity, distal lobes 568A, 570A and proximate lobes 568B, 570B may comprise similar forward and rearward surfaces which exhibit similar angular properties with respect to the surface of prong 564. In some embodiments, the size of lobes 566, 568, 570 may increase along the extension of prong 564. That is, lobes 566 may be larger than lobes 568 which may be larger than lobes 570.

Male connector component 534 also comprises a thumb 575 similar to thumb 175 of connector component 134. Thumbs 575 comprises a beveled surface 576 which forms an angle $\alpha$ with outward facing surface 131B of connector component 530A. The open angle $\alpha$ may be less than 270°. Thumb 575 also comprises a hook 562 (FIG. 8B). Hook 562 may be on a surface opposite beveled surface 576. Hook 562 may have an open angle $\Psi$ less than 90°.

Female connector component 532 comprises distal curved arm 556A and proximate curved arm 556B, both of which extend away from inward facing surface 531A of panel 530B to define curved receptacle 554. Unlike receptacle 154 of female connector component 132, receptacle 554 of female connector component 532 has a bight 557 (FIG. 8B), which is relatively proximate to inward facing surface 531A of panel 530, and an opening 561, which is relatively distal to inward facing surface 531A of panel 530. In contrast, receptacle 154 of female connector component 132 has a bight 157 which is relatively distal from inward facing surface 131A of panel 130A and an opening 161 which is relatively proximate to inward facing surface 131A of panel 130A. In some embodiments, channel 564 is narrower in the region of opening 561 and increases in width as it gets closer to bight 557.

Female connector component 532 also comprises a receptacle 574 (FIG. 8B) which is similar to receptacle 174 of female connector component 534. Receptacle 574 comprises a thumb 579 which is shaped similarly to thumb 575 of connector component 534 and also comprises a hook 574' which is complementary to hook 562 of male connector component 534. The interior angle $\gamma$ of hook 574' may be less than 90°. One portion of the surface of receptacle 574 or some other surface of female connector component 532 may comprise a beveled surface 560 (FIG. 8A) which is beveled in relation to outward facing surface 531B of panel 530B. In some embodiments, the open angle $\beta$ between beveled surface 560 and outward facing surface 531 B of panel 530B is greater than 270°. In addition, the open angle $\beta$ of beveled surface 560 is preferably complementary with the open angle $\alpha$ of beveled surface 576, such that beveled surfaces 560, 576 abut against one another when connector components 532, 534 are in the connected configuration of FIG. 8C (i.e. when outward facing surfaces 531B of panels 530A, 530B are parallel to one another).

In operation, a user couples connector components 532, 534 to one another (and thereby couples panels 530A, 530B to one another) by sliding panels 530A, 530B relative to one another, such that connector components 532, 534 are partially engaged to one another and then pivoting panels 530A, 530B relative to one another, such that restorative deformation forces lock connector components 532, 534 to one another to complete the connection. The connection of connector components 532, 534 starts with the configuration of FIG. 8A, where a user starts with outward facing surfaces 531B of panels 530A, 530B at an angle $\theta$ in an angular range of 110°-160° relative to one another and then slides panels 530A, 530B relative to one another, such that curved prong 564 projects into curved receptacle 554 as shown in FIG. 8A. The configuration of FIG. 8A may be referred to as a "loose fit" configuration.

The user then begins to pivot panel 530B relative to 530A in the direction of arrow 577 as shown in FIG. 8B. In the configuration of FIG. 8B, the angle θ between outward facing surfaces 531B of panels 530A, 530B may be in an angular range of 135°-170° relative to one another. As panels 530A, 530B pivot relative to one another, prong 564 pulls away from bight 557 toward opening 561 of receptacle 554. As prong 564 is moving in this manner relative to receptacle 554, proximate lobes 566A, 568A, 570A engage proximate arm 556B and distal lobes 566B, 568B, 570B engage distal arm 556A. This interaction between lobes 566A, 568A, 570A, 566B, 568B, 570B and arms 556A, 556B causes deformation of prong 564 and/or arms 556A, 556B. Restorative deformation forces between arms 556A, 556B and prong 564 tends to increase the strength of the resultant connection 550 between connector components 532, 534. Also, in a manner similar to that of connection 150 described above, interaction between lobes 566A, 568A, 570A, 566B, 568B, 570B and arms 556A, 556B may provide a seal that makes connections 550 impermeable to liquid (e.g. water) or gas (e.g. air). The contact surfaces of connector components 532, 534 may be coated with suitable coating materials and/or may be provided with suitable surface textures which enhance this seal and/or the friction between contact surfaces.

Finally, the user continues to pivot panel 530B relative to panel 530A in the direction of arrow 577, until hook 562 of thumb 575 is received in receptacle 574 and hooks 562, 574' engage one another such that connector components 532, 534 are locked to one another as shown in FIG. 8C. Between the configuration of FIGS. 8B and 8C, thumb 579 of connector component 532 interacts with thumb 575 of connector component 534 to cause deformation of prong 564 and/or arm 556A. Thus, when panels 530A, 530B are pivoted sufficiently far, restorative deformation forces cause hook 562 to "snap" into receptacle 574 where hooks 562, 574' engage one another. In addition, when panels 530A, 530B are pivoted to the configuration of FIG. 8C, beveled surfaces 576, 560 engage one another. Beveled surfaces 576, 560 and/or the contact surfaces of hooks 562, 574' may be coated with suitable coating materials or provided with suitable surface texturing as described above.

Figure 9A:
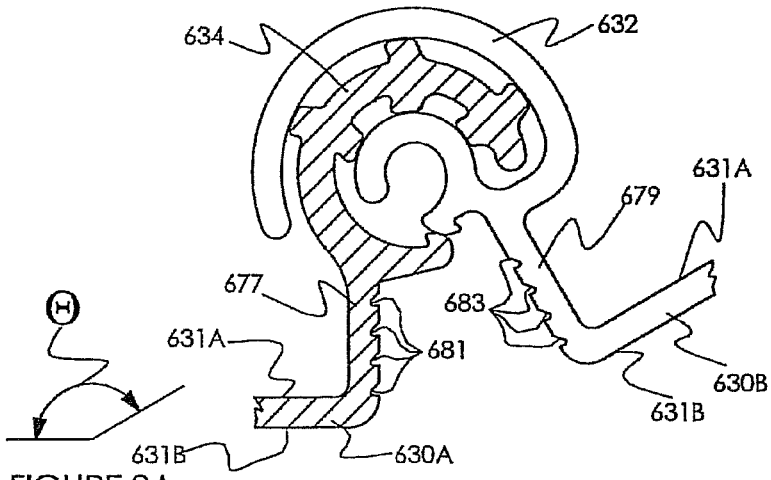
FIGS. 9A-9C represent magnified partial views of curved connector components and a plug component for implementing edge-to-edge connection between edge-adjacent panels according to another particular embodiment of the invention and a method of coupling the connector components and the plug component to form such edge-to-edge connections.
Figure 9B:
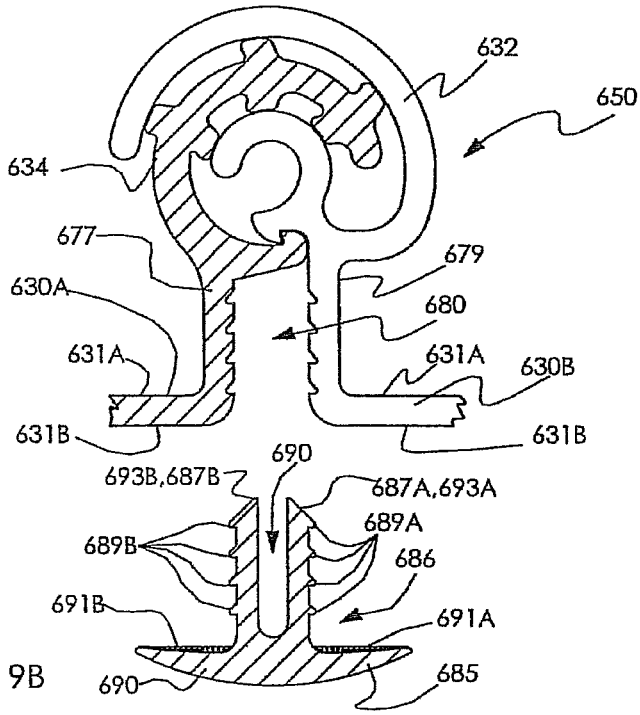
Figure 9C:
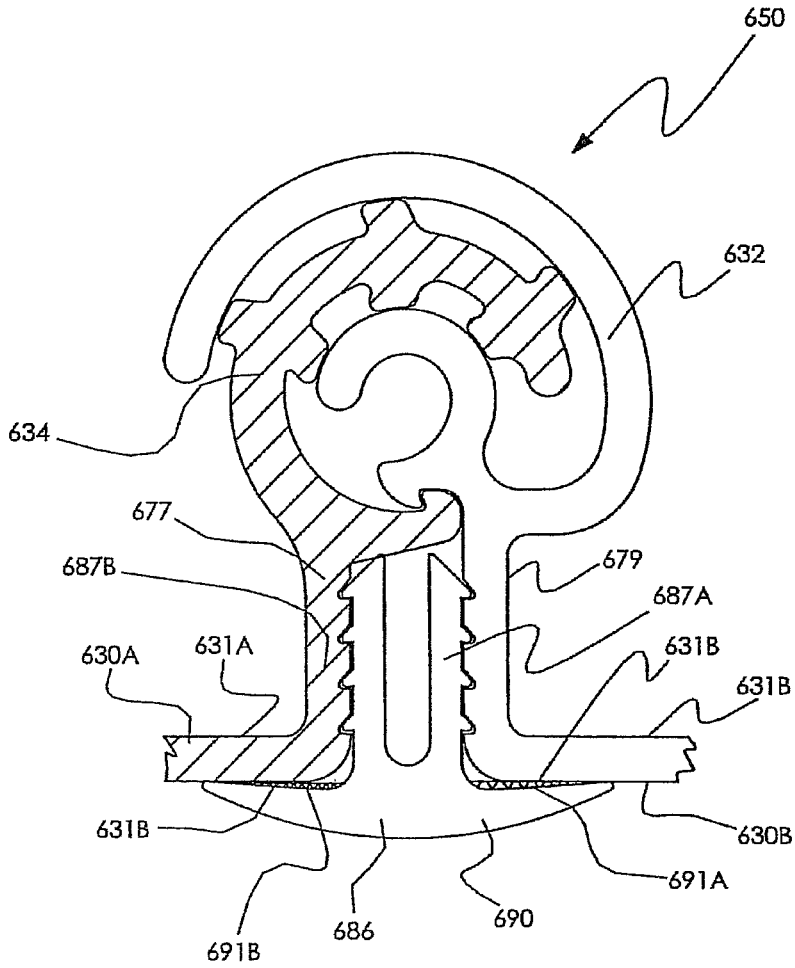

FIGS. 9A-9C schematically illustrate curved connector components 632, 634 according to another embodiment of the invention and the coupling of first, generally male connector component 634 to second, generally female connector component 632 to make a connection 650 between panels 630A, 630B. As discussed in more detail below, connection 650 also comprises a plug 686 which provide a hygienic function and which may assist with improving the impermeability of connection 650 to liquids and/or gasses. For clarity, only a portion of panels 630A, 630B are shown in FIGS. 9A-9C, it being understood that panels 630A, 630B may be substantially similar to panels 130 described above, except for connector components 632, 634. Curved connector components 632, 634 and their use to make connection 650 are similar in many respects to connector components 532, 534 described above. For brevity only the differences between connector components 632, 634 and connector components 532, 534 are detailed herein. In other respects, connector components 632, 634 should be understood to be similar to, operate in a manner similar to and incorporate variations which are similar to those of connector components 532, 534.

Connector components 632, 634 differ from connector components 532, 534 primarily in that they are spaced inwardly from inward facing surfaces 631A of their respective panels 630A, 630B by stand-off member 677 (for connector component 634) and stand-off member 679 (for connector component 632). As shown in FIGS. 9A and 9B, connector components 632, 634 are coupled to one another in a manner that is substantially similar to that of connector components 532, 534. When connector components 632, 634 are in their connected configuration (FIG. 9B), stand-off members 677, 679 define an outwardly opening channel 680 therebetween. As best illustrated in FIG. 9A, stand-off members 677, 679 respectively comprise indents 681, 683 on their channel-defining surfaces.

Connections 650 also comprise a plug 686 (FIG. 9B). In the illustrated embodiment, plug 686 comprises: a transversely and vertically extending head 690 having a pair of inward facing flanges 691A, 691B; and a pair of inwardly extending arms 687A, 687B. Although not explicitly shown in the illustrated views, plug 686 may extend the entire vertical dimension of panels 630A, 630B or may extend only over a portion of the vertical dimension of panels 630A, 630B. In the illustrated embodiment, arms 687A, 687B are transversely spaced from one another to provide channel 690 therebetween. In the illustrated embodiment, arms 687A, 687B comprise protrusions 689A, 689B which are complementary with indents 683, 681 on stand-off members 679, 677. In the illustrated embodiment, arms 687A, 687B comprise beveled surfaces 693A, 693B at their extremities to help guide plug 686 into channel 680.

As shown in FIG. 9C, plug 686 is inserted into channel 680 such that arms 687A, 687B extend inwardly into channel 680 and respectively engage stand-off members 679, 677 and flanges 691A, 691B respectively engage the outward facing surfaces 631B of panels 630B, 630A. In the illustrated embodiment, the interaction between arms 687A, 687B (e.g. beveled surfaces 693A, 693B) and stand-off members 679, 677 causes deformation of arms 687A, 687B toward one another (i.e. into channel 690). Accordingly, restorative deformation forces cause protrusions 689A, 689B of anus 687A, 687B to engage corresponding indents 683, 681 of stand-off members 679, 677. Protrusions 689A, 689B may be provided with "saw-tooth" shapes as shown in the illustrated embodiment which make it relatively more easy to insert arms 687A, 687B into channel 680 and relatively more difficult to remove arms 687A, 687B from channel 680. In other embodiments, stand-off members 679, 677 and arms 687A, 687B may comprise other means of engaging one another. By way of non-limiting example, stand-off members 679, 677 may comprise protrusions and arms 687A, 687B may comprise corresponding indents.

Plug 686 can improve the hygiene of connections 650 and can also improve the impermeability of connections 650 to liquids and/or gasses. In some embodiments, various surfaces of plug 686 (e.g. arms 687A, 687B and/or flanges 691A, 691B) may be coated with suitable coating materials or provided with suitable surface texturing as described above. In addition or in the alternative, these surfaces of plug 686 may be coated with anti-bacterial substances to provide an antimicrobial hygienic function.

Figure 13:
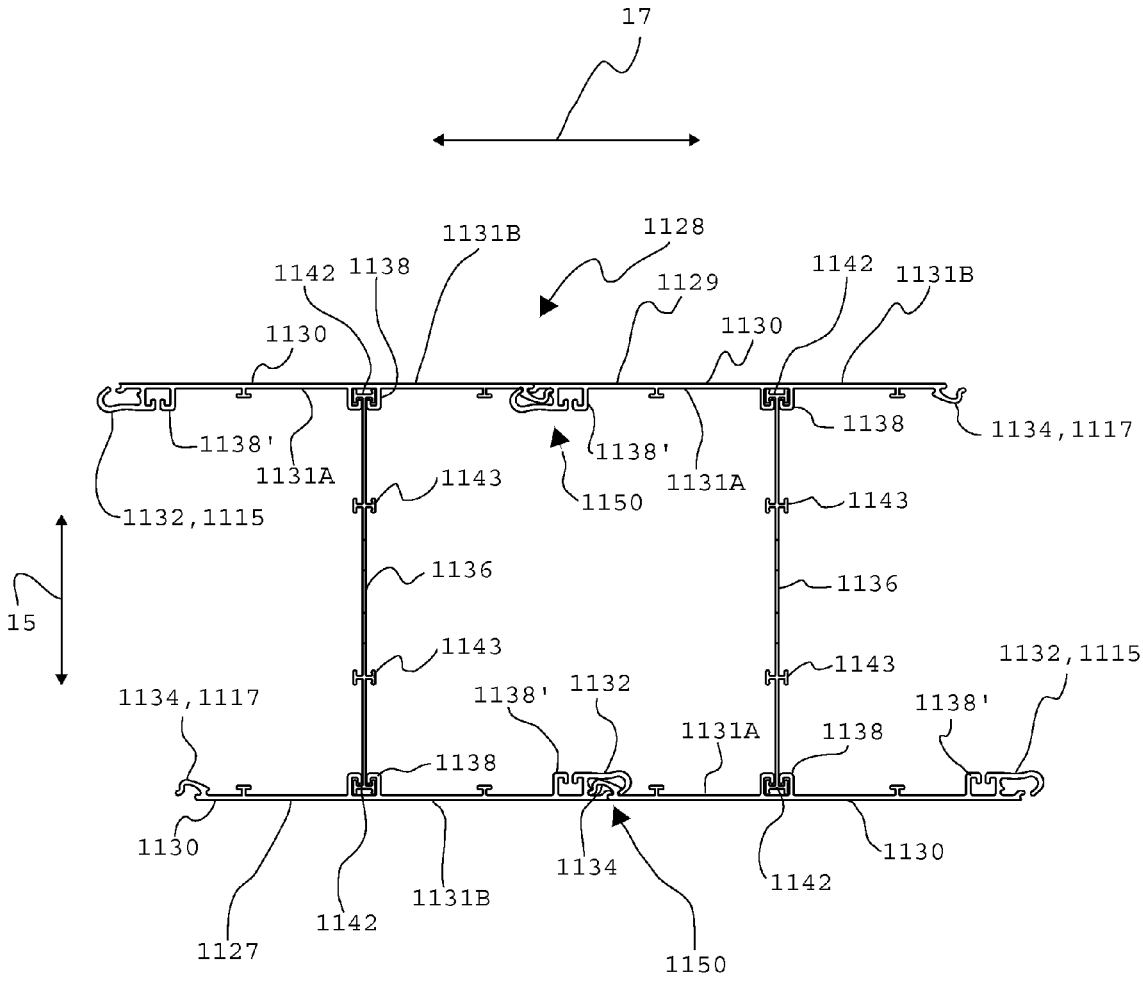
FIG. 13 is a top plan view of a modular stay-in-place form according to another particular embodiment of the invention.

FIG. 13 is a partial top plan view of a modular stay-in-place form 1128 according to a particular embodiment of the invention which may be used to fabricate a portion of a wall, a building structure (e.g. a wall, floor foundation or ceiling) or some other structure. In the illustrated embodiment, form 1128 is used to form a portion of a wall. Form 1128 of the FIG. 13 embodiment includes panels 1130 and support members 1136. The components of form 128 (i.e. panels 1130 and support members 1136) may be fabricated from any of the materials and using any of the procedures described above for form 128 (FIG. 3).

Figure 16A:
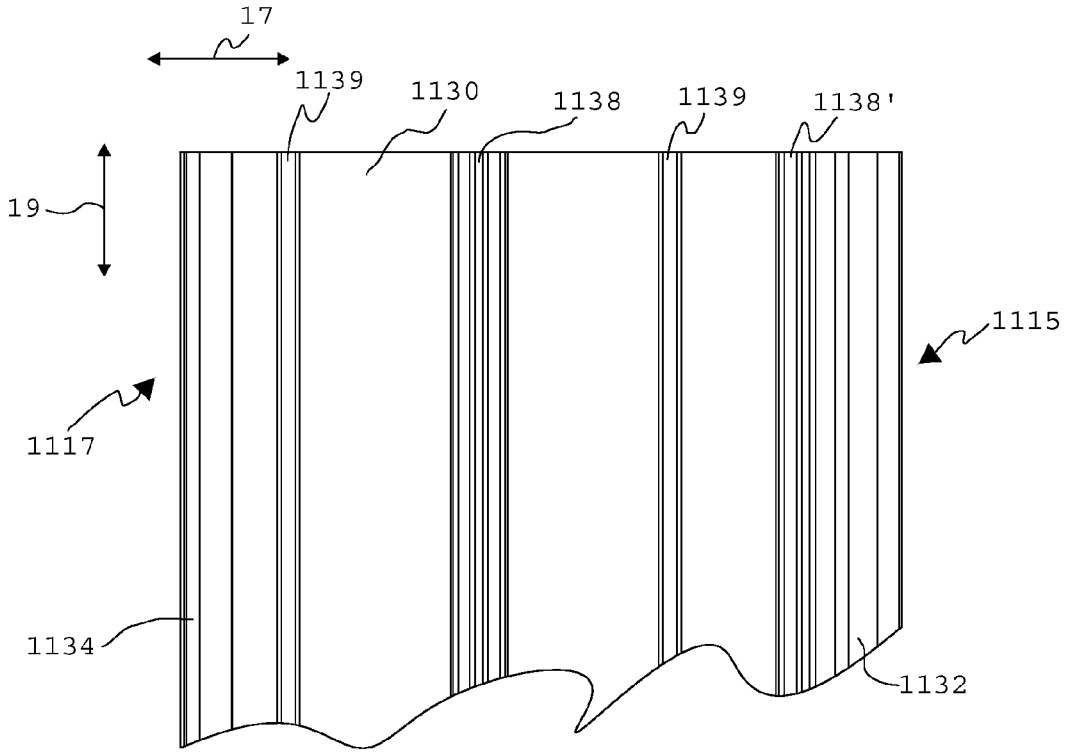
FIGS. 16A, 16B and 16C represent partial side plan views of the panels and the support members of the forms of FIGS. 13, 14 and 15 and of the tensioning components of the FIG. 14 and FIG. 15 forms.
Figure 16B:
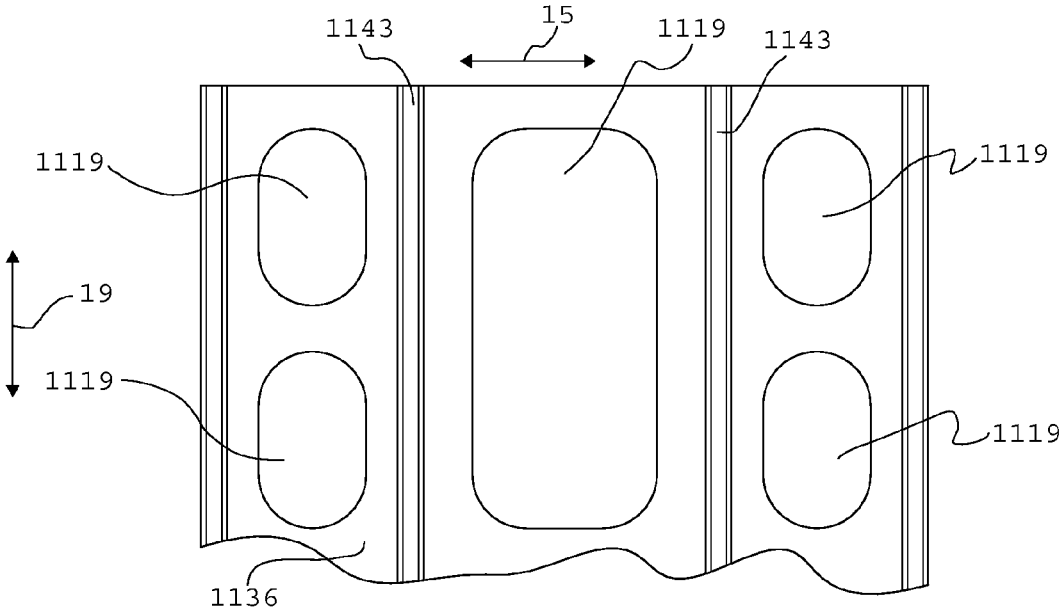

Form 1128 comprises a plurality of panels 1130 which are elongated in the vertical direction (i.e. the direction into and out of the page of FIG. 13 and the direction of double-headed arrow 19 of FIGS. 16A and 16B). Panels 1130 comprise inward facing surfaces 1131A and outward facing surfaces 1131B. In the FIG. 13 embodiment, all panels 1130 are identical to one another, but this is not necessary. In general, panels 1130 may have a number of features which differ from one another as explained in more particular detail below. As shown in FIGS. 13 and 17C-17G, panels 1130 incorporate first, generally female, contoured connector components 1132 at one of their edges 1115 and second, generally male, contoured connector components 1134 at their opposing edges 1117. In the illustrated embodiment, panels 1130 (including first and second connector components 1132, 1134) have a substantially uniform cross-section along their entire vertical length, although this is not necessary.

In some embodiments, panels 1130 are prefabricated to have different vertical dimensions. In other embodiments, the vertical dimensions of panels 1130 may be cut to desired length(s). Preferably, panels 1130 are relatively thin in the inward-outward direction (shown by double-headed arrow 15 of FIG. 13) in comparison to the inward-outward dimension of the resultant structures fabricated using form 1128. In some embodiments, the ratio of the inward-outward dimension of a structure formed by form 1128 to the inward-outward dimension of a panel 1130 is in a range of 10-600. In some embodiments, the ratio of the inward-outward dimension of a structure formed by form 1128 to the inward-outward dimension of a panel 1130 is in a range of 20-300.

As shown in FIG. 13 and explained further below, connector components 1132, 1134 may be joined together to form connections 1150 at edges 1115, 1117 of panels 1130. Panels 1130 may thereby be connected in edge-adjacent relationship to form wall segments 1127, 1129. In the FIG. 13 embodiment, form 1128 comprises a pair of wall segments 1127, 1129 which extend in the vertical direction 19 and in the transverse direction (shown by double headed arrows 17 in FIGS. 13 and 16A). This is not necessary. As explained in more particular detail below, one-sided forms according to the invention (the type used for tilt-up walls, for example) comprise only a single wall segment. In addition, structures fabricated using forms according to the invention are not limited to walls. In such embodiments, groups of edge-adjacent panels 1130 connected in edge-to-edge relationship at connections 1150 may be more generally referred to as form segments instead of wall segments. In the illustrated embodiment, wall segments 1127, 1129 are spaced apart from one another in the inward-outward direction 15 by an amount that is relatively constant, such that wall segments 1127, 1129 are generally parallel. This is not necessary. In some embodiments, wall segments 1127, 1129 need not be parallel to one another and different portions of forms according to the invention may have different inward-outward dimensions.

FIGS. 17A-17G schematically illustrate represent various magnified views of the connector components 1132, 1134 for implementing connections 1150 between edge-adjacent panels 1130A, 1130B of form 1128 and a method of coupling connector components 1132, 1134 to form such edge-to-edge connections 1150. Generally speaking, to form a connection 1150 between connector components 1132, 1134, edge-adjacent connector components 1132, 1134 (or panels 1130A, 1130B) are moved relative to one another in a vertical direction 19 such that connector components 1132, 1134 slideably engage one another in an intermediate loose-fit connection and then edge-adjacent connector components 1132, 1134 (or panels 1130A, 1130B) are pivoted relative to one another to deform portions of connector components 1132, 1134 such that resilient restorative forces tend to lock connector components 1132, 1134 to one another (i.e. snap-together fitting to thereby form connection 1150.

The Nov. 7, 2008 connection between connector components 1132, 1134 may be made by slidably inserting a principal protrusion 1158 of connector component 1134 into a principal receptacle or recess 1154 of connector component 1132 (by relative sliding of panels 1130A, 1130B in a vertical direction) and, if relative sliding between panels 1130A, 1130B is used to make the loose-fit connection, may be made without substantial deformation of connector components 1132, 1134 and/or without substantial friction therebetween. The loose-fit connection between connector components 1132, 1134 may alternatively be made by deforming portions of connector components 1132, 1134 to insert generally male connector component 1134 loosely into generally female connector component 1132, although this may be difficult when panels 1130A, 1130B are relatively lengthy in the vertical direction. Once the loose-fit connection is made, connector components 1132, 1134 (or panels 1130A, 1130B) may be pivoted to resiliently deform one or more parts of connector components 132, 134 and eventually to reach a relative orientation where restorative deformation forces lock connector components 1132, 1134 to one another (i.e. in a snap-together fitting). In the loose-fit connection, connector components 1132, 1134 partially engage one another. The partial engagement of connector components 1132, 1134 retains principal protrusion 1158 of connector component 1134 in recess 1154 of connector component 1132 such that connector components 1132, 1134 are prevented from separating under the application of limited forces and/or under the application of force in a limited range of directions. By way of non-limiting example, in particular embodiments, once engaged in a loose-fit connection, connector components 1132, 1134 cannot be separated by the force of gravity acting on one of two panels 1130A, 1130B. In some embodiments such as that illustrated in FIGS. 13 and 7A-7G, once engaged in a loose-fit connection, connector components 1132, 1134 cannot easily be separated by forces applied to panels 1130A, 1130B in generally transverse opposing directions 17.

Figures 17A, 17B:
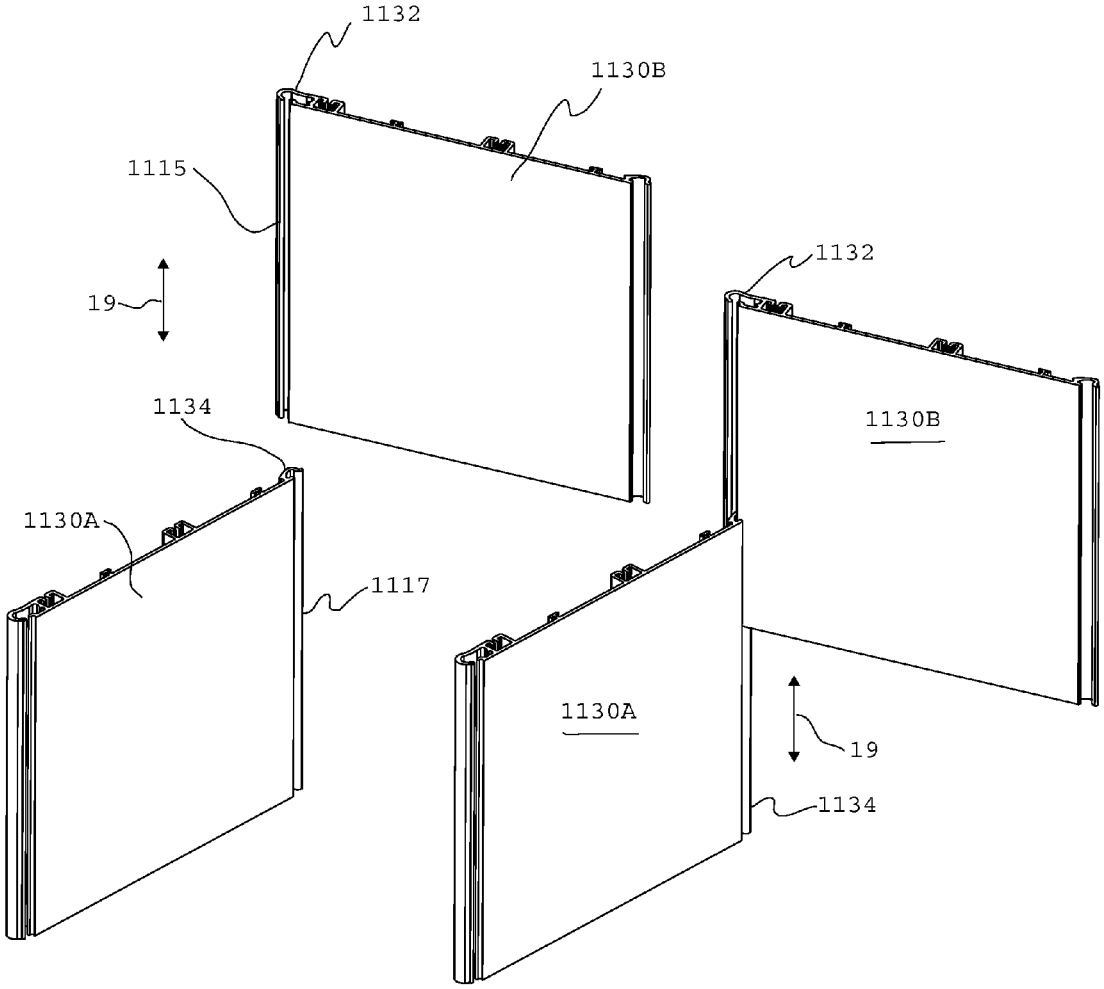
FIGS. 17A-17G represent various magnified views of the connector components for implementing the edge-to-edge connections between edge-adjacent panels of the forms of FIGS. 13, 14 and 15 and a method of coupling the connector components to form such edge-to-edge connections.
Figure 17C:
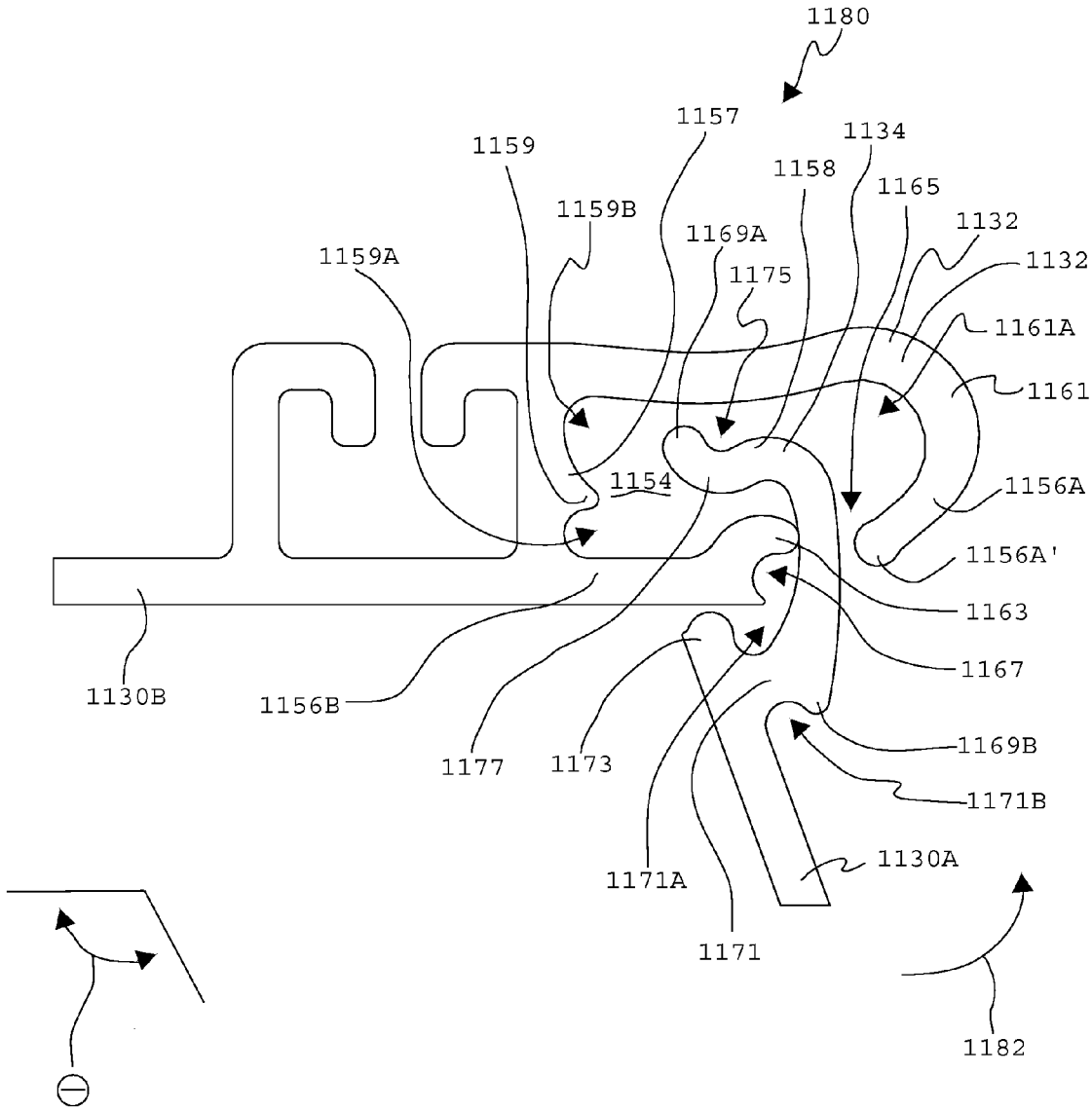

The features of connector components 1132, 1134 are shown best in FIG. 17C. Connector component 1132 is a part of (i.e. integrally formed with) panel 1130B and includes a pair of contoured arms 1156A, 1156B which join one another in region 1157 but are spaced apart from one another at their opposing ends to form principal recess 1154. Region 1157 may be referred to as bight 1157. In the illustrated embodiment, bight 1157 comprises a projection 1159 which projects into principal recess 1154 to define a pair of secondary recesses 1159A, 1159B within principal recess 1154 and contoured arm 1156 comprises a concave region 1161 which defines a third secondary recess 1161A within principal recess 1154. Contoured arm 1156B comprises a thumb 1163 at its distal end. Thumb 1163 projects toward a distal end 1156A' of contoured arm 1156A to define an opening 1165 to principal recess 1154 between the distal ends of arms 1156A, 1156B. In the illustrated embodiment, thumb 1163 is shaped to provide a fourth secondary recess 1167 located outside of primary recess 1154.

Connector component 1134 is a part of (i.e. integrally formed with) panel 1130A and includes a principal protrusion 1158 and a thumb 1173. Principal protrusion 1158 is contoured and, in the illustrated embodiment, principal protrusion 1158 comprises a pair of secondary protrusions 1169A, 1169B and a neck section 1171. Neck section 1171, thumb 1173 and a remainder of panel 1130A define a pair of opposing concavities 1171A, 1171B. Secondary protrusion 1169A is curved in a direction opposing the curvature of the remainder of principal protrusion 1158 to define a third concavity 1175.

The coupling of connector components 1132, 1134 to one another to form connection 1150 between panels 1130A, 1130B is now described with reference to FIGS. 17A-17G. Initially, as shown in FIG. 17A, panels 1130A, 1130B are separated from one another. A user brings panels 1130A, 1130B toward one another such that edge 1117 and connector component 1134 of panel 1130A are adjacent edge 1115 and connector component 1132 of panel 1130B. Preferably, as shown in FIG. 17A, panels 1130A, 1130B are spaced from one another in vertical direction 19. Then, as shown in FIGS. 17B and 17C, a distal portion 1177 of principal protrusion 1158 is inserted into principal recess 1154 (FIG. 17C) and panels 1130A, 1130B are slid relative to one in vertical direction 19 (FIG. 17B) until panels 1130A, 1130B are vertically aligned with the desired orientation. The insertion of distal portion 1177 of principal protrusion 1158 into principal recess 1154 (FIG. 17C) may be referred to herein as a loose-fit connection 1180 between connector components 1132, 1134.

As can be appreciated from viewing FIG. 17C, when panel connector components 1132, 1134 are arranged in loose-fit connection 1180, panels 1130A, 1130B can be slid in vertical direction 19 (into and out of the page in FIG. 17C) without substantial friction between connector components 1132, 1134 and without substantial deformation of connector components 1132, 1134. This lack of substantial friction and deformation facilitates easy relative sliding motion between connector components 1132, 1134 in vertical direction 19, even where panels 1130A, 1130B are relatively long (e.g. the length of one or more stories of a building) in vertical direction 19. In some embodiments, as shown in FIG. 17C for example, the relative interior angle θ between panels 1130A, 1130B when connector components 1132, 1134 are in loose-fit connection 1180 is in a range of 30°-150°. In other embodiments, this angular range between panels 1130A, 1130B when connector components 1132, 1134 are in loose-fit connection 1180 is in a range of 90°-150°. In still other embodiments, this angular range between panels 1130A, 1130B when connector components 1132, 1134 are in loose-fit connection 1180 is in a range of 120°-150°.

Figure 17D:
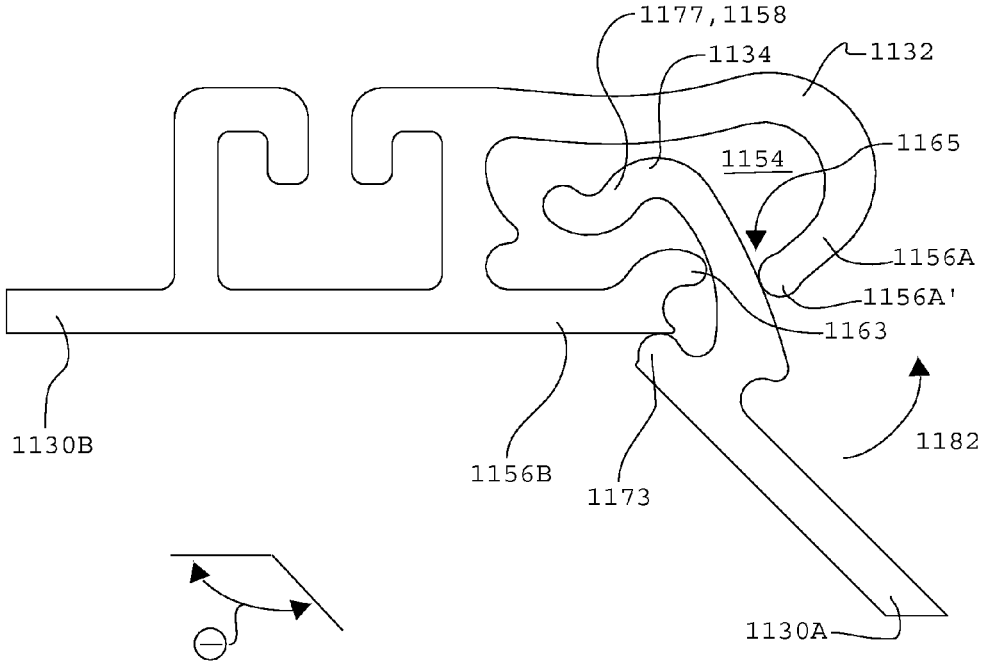

Once panels 1130A, 1130B are vertically aligned with the desired orientation (e.g. by sliding within loose-fit connection 1180), a user effects relative pivotal (or quasi pivotal) motion (see arrow 1182) between panels 1130A, 1130B (or, more particularly, connector components 1132, 1134) until connector components 1132, 1134 achieve the configuration of FIG. 17D. In the configuration of FIG. 17D, the relative pivotal movement of panels 1130A, 1130B causes contact between one or more of: distal end 1156A' of contoured arm 1156A and principal protrusion 1158; thumb 1173 and contoured arm 1156B; and thumb 1163 and principal protrusion 1158. In the illustrated view of FIG. 17D, contact is made in at least two of these locations. This contact tends to prevent further relative pivotal motion between panels 1130A, 1130B, unless one or more parts of connector components 1132, 1134 are forced to deform. In currently preferred embodiments, the relative interior angle θ between panels 1130A, 1130B when connector components 1132, 1134 begin to deform is in a range of 90°-150°.

Figure 17E:
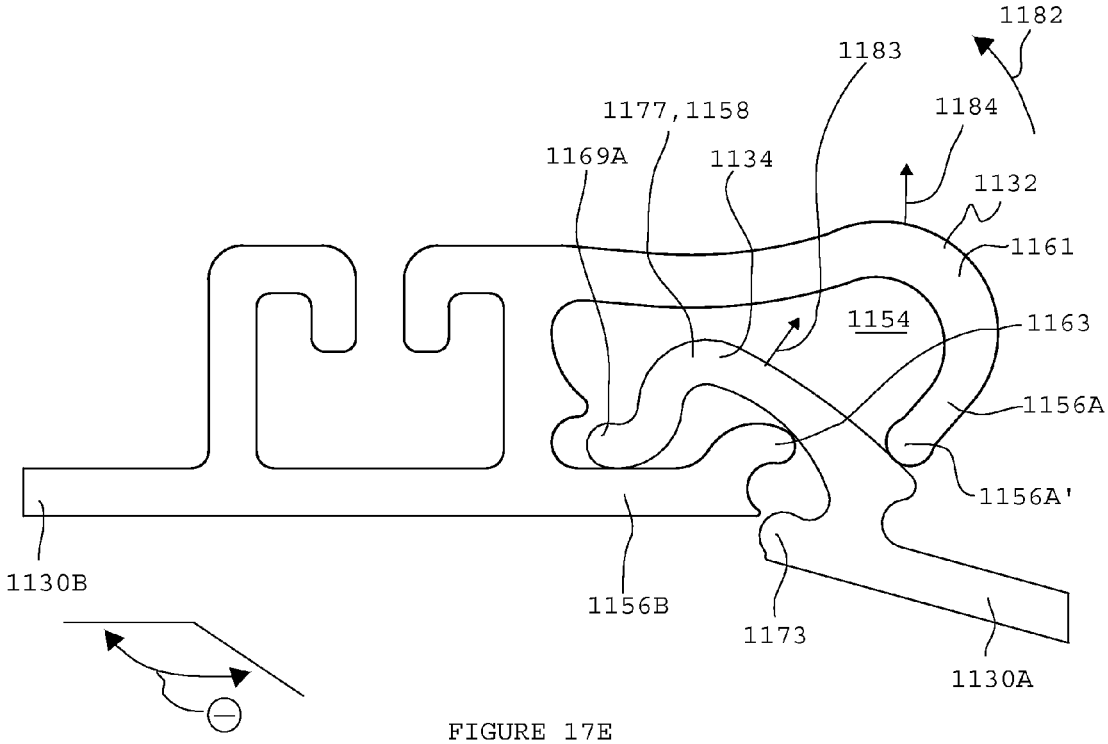

The user continues to effect relative pivotal motion (arrow 1182) between panels 1130A, 1130B (and between connector components 1132, 1134) such that one or more parts of connector components 1132, 1134 deforms. This deformation is shown in FIG. 17E. In the configuration of FIG. 17E, contact between principal protrusion 1158 and distal end 1156A' of contoured arm 1156A causes deformation of connector component 1132, such as deformation of concave region 1161 of contoured arm 1156A in the direction indicated by arrow 1184. In addition, contact between secondary protrusion 1169A and arm 1156B and/or contact between thumb 1163 and principal protrusion 1158 causes deformation of connector component 1134, such as deformation of principal protrusion 1158 in the direction indicated by arrow 1183. In currently preferred embodiments, the relative interior angle θ between panels 1130A, 1130B when connector components 1132, 1134 have deformed as shown in FIG. 17E is in a range of 130°-170°.

Figure 17F:
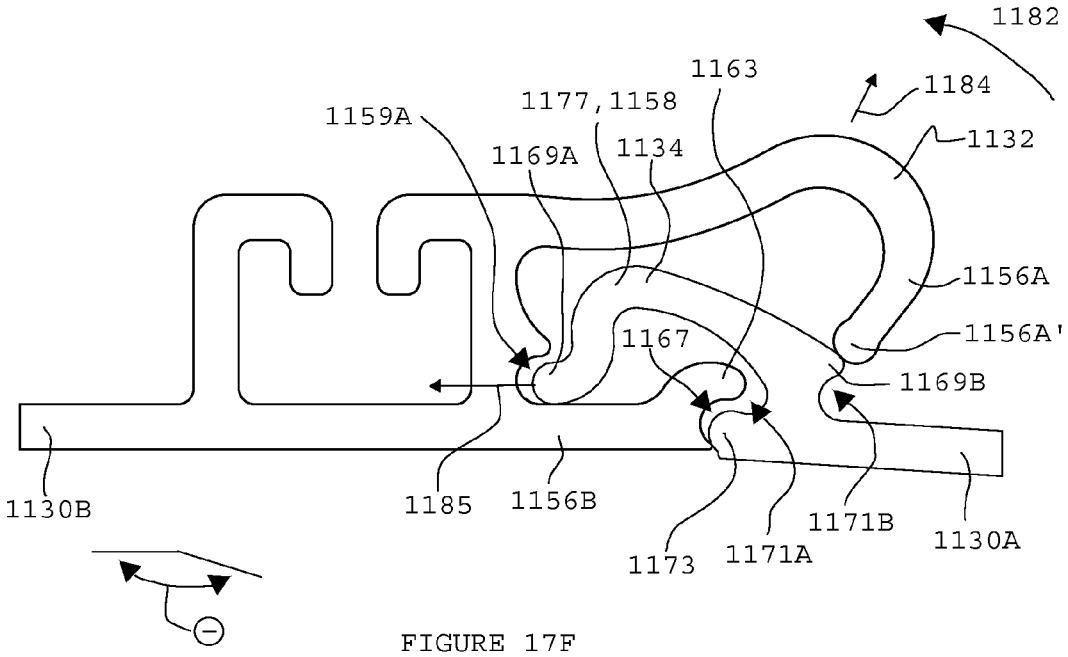

Deformation of connector components 1132, 1134 continues as the user continues to effect relative pivotal motion between panels 1130A, 1130B (and connector components 1132, 1134) in direction 1182. In the illustrated view of FIG. 17F, distal end 1156A' of arm 1156A is abutting against secondary protrusion 1169B of connector component 1134 to cause maximal deformation of arm 1156A of connector component 1132 in direction 1184. Also, as shown in FIG. 17F, principal protrusion 1158 deforms such that secondary protrusion 1169A tends to slide along arm 1156B in direction 1185 toward secondary recess 1159A. With the continued pivotal motion between panels 1130A, 1130B (and connector components 1132, 1134) as shown in FIG. 17F, thumb 1173 tends to move into secondary recess 1167 and thumb 1163 tends to move into concavity 1171A. In particular embodiments, the relative interior angle θ between panels 1130A, 1130B when connector components 1132, 1134 have deformed as shown in FIG. 17F is in a range of 160°-478°.

Figure 17G:
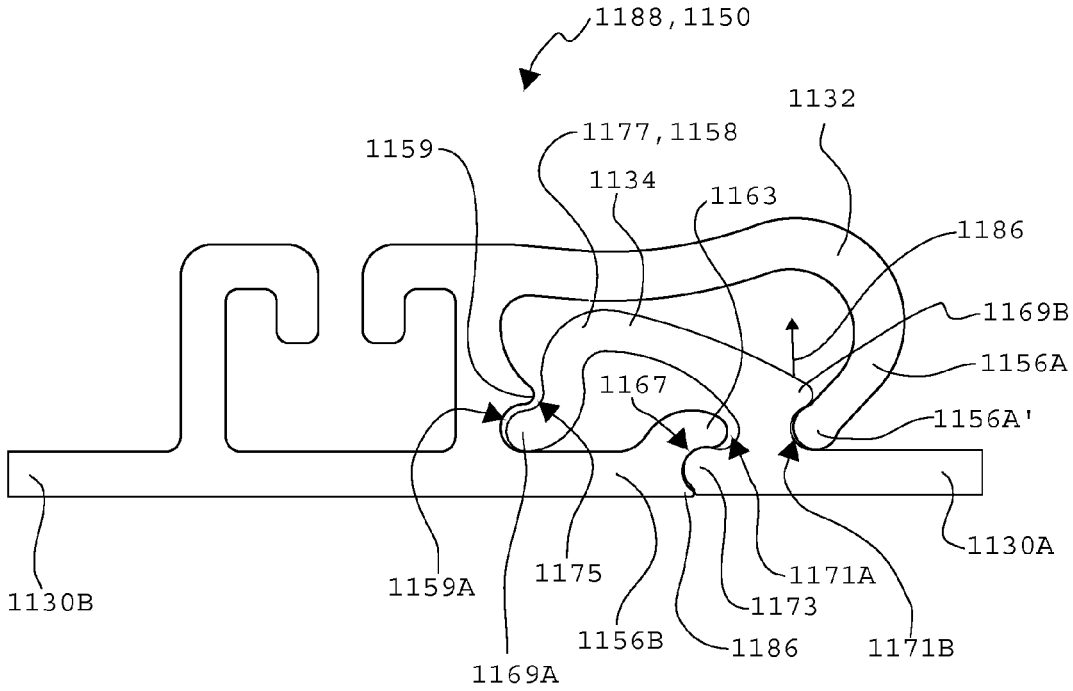

The user continues to effect relative pivotal motion between panels 1130A, 1130B (and connector components 1132, 1134) as shown by arrow 1182 until distal end 1156A' of arm 1156A passes secondary protrusion 1169B as shown in FIG. 17G. Having regard to both FIGS. 17F and 17G, when distal end 1156A' of arm 1156A is pivoted past secondary protrusion 1169B, distal end 1156A' of arm 1156A is permitted to move into concavity 1171B. Because of the above-described deformation of arm 1156A of connector component 1132 during relative pivotal motion of panels 1130A, 1130B, restorative deformation forces (i.e. the forces that tend to restore connector component 1132 to its original non-deformed configuration) tend to force distal end 1156A' of arm 1156A into concavity 1171B—i.e. to provide a snap-together fitting.

As distal end 1156A' of arm 1156A moves into concavity 1171B, this allows principal protrusion 1158 to move into principal recess 1154 in the direction shown by arrow 1186. Because of the above-described deformation of principal protrusion 1158 of connector component 1134 during relative pivotal motion panels 1130A, 1130B, restorative deformation forces associated with connector component 1134 tend to force secondary protrusion 1169A into secondary recess 1159A—i.e. to provide a snap-together fitting.

At substantially the same time as the restorative deformation forces act on connector component 1132 to force distal end 1156A' of arm 1156A into concavity 1171B and on connector component 1134 to force secondary protrusion 1169A into secondary recess 1159A, thumb 1173 tends to move into secondary recess 1167 and thumb 1163 tends to move into concavity 1171A.

With this movement, connector components 1132, 1134 (and panel 1130A, 1130B) achieve the locked configuration 1188 shown in FIG. 17G where the relative interior angle θ between panels 1130A, 1130B is approximately 180°. In some embodiments, the relative interior angle θ between panels 1130A, 1130B is in a range of 175°-185° when connector components 1132, 1134 achieve the locked configuration 1188. Locked configuration 1188 may be referred to as a connection 1150 between connector components 1132, 1134. Between the configuration of FIG. 17F and locked configuration 1188 of FIG. 17G, there may be a limited relative linear motion of panels 1130A, 1130B (e.g. in the direction of arrow 1185 (FIG. 17F)) as the various aforementioned parts of connector components 1132, 1134 move into locked configuration 1188.

When connector components 1132, 1134 are in locked configuration 1188, connector components 1132, 1134 may still be slightly deformed from their nominal states, such that restorative deformation forces continue to force one or more of: distal end 1156A' of arm 1156A into concavity 1171B; secondary protrusion 1169A into secondary recess 1159A; thumb 1173 into secondary recess 1167; and thumb 1163 into concavity 1171A. However, preferably, the strain on these parts of connector components 1132, 1134 is not sufficient to degrade the integrity of connector components 1132, 1134.

When connector components 1132, 1134 are in locked configuration 1188, connector components 1132, 1134 are shaped to provide several interleaving parts. For example, as can be seen from FIG. 17G:

- when secondary protrusion 1169A projects into secondary recess 1159A, secondary protrusion is interleaved between contoured arm 1156B and projection 1159;
- when projection 1159 extends into concavity 1175, projection 1159 is interleaved between secondary protrusion 1169A and a remainder of principal protrusion 1158;
- when thumb 1163 projects into concavity 1171A, thumb 1163 is interleaved between thumb 1173 and principal protrusion 1158;
- when thumb 1173 projects into secondary recess 1167, thumb 1173 is interleaved between thumb 1163 and projection 1189; and
- when distal end 1159A' of contoured arm 1156A projects into concavity 1171B, distal end 1159A' is interleaved between secondary projection 1169B and the remainder of panel 1130A.

The interleaving parts of components 1132, 1134 may provide connection 1150 with a resistance to unzipping and may prevent or minimize leakage of liquids and, in some instances, gases through connector 1150.

In some embodiments, a sealing material (not shown) may be provided on some surfaces of connector components 1132, 1134. Such sealing material may be relatively soft (e.g. elastomeric) when compared to the material from which the remainder of panel 1130 is formed. Such sealing materials may be provided using a co-extrusion process or coated onto connector components 132, 1134 after fabrication of panels 1130, for example, and may help to make connection 1150 impermeable to liquids or gasses. By way of non-limiting example, such sealing materials may be provided: on distal end 1156A' of arm 1156A; in concavity 1171B; on secondary protrusion 1169A; in secondary recess 1159A; on thumb 1173; in secondary recess 1167; on thumb 1163; and/or in concavity 1171A. Suitable surface textures (as described above) may also be applied to these or other surfaces of connector components 1132, 1134 as described above to enhance the seal or the friction between components 1132, 1134.

Referring back to FIG. 13, in the illustrated embodiment, form 1128 comprises support members 1136 which extend between wall segments 1127, 1129. Support members 1136 are also shown in FIG. 16B. Support members 1136 comprise connector components 1142 at their edges for connecting to corresponding connector components 1138 on inward surfaces 1131A of panels 1130. Support members 1136 may brace opposing panels 1130 and connect wall segments 1127, 1129 to one another.

In the illustrated embodiment, connector components 1138 on inward surfaces 1131A of panels 1130 comprise a pair of J-shaped legs (not specifically enumerated) which together provide a female shape for slidably receiving H-shaped male connector components 1142 of support members 1136. This is not necessary. In general, where form 1128 includes support members 1136, connector components 1138,1142 may comprise any suitable complementary pair of connector components and may be coupled to one another by sliding, by deformation of one or both connector components or by any other suitable coupling technique. By way of non-limiting example, connector components 1138, 1142 may comprise male T-shaped connectors and female C-shaped connectors which may be slidably coupled to one another as with connectors 138, 142 of form 128 (FIG. 3) described above.

In the illustrated embodiment of FIG. 13, each panel 1130 comprises a generally centrally located connector component 1138. Connector components 1138 facilitate connection to support members 1136 as discussed above. In the illustrated embodiment, each panel 1130 also comprises an additional optional connector component 1138' located adjacent to, and in the illustrated embodiment immediately adjacent to and sharing parts with, connector component 1132. As shown in FIG. 13, connector component 1138' are substantially similar in shape to connector components 1138. Accordingly, in some embodiments, where it is desired to provide form 1128 with additional strength or to increase the strength of form 1128 in the regions of connections 1150, support members 1136 may be coupled between opposing wall segments 1127, 1129 at connector components 1138' in addition to, or in the alternative to, connector components 1138. Connector components 1138' are optional. In some embodiments, connector components 1138' are not present. In the remainder of this description, except where specifically noted, connector components 1138 and connector components 1138' will be referred to collectively as connector components 1138.

In general, panels 1130 may be provided with any suitable number of connector components 1138 to enable the connection of a corresponding number of support members 1136, as may be necessary for the particular strength requirements of a given application. In addition, the mere presence of connector components 1138 on panels 1130 does not necessitate that support members 1136 are connected to each such connector component 1138. In general, the spacing of support members 1136 may be determined as necessary for the particular strength requirements of a given application and to minimize undesirably excessive use of material.

Support members 1136 are preferably apertured (see apertures 1119 of FIG. 16B) to allow liquid concrete to flow in transverse directions 17 between wall segments 1127, 1129. Although not explicitly shown in the illustrated views, rebar may also be inserted into form 1128 prior to placing liquid concrete in form 1128. Where required or otherwise desired, transversely extending rebar can be inserted to extend through apertures 1119 in support members 1136. If desired, vertically extending rebar can then be coupled to the transversely extending rebar.

Figure 14:
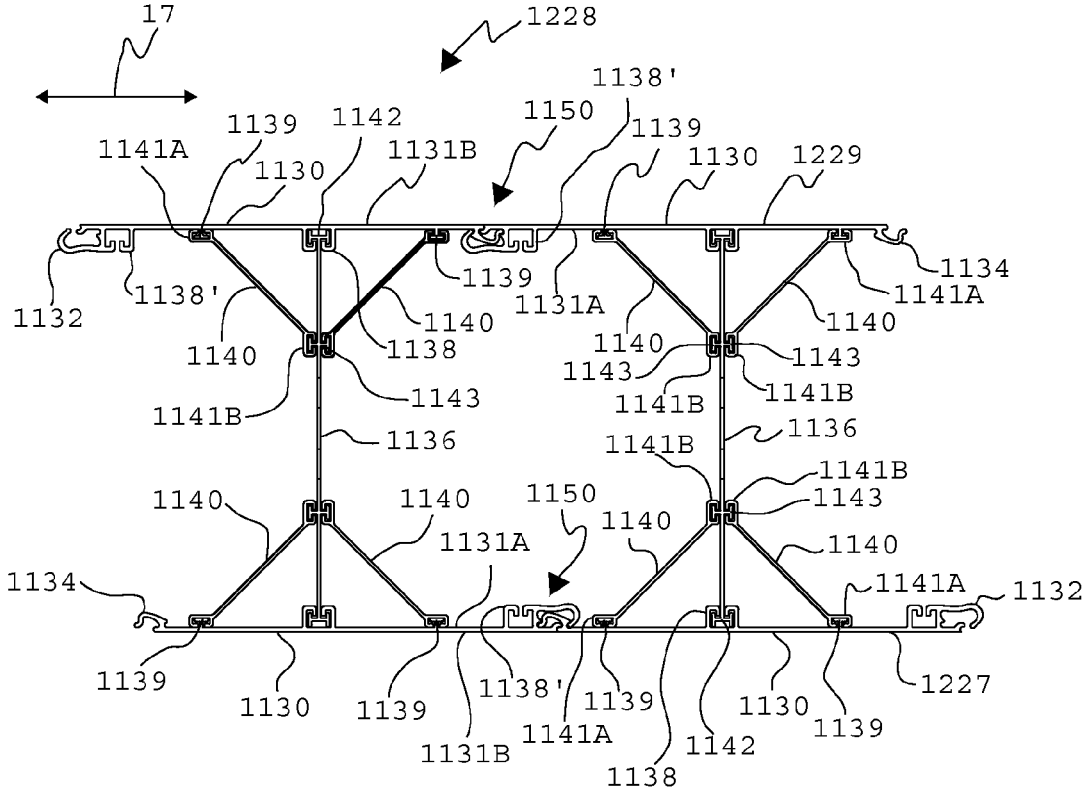
FIG. 14 is a top plan view of a modular stay-in-place form according to yet another particular embodiment of the invention.
Figure 16C:
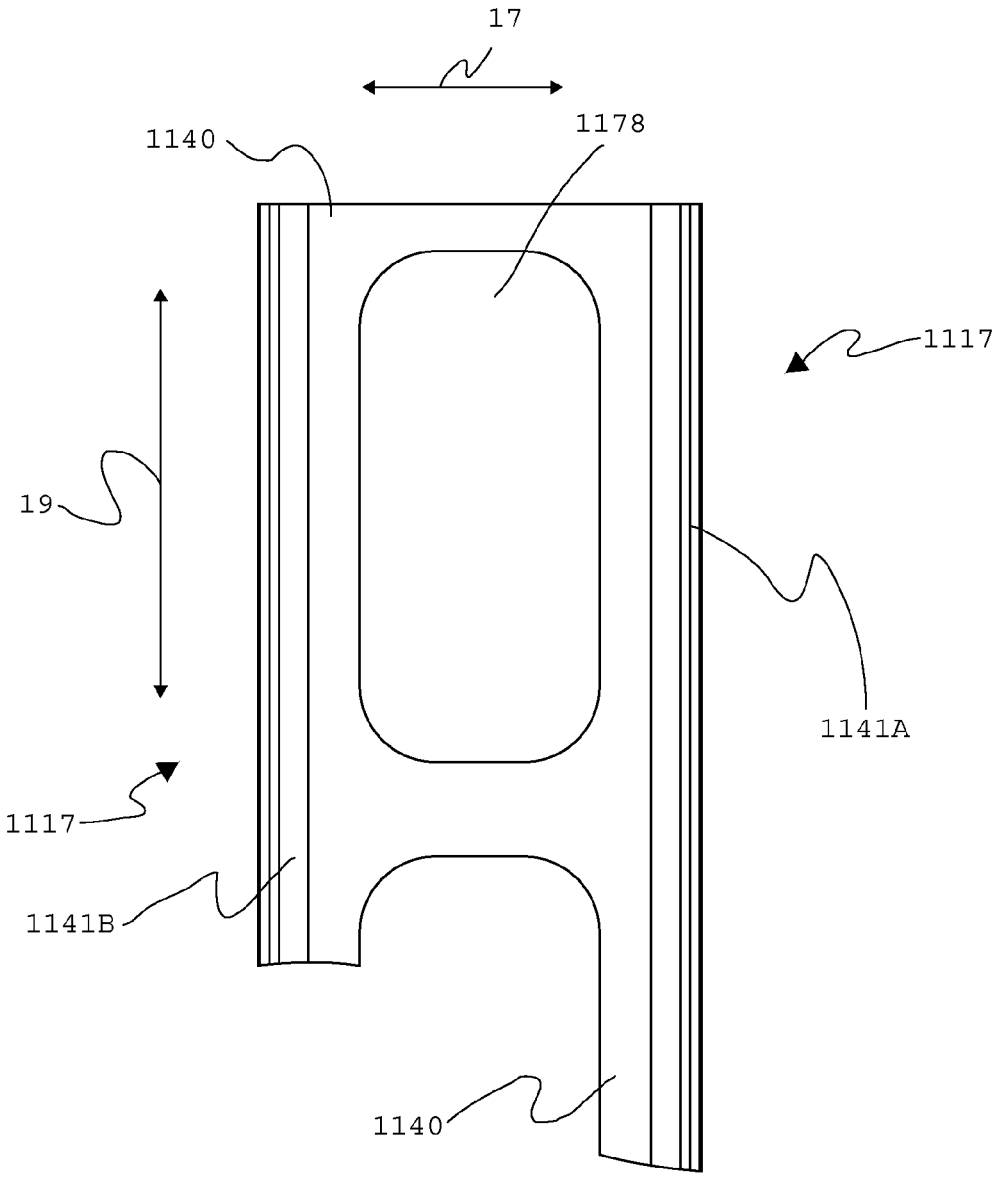

FIG. 14 is a partial top plan view of a modular stay-in-place form 1228 according to another particular embodiment of the invention which may be used to form a wall of a building or other structure. Form 1228 of FIG. 14 incorporates panels 1130 and support members 1136 which are substantially identical to panels 1130 and support members 1136 of faun 1128 and similar reference numbers are used to refer to the similar features of panels 1130 and support members 1136. Panels 1130 are connected as described above (at connections 1150) in edge adjacent relationship to provide wall segments 1227, 1229. Form 1228 differs from form 1128 in that form 1228 incorporates tensioning members 1140 which are not present in form 1128. Tensioning members 1140 are also illustrated in FIG. 16C. Tensioning members 1140 extend at an angle between support members 1136 and panels 1130 and may provide form 1228 with increased strength and may help to prevent pillowing of panels 1130 when form 1228 is filled with concrete.

Tensioning members 1140 incorporate connector components 1141A, 1141B at their respective ends for connection to complementary connector components 1139 on inward surfaces 1131A of panels 1130 and complementary connector components 1143 on transverse surfaces of support members 1136. In the FIG. 14 embodiment, connector components 1141A, 1141B on tensioning members 1140 are provided with a female C-shape for slidably receiving T-shaped male connector components 1139, 1143 of panels 1130 and support members 1136. This is not necessary. In general, where form 1128 includes tensioning members 1140, connector components 1141A, 1139 and connector components 1141B, 1143 may comprise any suitable complementary pairs of connector components and may be coupled to one another by sliding, by deformation of one or both connector components or by any other suitable coupling technique.

Tensioning members 1140 preferably comprise apertures 1171 which allow concrete flow and for the transverse extension of rebar therethrough (see FIG. 16C).

As mentioned above, support members 1136 may be connected between connector components 1138' on opposing wall segments 1227, 1229. Since connector components 1138' are closer to connections 1150 (relative to centrally located connector components 1138), the provision of support members 1136 between connector components 1138' acts to reinforce connections 1150. Although not explicitly shown, where support members 1136 are connected between connector components 1138' and tensioning members 1140 are provided to extend between connector components 1139 on panels 1130 and connector components 1143 on support member 1136, tensioning members 1140 may extend transversely across connection 1150—i.e. from connector component 1139 on a first panel 1130 on one transverse side of connection 1150 across connection 1150 to a connector component 1143 on support member 1136 on the opposing transverse side of connection 1150 in a manner similar to tensioning members 140 of form 228 (FIG. 4). In this manner, tensioning members 1140 can be made to reinforce connections 1150 between panels 1130 and help to prevent unzipping of connections 1150.

In some embodiments, tensioning members 1140 are not necessary. Tensioning members 1140 need not generally be used in pairs. By way of non-limiting example, some forms may use only tensioning members 1140 which are configured to span connections 1150. In some embodiments, support members 1136 and/or tensioning members 1140 may be employed at different spacings within a particular form. Form 1228 incorporates components (i.e. panels 1130 and support members 1136) which are substantially similar to the components of form 1128 described herein. In various different embodiments, form 1228 may be modified as discussed herein for foim 1128.

In operation, forms 1128, 1228 may be used to fabricate a wall or other structure by slidably moving panels 1130 relative to one another as discussed above to form loose-fit connections 1180 between connector components 1132, 1134 and then pivoting panels 1130 (and connector components 132, 134) relative to one another to put connector components 1132, 1134 into their locked configuration 1188, thereby forming connections 1150 between edge-adjacent panels 1130. Once, panels 1130 are assembled into wall segments 1127, 1129 or 1227, 1229, support members 1136 may be added by slidably connecting connector components 1142 of support members 1136 to connector components 1138 of panels 1130. Support members 1136 connect wall segments 1127, 1129 or 1227, 1229 to one another. If it is desired to include tensioning members 1140, tensioning members 1140 may then be attached between connector components 1143 of support members 1136 and connector components 1139 of panels 1130. Panels 1130, support members 1136 and tensioning members 1140 (if present) may be connected to one another in any orientation and may then be placed in a desired orientation after such connection. Walls and other structures fabricated from panels 1130 generally extend in two dimensions (referred to herein as the vertical dimension (see arrow 19 of FIGS. 16A and 16B) and the transverse dimension (see arrow 17 of FIG. 13)). However, it will be appreciated that walls and other structures fabricated using forms 1128, 1228 can be made to extend in any orientation and, as such, the terms "vertical" and "transverse" as used herein should be understood to include other directions which are not strictly limited to the conventional meanings of vertical and transverse. In some embodiments, panels 130 may be deformed or may be prefabricated such that their transverse extension has some curvature.

If necessary or otherwise desired, transversely extending rebar and/or vertically extending rebar can then be inserted into any of the forms described herein, including forms 1128, 1228. After the insertion of rebar, liquid concrete may be placed into form 1128, 1228. When the liquid concrete cures, the result is a structure (e.g. a wall) that has two of its surfaces covered by stay-in-place form 1128, 1228.

Figure 19A:
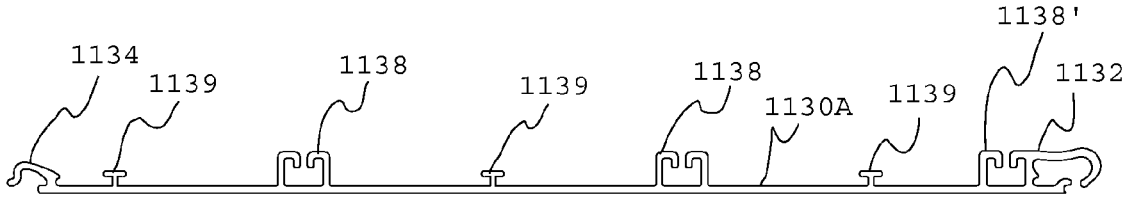
FIGS. 19A-19C are plan views showing modular panels of the type used in the forms of FIGS. 13 and 14 and having different transverse dimensions.
Figure 19B:
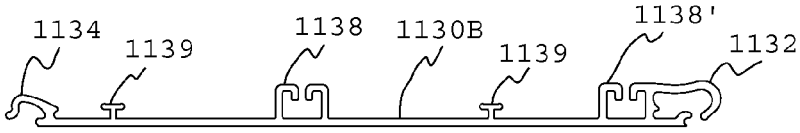
Figure 19C:
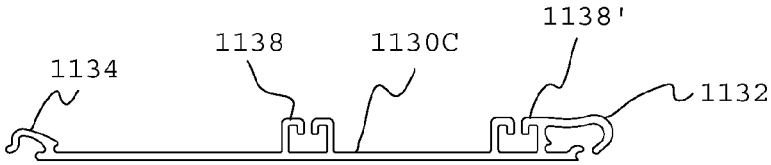

Panels 1130 of forms 1128, 1228 may be provided in modular units with different transverse dimensions as shown in FIGS. 19A, 19B and 19C. Panel 1130B of FIG. 19B represents panel 1130 shown in the illustrated embodiments of forms 1128, 1228 (FIGS. 13 and 14). However, panels 1130 may be provided with smaller transverse dimensions (as shown in panel 1130C of FIG. 19C) or with larger transverse dimensions (as shown in panel 1130A of FIG. 19A). In the illustrated embodiment, large panel 1130A comprises an additional connector component 1138 and an additional connector component 1139 when compared to panel 1130B. This is not necessary. In some embodiments, larger panel 1130A may be made larger without additional connector components. In other embodiments, panels may be fabricated with transverse dimensions greater than that of panel 1130A and, optionally, with more connector components 1138 and/or connector components 1139. In the illustrated embodiment, small panel 1130B has had connector components 1139 removed. This is not necessary. In some embodiments, smaller panel 1130C may be made smaller without removing connector components 1139. In some embodiments, panels may be fabricated with transverse dimensions less than that of panel 1130C.

Figure 20A:
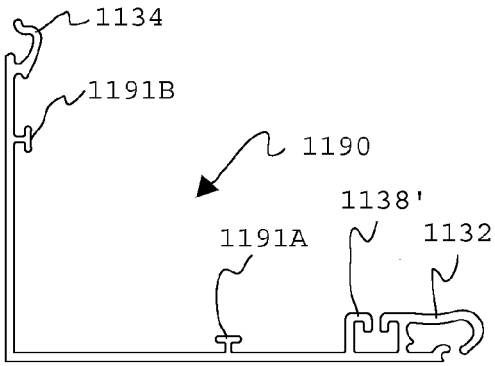
FIGS. 20A and 20B are plan views of an outside corner element and an inside corner element suitable for use with the forms of FIGS. 13 and 14.
Figure 20B:
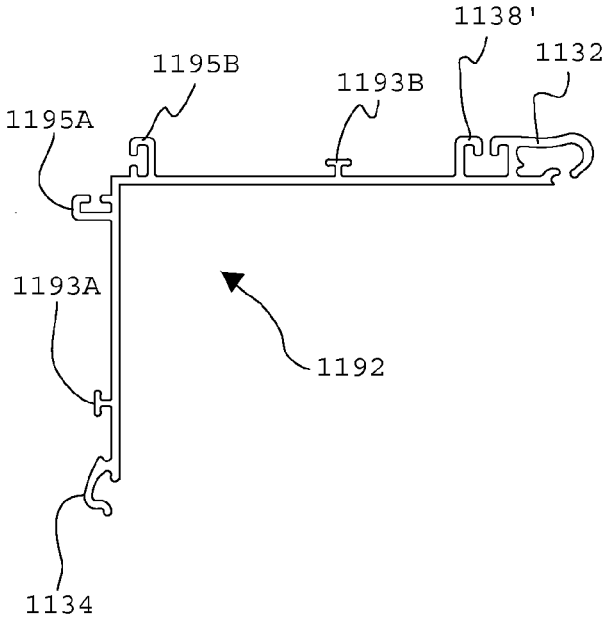
Figure 20C:
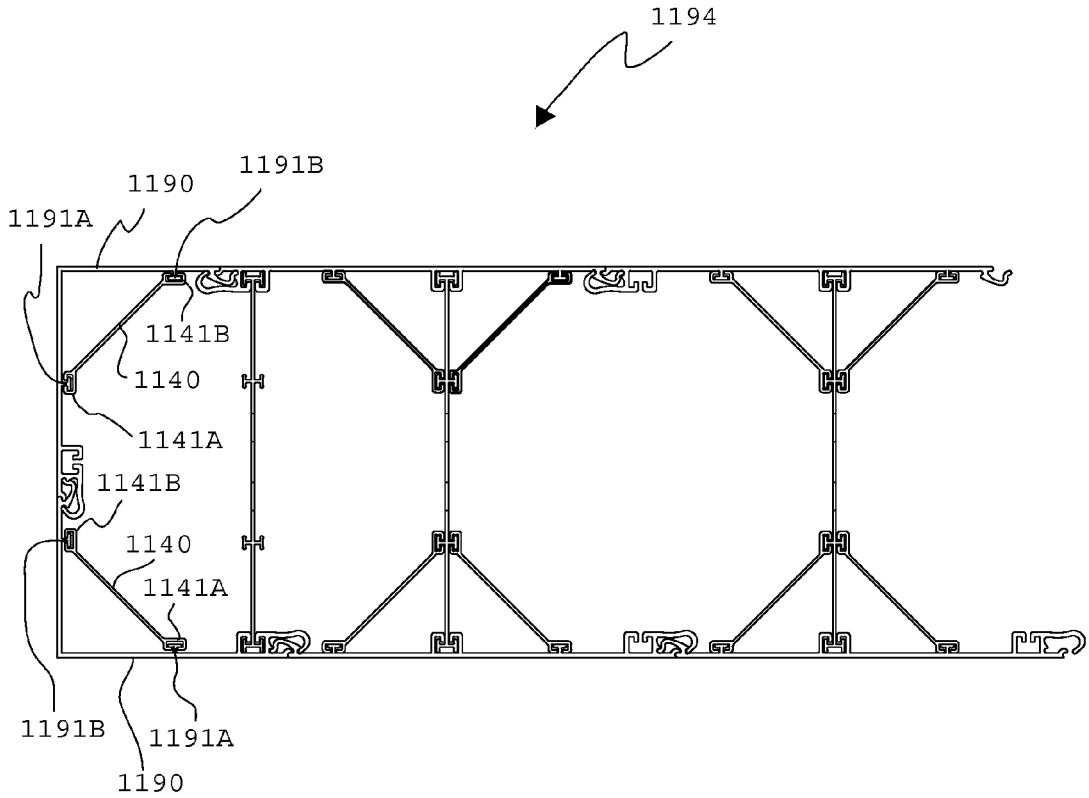
FIG. 20C is a top plan view of a wall end incorporating a pair of FIG. 20A outside corner elements.
Figure 20D:
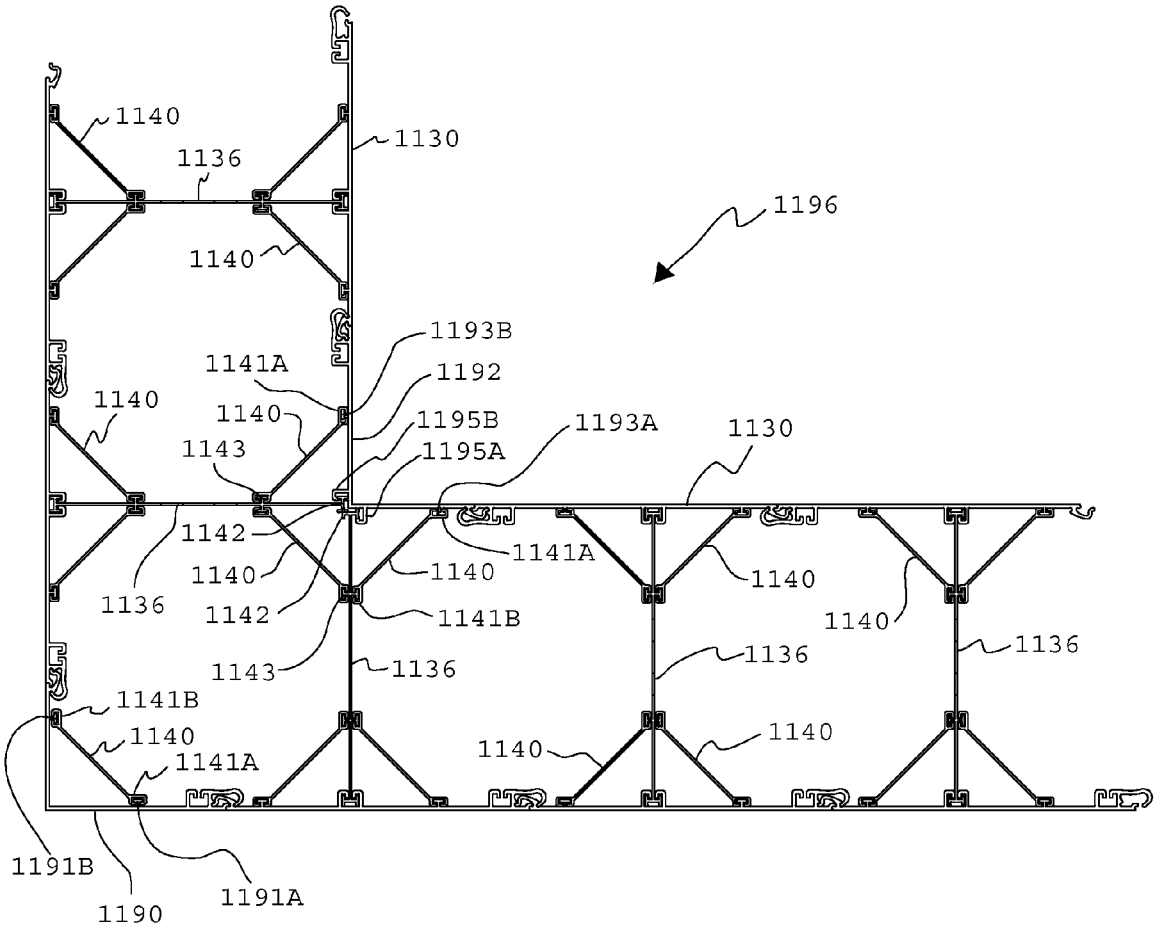
FIG. 20D is a top plan view of a form incorporating the outside and inside corner elements of FIGS. 20A and 20B.

FIGS. 20A and 20B are plan views of an outside 90° corner element 1190 and an inside 90° corner element 1192 suitable for use with the forms of FIGS. 13 and 14. FIG. 20C is a partial plan view of a form 1194 which incorporates a pair of outside corner elements 1190 to provide the end of a wall and FIG. 20D is a partial plan view of a form 1196 incorporating an outside corner element 1190 and an inside corner element 1192 to provide a 90° corner in a wall.

In the illustrated embodiment, outside corner element 1190 comprises a connector component 1132 at one of its edges and a connector component 1134 at its opposing edge. Similarly, the illustrated embodiment, inside corner element 1192 comprises a connector component 1132 at one of its edges and a connector component 1134 at its opposing edge. Connector components 1132, 1134 are substantially similar to connector components 1132, 1134 on panels 1130 and are used in a manner similar to that described above to connect corner components 1190, 1192 to panels 1130 or to other corner components 1190, 1192. Outside corner element 1190 also comprises a pair of connector components 1191A, 1191B for connection to corresponding connector components 1141A, 1141B of tensioning members 1140. As shown in FIGS. 20C and 20D, a tensioning member 1140 may optionally be connected between connector components 1191A, 1191B to provide increased strength to outside corner element 1190. In the illustrated embodiment connector components 1191A, 1191B are T-shaped male connector components for slidably engaging C-shaped female connector components 1141A, 1141B of tensioning members 1140. In general, however, connector components 1191A, 1191B, 1141A, 1141B may comprise any suitable complementary pairs of connector components and may be coupled to one another by sliding, by deformation of one or both connector components or by any other suitable coupling technique.

Inside corner element 1192 may comprise a pair of connector components 1193A, 1193B for connection to corresponding connector components 1141A of tensioning members 1140 and connector components 1195A, 1195B for connection to corresponding connector components 1142 of support members 1136. As shown in FIG. 20D, an inside corner may be formed by: connecting a pair of support members 1136 between connector components 1195A, 1195B and corresponding connector components 1138 on outside panels 1130; connecting a pair of tensioning members 1140 between connector components 1193A, 1193B and connector components 1143 of the pair of support members 1316; and connecting a tensioning member 1140 between connector components 1143 of the pair of support members 1136. It should be noted that in the illustrated embodiment, connector components 1195A, 1195B are C-shaped female connector components which receive only one of the two halves of H-shaped male connector components 1142 of support members 1136. In the illustrated embodiment, connector components 1193A, 1193B, 1195A, 1195B, 1141, 1142 are slidably engaging connector components. In general, however, connector components 1193A, 1193B, 1195A, 1195B, 1141, 1142 may comprise any suitable complementary pairs of connector components and may be coupled to one another by sliding, by deformation of one or both connector components or by any other suitable coupling technique.

Figure 15:
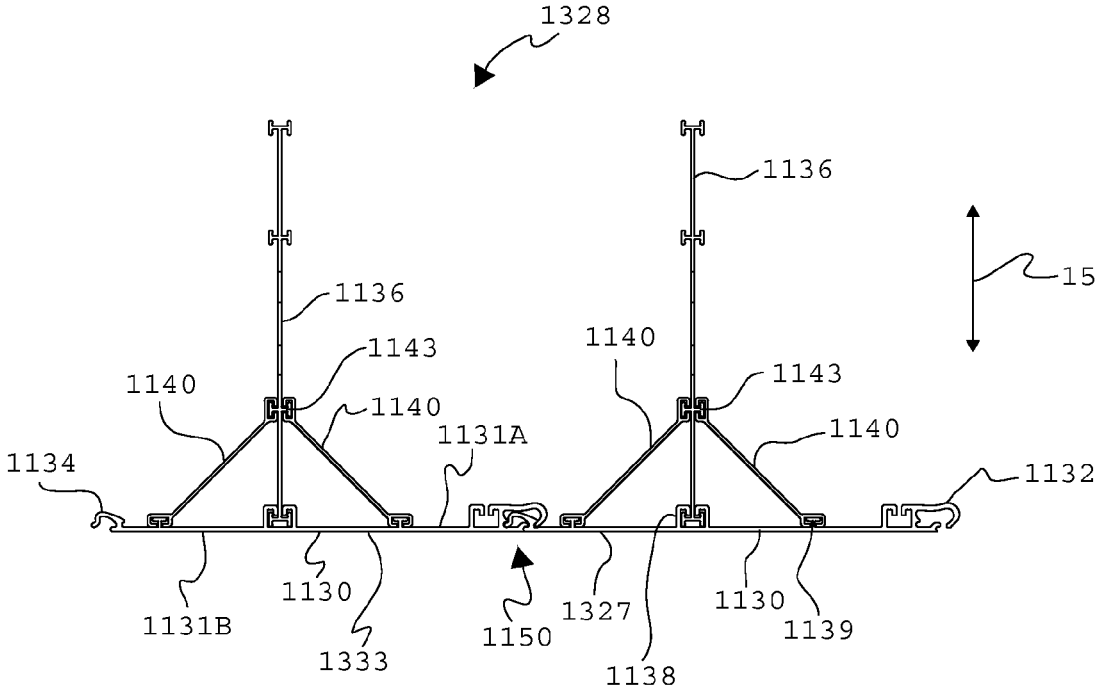
FIG. 15 is a plan view of a modular stay-in-place one-sided form which may be used to fabricate a tilt-up wall according to another embodiment of the invention.

FIG. 15 shows a one-sided modular stay-in-place form 1328 according to a particular embodiment of the invention which may be used to fabricate structures cladded on one side by stay-in-place form. One-sided forms, such as form 1328, may be used to fabricate tilt-up walls, for example. The modular components of form 1328 (FIG. 15) and their operability are similar in many respects to the modular components of form 1228 (FIG. 14). In particular, in the illustrated embodiment, form 1328 incorporates panels 1130, support members 1136 and tensioning members 1140 which are similar to panels 1130, support members 1136 and tensioning members 1140 of form 1228 and are connected to one another as described above to form a single wall segment 1327 that is substantially similar to wall segment 1227 of form 1228. Form 1328 differs from form 1228 in that form 1328 does not include panels 1130 to form a wall segment that opposes wall segment 1327 (i.e. form 1328 comprises a single-sided form and does not include an opposing wall segment like wall segment 1229 of form 1228). In addition, form 1328 differs from form 11228 in that form 1328 only includes tensioning members 1140 that connect to wall segment 1327 (i.e. form 1328 does not include tensioning members 1140 that attach to an opposing wall segment like wall segment 1229 of form 1228).

In operation, form 1328 is assembled by coupling connector components 1132, 1134 of panels 1130 together as described above to provide connections 1150 and to fabricate a single wall segment 1327. In form 1428, support members 1136 and tensioning members 1140 are then coupled to panels 1130 as described above for form 1228, except that the coupling between connector components 1142 and connector components 1138 is made at one side only and tensioning members 1140 are coupled to support members 1136 (at connector components 1141B, 1143) and to panels 1130 (at connector components 1141A, 1139) at one side only.

Form 1328 may be assembled on or otherwise moved onto a generally horizontal table or the like, such that outward facing surfaces 1131B of panels 1130 are facing downward and the vertical and transverse extension of panels 1130 is in the generally horizontal plane of the table. The table may be a vibrating table. In some embodiments, a table is not required and a suitable, generally horizontal surface may be used in place of a table. If required, rebar may be inserted into form 1328 while the form is horizontally oriented. Transversely extending rebar may project through apertures 1119 of support members 1136 and apertures 1171 of tensioning members 1140. Edges (not shown) of form 1328 may be fabricated on the table in any suitable manner, such as using conventional wood form. Concrete is then poured into form 1328 and allowed to flow through apertures 1119 of support members 1136 and through apertures 1171 of tensioning members 1140. The liquid concrete spreads to level itself (perhaps with the assistance of a vibrating table) in form 1328.

The concrete is then allowed to cure. Once cured, the resultant structure may be tilted into any desired orientation (e.g. to a vertical orientation in the case of a tilt-up wall). The result is a concrete wall segment (or other structure) that is cladded on one side with the panels 1130 of form 1328. Panels 1130 are anchored into the concrete wall by support members 1136 and tensioning members 1140. Structures (e.g. building walls and the like) may be formed by tilting up a plurality of wall segments in place. Advantageously, the outward facing surfaces 1131B panels 1130 provide one surface of the resultant wall made using form 1328 which may provide a finished wall surface 1333 on the exterior of a building or on the interior of a building, for example.

The use of form 1328 to fabricate tilt-up walls may involve the same or similar procedures (suitably modified as necessary) as those described for the fabrication of tilt-up walls using modular stay-in-place forms in the Structure-Lining PCT Application. Form 1328 may be anchored to the concrete by support members 1136, by connector components 1138, 1139, by connector components 1132, 1134 of connections 1150 and by tensioning members 1140. Other anchoring components similar to any of the anchoring components disclosed in the Structure-Lining PCT Application may also be used.

As discussed above, form 1328 represents a one-sided form that incorporates components (e.g. panels 1130, support members 1136 and tensioning members 1140) similar to form 1228 (FIG. 14). It will be appreciated that one-sided forms may be made using components of any of the other two-sided forms described herein. By way of non-limiting example, a one-sided form may be constructed using the components of form 1128 (FIG. 13)—i.e. without tensioning members 1140. Any such one-sided forms may be used to construct tilt-up walls and other structures cladded on one side fwith panels as described above for form 1328.

Figure 18A:
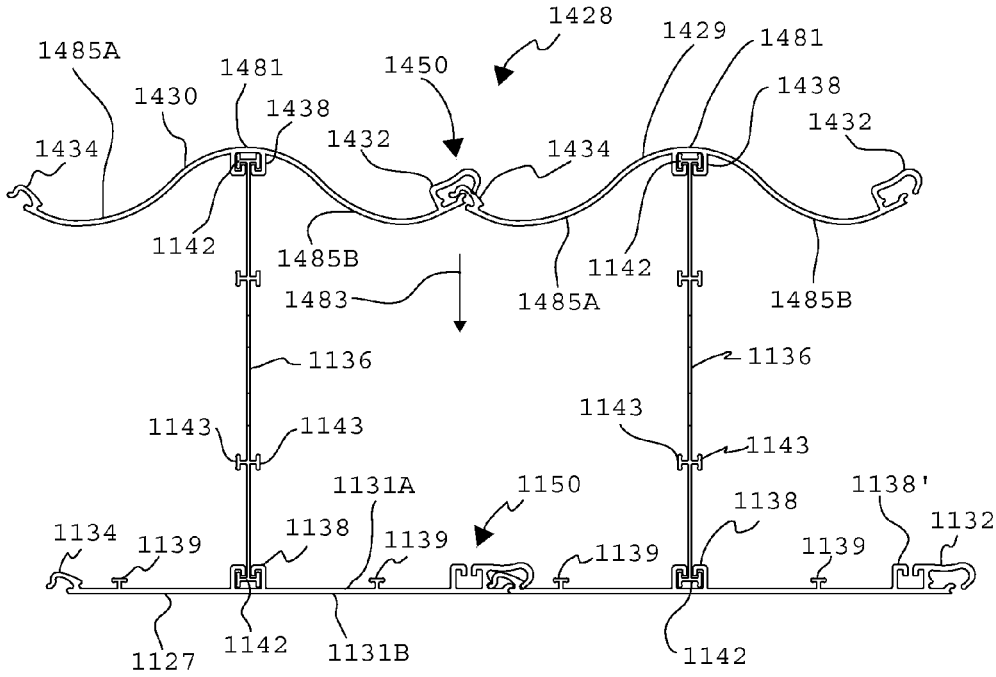
FIGS. 18A-18D represent plan views of various modular stay-in-place forms according to other embodiments of the invention.

FIG. 18A schematically illustrates a form 1428 according to another embodiment of the invention. Form 1428 comprises a first wall segment 1127 constructed from panels 1130 which are substantially similar to wall segment 1127 and panels 1130 of form 1128 (FIG. 13). Form 1428 also comprises support members 1136 which are substantially similar to support members 1136 of form 1128 (FIG. 13). Connector components 1142, 1138 are used to connect support members 1136 to panels 1130. Although not shown in the illustrated embodiment, form 1428 may incorporate tensioning members 1140 between connector components 1143 (of support members 1136) and connector components 1139 (of panels 1140)—i.e. similar to tensioning members of form 1228 (FIG. 14). The aspects of form 1428 which are similar to those of forms 1128, 1228 may be used and/or modified in accordance with any of the uses and/or modifications described herein for forms 1128, 1228.

Form 1428 is different from forms 1128, 1228 in that form 1428 incorporates an opposing wall segment 1429 fabricated from curved panels 1430. Each curved panel 1430 comprises a generally male contoured connector component 1434 at one of its transverse ends and a generally female contoured connector components 1432 at its opposing transverse end. Connector components 1432, 1434 are similar to connector components 1132, 1134. In the illustrated embodiment, each panel 1430 is curved to provide a convexity 1481 in a central region thereof, a first concavity 1485A between convexity 1481 and connector component 1434 and a second concavity 1485B between convexity 1481 and connector component 1432. The structure fabricated from form 1428 will have a contoured surface (i.e. having concavities and convexities corresponding to concavities 1485A, 1485B and convexities 1481 of panels 1430).

In the illustrated embodiment, each panel 1430 also comprises a connector component 1438 for connecting to complementary connector component 1142 on support member 1136. In the illustrated embodiment, connector components 1438 are double-J shaped female connector components for slidably receiving H-shaped male connector components 1142 of support members 1136. This is not necessary. In general, connector components 1438, 1142 may comprise any suitable complementary pairs of connector components and may be coupled to one another by sliding, by deformation of one or both connector components or by any other suitable coupling technique.

Connector components 1432, 1434 of panels 1430 operate in a manner similar to connector components 1132, 1134 described herein. More particularly, connector components 1432, 1434 are used by: first sliding panels 1430 relative to one another with connector components 1434 partially inserted into connector components 1432 to thereby provide a loose-fit connection; and then effecting relative pivotal motion between connector components 1432, 1434 to deform one or more parts of connector components 1432, 1434 and to thereby bring connector components 1432, 1434 into a locked configuration where restorative deformation forces lock connector components 1432, 1434 to one another to form a snap together connection 1450. In the FIG. 18A view, connector components 1432, 1434 are shown in their loose-fit configuration. Effecting relative pivotal motion between connector components 1432, 1434 may be accomplished by pivoting edge adjacent panels 1430 in a manner similar to that described above for panels 1130. However, in form 1428, relative pivotal motion between connector components 1432, 1434 may additionally or alternatively be effected by deforming the edge adjacent portions of panels 1430 in the direction of arrow 1483, such that connector components 1432, 1434 are caused to pivot in opposing angular directions.

Figure 18B:
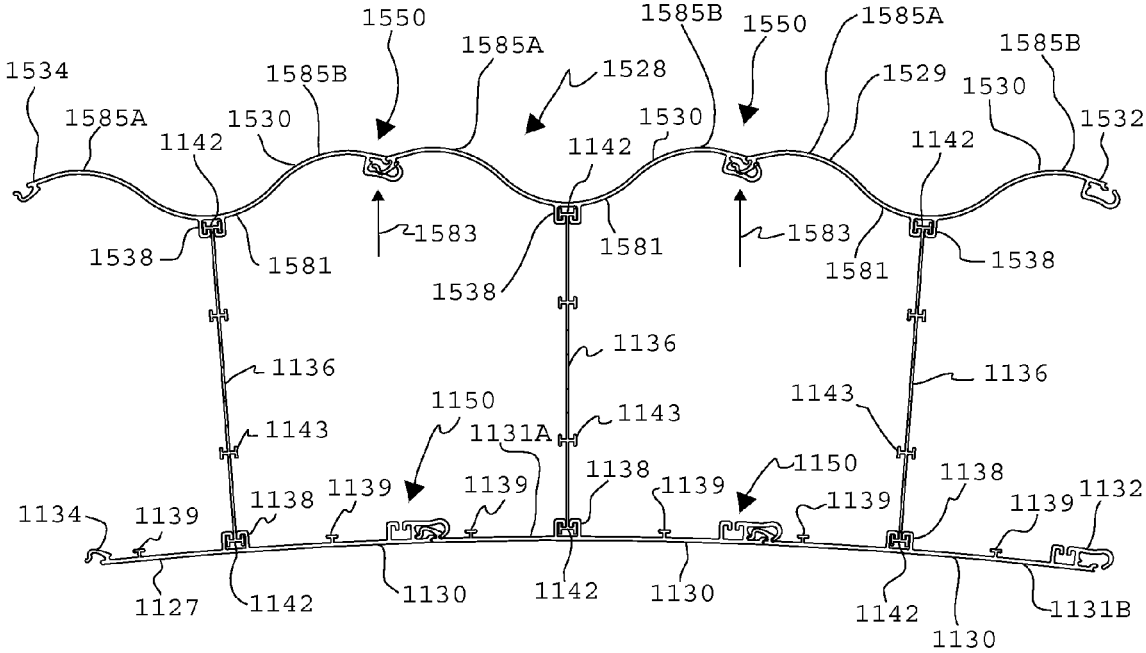

FIG. 18B schematically illustrates a form 1528 according to another embodiment of the invention. Form 1528 comprises a first wall segment 1127 constructed from panels 1130 which are substantially similar to wall segment 1127 and panels 1130 of form 1128 (FIG. 13). Form 1528 also comprises support members 1136 which are substantially similar to support members 1136 of form 1128 (FIG. 13). Connector components 1142, 1138 are used to connect support members 1136 to panels 1130. Although not shown in the illustrated embodiment, form 1528 may incorporate tensioning members 1140 between connector components 1143 (of support members 1136) and connector components 1139 (of panels 1140)—i.e. similar to tensioning members of form 1228 (FIG. 14). The aspects of form 1528 which are similar to those of forms 1128, 1228 may be used and/or modified in accordance with any of the uses and/or modifications described herein for forms 1128, 1228.

Form 1528 is different from forms 1128, 1228 in that form 1528 incorporates an opposing wall segment 1529 fabricated from curved panels 1530. Each curved panel 1530 comprises a generally male contoured connector component 1534 at one of its transverse ends and a generally female contoured connector components 1532 at its opposing transverse end. Connector components 1532, 1534 are similar to connector components 1132, 1134. In the illustrated embodiment, each panel 5130 is curved to provide a concavity 1481 in a central region thereof, a first convexity 1485A between concavity 1481 and connector component 1434 and a second convexity 1485B between concavity 1481 and connector component 1432. The structure fabricated from form 1528 will have a contoured surface (i.e. having concavities and convexities corresponding to concavities 1581 and convexities 1585A, 1585B of panels 1530).

In the illustrated embodiment, each panel 1530 also comprises a connector component 1538 for connecting to complementary connector component 1142 on support member 1136. In the illustrated embodiment, connector components 1538 are double-J shaped female connector components for slidably receiving H-shaped male connector components 1142 of support members 1136. This is not necessary. In general, connector components 1538, 1142 may comprise any suitable complementary pairs of connector components and may be coupled to one another by sliding, by deformation of one or both connector components or by any other suitable coupling technique.

Connector components 1532, 1534 of panels 1530 operate in a manner similar to connector components 1132, 1134 described herein. More particularly, connector components 1532, 1534 are used by: first sliding panels 1430 relative to one another with connector components 534 partially inserted into connector components 1532 to thereby provide a loose-fit connection; and then effecting relative pivotal motion between connector components 1532, 1534 to deform one or more parts of connector components 1532, 1534 and to thereby bring connector components 1532, 1534 into a locked configuration where restorative deformation forces lock connector components 1532, 1534 to one another to form a snap-together connection 1550. In the FIG. 18B view, connector components 1532, 1534 are shown in their loose-fit configuration. Effecting relative pivotal motion between connector components 1532, 1534 may be accomplished by pivoting edge adjacent panels 1530 in a manner similar to that described above for panels 1130. However, in form 1528, relative pivotal motion between connector components 1532, 1534 may additionally or alternatively be effected by deforming the edge adjacent portions of panels 1530 in the direction of arrow 1583 such that connector components 1532, 1534 are caused to pivot in opposing angular directions.

Form 1528 also differs from the forms described above because panels 1530 used to form wall segment 1529 are marginally longer than panels 1130 used to form wall segment 1127. Consequently, wall segments 1127, 1529 are deformed to provide a curvature. In the illustrated embodiment of FIG. 18B where panels 1530 are longer than panels 1130, outside surface 1131B of wall segment 1129 is concave. Any of the other forms described herein may be made to provide curved wall segments by having the panels on one side of the form larger than the panels on the opposing side of the form.

Figure 18C:
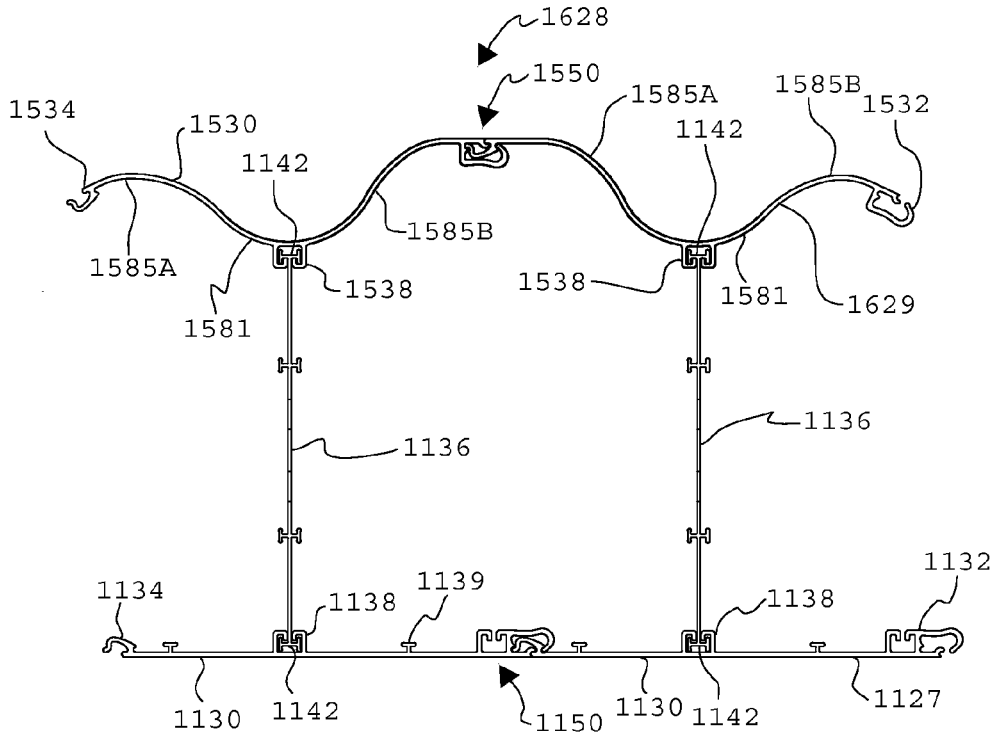

FIG. 18C schematically depicts a form 1628 according to another embodiment of the invention. Form 1628 is similar in many respects to form 1528 (FIG. 18B), except that panels 1530 of wall segment 1629 are sized the same as panels 1130 of wall segment 1127, such that wall segment 1127 is substantially flat. In other respects, form 1628 is the same as form 1528. FIG. 18C shows the edge to edge connection 1550 between panels 1530 (i.e. connector components 1532, 1534) in a locked configuration, rather than the loose-fit connection shown in FIG. 18B.

Figure 18D:
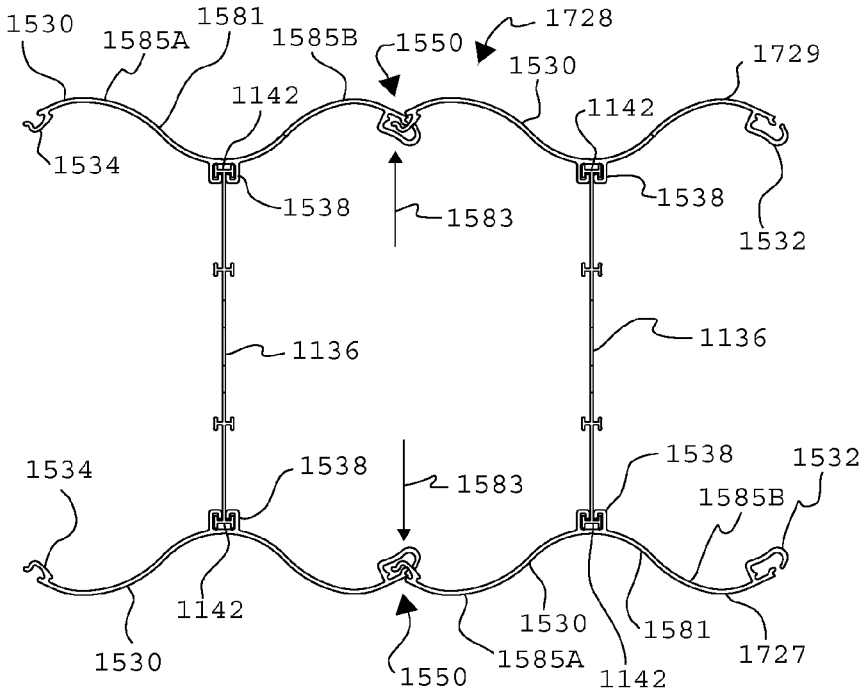

FIG. 18D schematically depicts a form 1728 according to another embodiment of the invention. Form 1728 incorporates panels 1530 (similar to panels 1530 of forms 1528, 1628 (FIGS. 18B, 18C)) on each of its wall segments 1727, 1729. Wall segments 1727, 1729 may be fabricated in a manner similar to that of wall segment 1529 described above by slidably connecting connector components 1532, 1534 in a loose-fit connection and then deforming the edges of panels 1530 in the directions of arrows 1583 to pivot connector components 1532, 1534 into a locked configuration. The structure fabricated from form 1728 will have a pair of contoured surfaces (i.e. having concavities and convexities corresponding to concavities 1581 and convexities 1585A, 1585B of panels 1530).

Figure 21A:
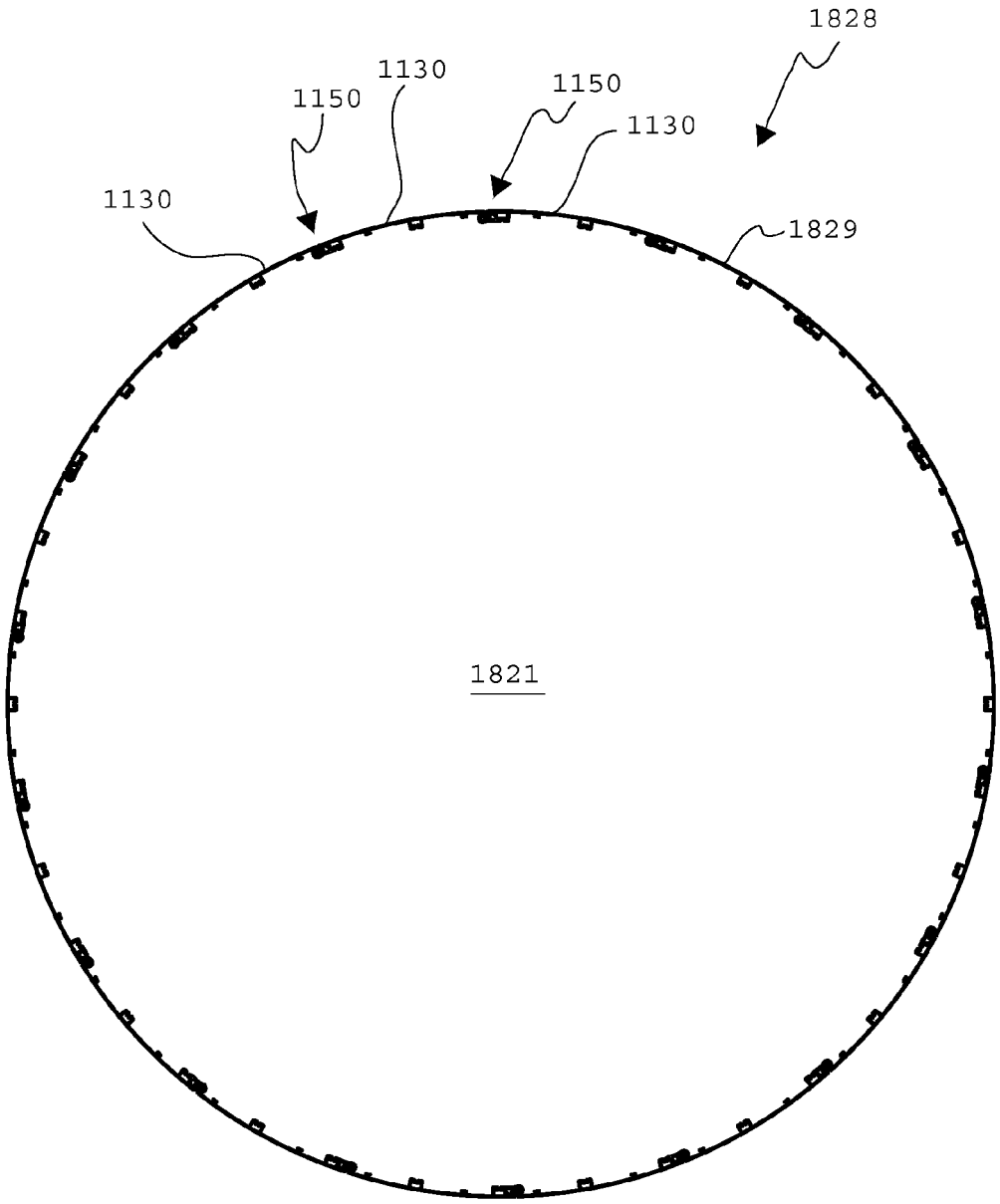
FIG. 21A is a top plan view of a form used to form a cylindrical column according to a particular embodiment of the invention.

FIG. 21A schematically depicts a form 1828 according to another embodiment of the invention. Form 1828 comprises a plurality of panels 1130 which are substantially similar to panels 1130 of form 1128 (FIG. 13) and which are used to fabricate a curved wall segment 1829. Panels 1130 are connected to one another in edge to edge relationship at connections 1150 (i.e. using connector components 1132, 1134 (not explicitly enumerated in FIG. 21A) in a manner similar to that described above). More particularly, panels 1130 are slidably moved relative to one another such that a portion of connector component 1134 of a first panel 1130 is inserted into connector component 1132 of an edge-adjacent panel 1130 to form a loose-fit connection and then relative pivotal motion is effected between connector components 1132, 1134 to deform one or more parts of connector components 1132, 1134 and to thereby establish a locked snap-together connection.

In form 1828, panels 1130 are curved to provide form 1828 with the round cross-section of wall segment 1829 shown in the illustrated view. An interior 1821 of form 1828 may be filled with concrete or the like and used to fabricate a solid cylindrical column, for example. Such columns may be reinforced with traditional reinforcement bars or with suitably modified support members. Panels 1130 may be fabricated with, or may be deformed to provide, the illustrated curvature. In other embodiments, forms similar to form 1828 may incorporate other curved panels to provide solid columns or the like having any desired shape.

Figure 21B:
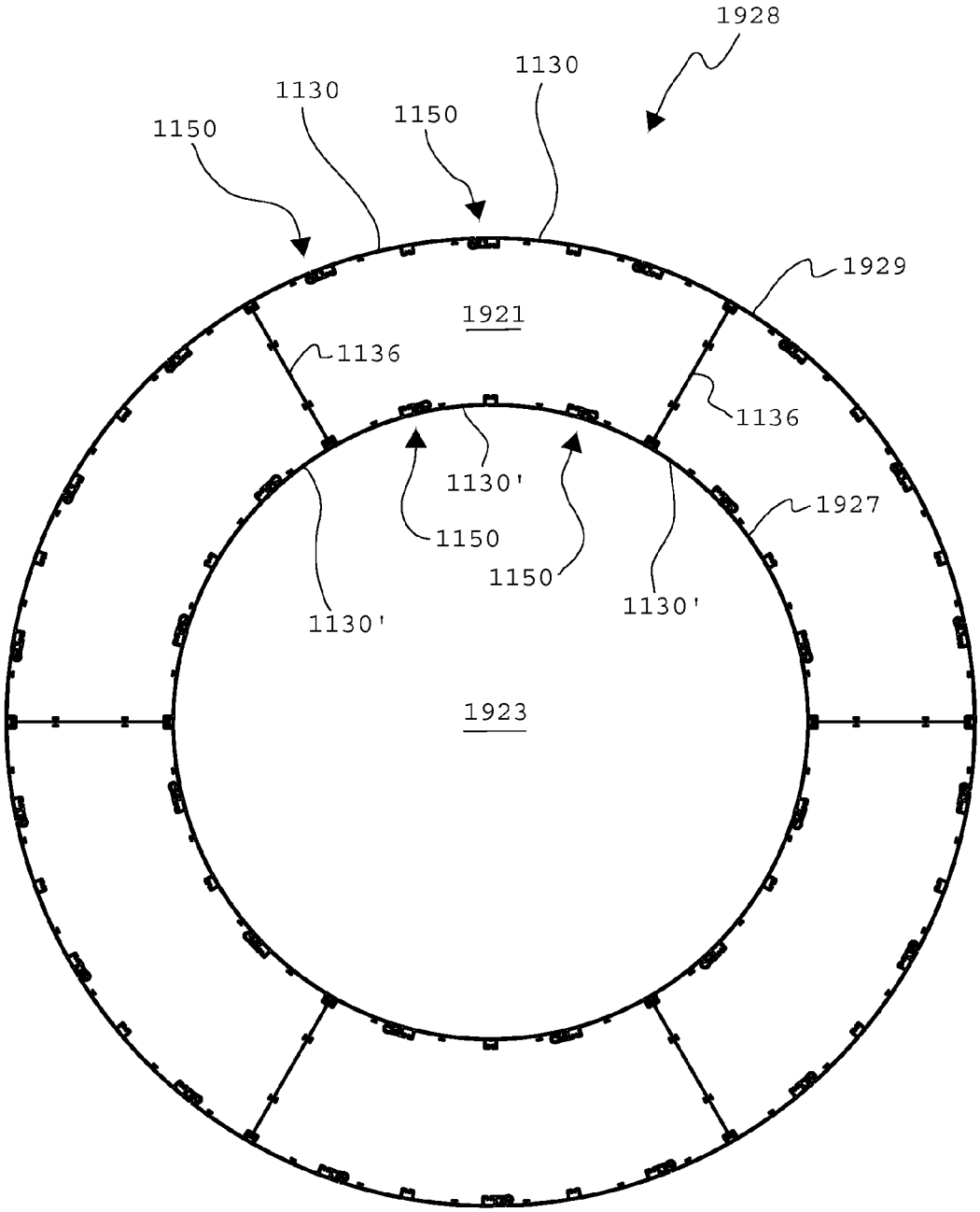
FIG. 21B is a top plan view of a form used to form a hollow annular column according to a particular embodiment of the invention.

FIG. 21B schematically depicts a form 1928 according to another embodiment of the invention. Form 1928 comprises a plurality of exterior panels 1130, a plurality of interior panels 1130' and a plurality of support members 1136. Panels 130, 1130' may be similar to panels 1130 of form 1128 (FIG. 13) and support members 1136 may be similar to support members 1136 of form 1128 (FIG. 13). In form 1928, panels 1130, 1130' and support members 1136 are used to fabricate a pair of curved wall segment 1927, 1929. Panels 1130 of exterior wall segment 1929 and panels 1130' of interior wall segment 1927 are connected to one another in edge to edge relationship at connections 1150 (i.e. using connector components 1132, 1134 (not explicitly enumerated in FIG. 21B) in a manner similar to that described above). More particularly, panels 1130, 1130' are slidably moved relative to one another such that a portion of connector component 1134 of a first panel 1130, 1130' is inserted into connector component 1132 of an edge-adjacent panel 1130, 1130' to form a loose-fit connection and then relative pivotal motion is effected between connector components 1132, 1134 to deform one or more parts of connector components 1132, 1134 and to establish a snap-together locked connection. Support members 1136 are connected between panels 1130, 1130' of opposing interior and exterior wall segments 1927, 1929 in a manner similar to that of support members 1136 and panels 1130 described above.

In form 1928, panels 1130 are curved to provide the round cross-section of interior and exterior wall segments 1927, 1929 shown in the illustrated view. Panels 1130' may be smaller than panels 1130 so as to permit interior and exterior wall segments 1927, 1929 to have different radii of curvature. It will be appreciated that the difference in length between panels 1130, 1130' will depend on desired concrete thickness (i.e. the different radii of interior and exterior wall segments 1927, 1929). An interior 1921 of form 1928 may be filled with concrete or the like and used to fabricate an annular column with a hollow bore in region 1923, for example. Such columns may be reinforced with traditional reinforcement bars or with suitably modified support members. Panels 1130, 1130' may be fabricated with, or may be deformed to provide, the illustrated curvature. In other embodiments, forms similar to form 1929 may incorporate other curved panels to provide other columns or the like having any desired shape and having hollow bores therethrough.

As will be apparent to those skilled in the art in the light of the foregoing disclosure, many alterations and modifications are possible in the practice of this invention without departing from the spirit or scope thereof. For example:

- Any of the connector components described herein can be used in conjunction with any of the forms described herein.
- Connector components 632, 634 (FIGS. 9A-9C) include stand-off members 677, 679 and plug 686. Connector components 632, 634 are similar in many respects to connector components 532, 534 (FIGS. 8A-8C). It will be appreciated however, that the connector components of any of the other embodiments described herein could be modified to provide suitable stand-off members similar to stand-off members 677, 679 and could thereby be made to accept plugs similar to plug 686.

Forms 328, 428, 1328 described above comprise support members 136, 1136 which are substantially similar to support members 136, 1136 of forms 128, 228, 1128, 1228. In general, this is not necessary, as support members 136, 1136 of forms 328, 428, 1328 need not extend through the other side of a wall. In general, forms 328, 428, 1328 use support members 136, 1136 to anchor forms 328, 428, 1328 into the concrete. Accordingly, to reduce the amount of material used to make forms 328, 428, 1328 support members 136, 1136 may be made smaller in the inward-outward direction. By way of non-limiting example, support members 136, 1136 may extend only up to connector components 143, 1143 in the inward-outward direction 15. As discussed above, forms 328, 428, 1328 may use any of the anchor components described in the Structure-Lining PCT Application.

Tilt-up forms 328, 428, 1328 may be modified to include lifting components similar to any of those described in the Structure-Lining PCT Application.

In some embodiments, it may be desirable to provide walls which incorporate insulation. Insulation 86 may be provided in the form of rigid foam insulation. Non-limiting examples of suitable materials for rigid foam insulation include: expanded poly-styrene, poly-urethane, poly-isocyanurate or any other suitable moisture resistant material. By way of non-limiting example, insulation layers may be provided in any of the forms described herein. Such insulation layers may extend in the vertical direction and in the transverse direction. Such insulation layers may be located centrally within the wall (e.g. between adjacent connector components 143 (see FIG. 3, for example)) or at one side of the wall (e.g. between connector components 143 and one of wall segments 127, 129, 227, 229, 327, 427). It will be appreciated that when fabricating walls using two-sided forms 128, 228, such insulation may be added before the liquid concrete is poured into the form, but when fabricating tilt-up walls with one-sided forms 328, 428, 1328, concrete and insulation may be layered as required on the generally horizontal table.

In the embodiments described herein, the structural material used to fabricate the wall segments is concrete. This is not necessary. In some applications, it may be desirable to use other structural materials which may be initially be poured or otherwise placed into forms and may subsequently solidify or cure.

Figure 12:
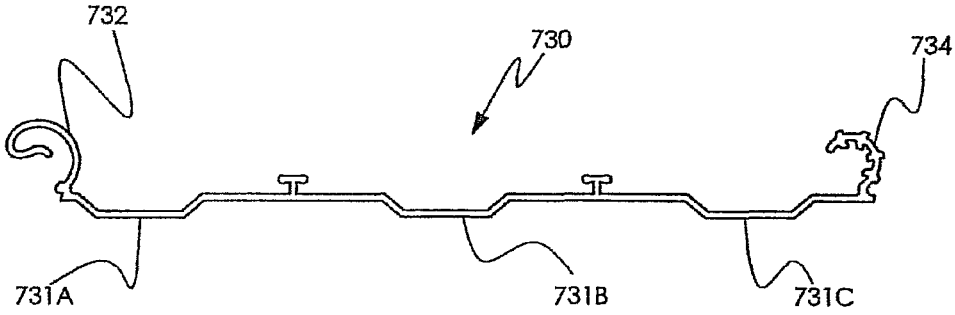
FIG. 12 is a plan view of a corrugated panel according to another embodiment of the invention.

In the embodiments describes above, the outward facing surfaces 131B of some panels (e.g. panels 130) are substantially flat. In other embodiments, panels 130, 1130 may be provided with corrugations in the inward-outward direction. Such corrugations may extend vertically and/or transversely. As is known in the art, such corrugations may help to prevent pillowing. FIG. 12 shows a wall panel 730 according to yet another embodiment of the invention. Wall panel 730 comprises connector components 732, 734, which are substantially similar to connector components 132, 134 described above. Although wall panel 730 extends generally transversely between connector components 732, 734, wall panel 730 incorporates corrugations 731A, 731B, 731C in the inward-outward direction. Corrugations 731A, 731B, 731C extend vertically and transversely.

In the embodiments described above, the various features of panels 130, 1130 (e.g. connector components 132, 134, 1132, 1314), support members 136, 1136 (e.g. connector components 142, 1142) and tensioning members 140, 1140 (e.g. connector components 141A, 1141A) are substantially co-extensive with panels 130, 1130, support members 136, 1136 and tensioning members 140, 1140 in the vertical dimension. This is not necessary. In some embodiments, such features may be located at various locations on the vertical dimension of panels 130, 1130, support members 136, 1136 and tensioning members 140, 1140 and may be absent at other locations on the vertical dimension 19 of panels 130, 1130, support members 136, 1136 and tensioning members 140, 1140. Forms incorporating any of the other wall panels described herein may comprise similarly dimensioned support members and/or tensioning members.

In some embodiments, sound-proofing materials may be layered into the form-works described above or may be connected to attachment units.

In some embodiments, the forms described herein may be used to fabricate walls, ceilings or floors of buildings or similar structures. In general, the forms described above are not limited to building structures and may be used to construct any suitable structures formed from concrete or similar materials. Non-limiting examples of such structures include transportation structures (e.g. bridge supports and freeway supports), beams, foundations, sidewalks, pipes, tanks, beams and the like.

FIGS. 21A and 21B show columns fabricated from panels 1130. Forms incorporating any of the other panels described herein may be used to fabricate columns according to other embodiments of the invention. Columns may be formed (like FIG. 21A) such that only an outer surface of the column is coated by panels having connector components of the type described herein. Columns may also be formed (like FIG. 21B) to have inside and outside surfaces coated by panels having connector components of the type described herein—i.e. such that the columns have a bore in the center which may be hollow or which contain other materials. Such columns may generally have any cross-section, such as rectangular, polygonal, circular or elliptical, for example. Columns may be reinforced with traditional reinforcement bars or with suitably modified support members.

Structures (e.g. walls) fabricated according to the invention may have curvature. Where it is desired to provide a structure with a certain radius of curvature, panels on the inside of the curve may be provided with a shorter length than corresponding panels on the outside of the curve. This length difference will accommodate for the differences in the radii of curvature between the inside and outside of the curve. It will be appreciated that this length difference will depend on the thickness of the structure.

In addition or in the alternative to the co-extruded coating materials and/or surface texturing described above, materials (e.g. sealants and the like) may be provided at various interfaces between the connector components described above to improve the impermeability of the resulting connections to liquids and/or gasses. By way of non-limiting example, receptacle 154 of connector component 132, receptacle 174 of connector component 134 and channel 680 may contain suitable sealants or the like for providing seals with prong 164 (which projects into receptacle 154), protrusion 158 (which projects into receptacle 174) and arms 687A, 687B (which project into channel 680). A bead or coating layer of sealing material may be provided: on distal end 1156A' of arm 1156A; in concavity 1171B; on secondary protrusion 1169A; in secondary recess 1159A; on thumb 1173; in secondary recess 1167; on thumb 1163; and/or in concavity 1171A.

The description set out above makes use of a number of directional terms (e.g. inward-outward direction 15, transverse direction 17 and vertical direction 19). These directional terms are used for ease of explanation only. In some embodiments, walls and other structures fabricated from the forms described herein need not be vertically and/or transversely oriented like those described above. In some circumstances, components of the forms described herein may be assembled in orientations different from those in which they are ultimately used to accept concrete. However, for ease of explanation only, directional terms are used in the description to describe the assembly of these form components. Accordingly, the directional terms used herein should not be understood in a literal sense but rather in a sense used to facilitate explanation.

Many embodiments and variations are described above. Those skilled in the art will appreciate that various aspects of any of the above-described embodiments may be incorporated into any of the other ones of the above-described embodiments by suitable modification.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations.

What is claimed is:

1. A stay-in-place form for casting structures from concrete or other curable construction materials comprising:

a plurality of elongate panels interconnectable in edge-to-edge relationship via complementary connector components on their longitudinal edges to define at least a portion of a perimeter of the form;

wherein each panel comprises a first connector component comprising a protrusion on a first longitudinal edge thereof and a second connector component comprising a receptacle on a second longitudinal edge thereof;

wherein interconnection of the panels to one another in edge-to-edge relationship forms edge-to-edge connections therebetween;

wherein for each edge-to-edge connection between a first one of the panels and a second one of the panels, the first connector component of the first one of the panels and the second connector component of the second one of the panels comprise shapes contoured such that relative pivotal motion between the first connector component of the first one of the panels and the second connector component of the second one of the panels about an axis generally parallel to at least one of the longitudinal edges creates the edge-to-edge connection by causing:

extension of the protrusion of the first connector component of the first one of the panels into the receptacle of the second connector component of the second one of the panels;

deformation of at least one of: the first connector component of the first one of the panels and the second connector component of the second one of the panels; and restorative deformation forces created by the deformation of the at least one of the first connector component of the first one of the panels and the second connector component of the second one of the panels to at least partially restore the deformation and to thereby retain the first connector component of the first one the panels and the second connector component of the second one of the panels in a locked configuration.

2. A form according to claim 1 wherein, for each connection, at least one of the first connector component of the first panel and the second connector component of the second panel comprise one or more deformable parts and wherein the relative pivotal motion between the connector components causes contact between the connector components which initially deforms the one or more deformable parts and wherein the relative pivotal motion between the connector components subsequently permits restorative deformation forces associated with the one or more deformable parts to retain the connector components in the locked configuration.

3. A stay-in-place form according to claim 1 wherein a portion of the protrusion of the first panel is dimensioned to be slidably received in the receptacle of the second panel in a loose-fit connection by relative movement of the first and second panels in a longitudinal direction.

4. A form according to claim 3 wherein the connector components are shaped for partial engagement with one another in the loose-fit connection, the partial engagement preventing separation of the connector components under an application of force in a transverse direction, the transverse direction generally orthogonal to the longitudinal direction.

5. A form according to claim 3 wherein the connector components are shaped to effect the loose-fit connection without deformation of the connector components.

6. A form according to claim 3 wherein the connector components are shaped to effect the loose-fit connection without substantial friction between the connector components.

7. A form according to claim 3 wherein an interior angle between the first and second panels is in a range of 30°-150° when the panels are in the loose-fit connection and wherein the interior angle between the first and second panels is in a range of 175°-185° when the panels are in the locked configuration.

8. A form according to claim 1 wherein the relative pivotal motion between the first connector component of the first panel and the second connector component of the second panel comprises relative pivotal motion between the first and second panels about the axis generally parallel to the at least one of the longitudinal edges.

9. A form according claim 1 wherein the first connector component of the first panel comprises at least one secondary protrusion and at least one concavity and wherein the second connector component of the second panel comprises at least one complementary secondary recess and at least one complementary projection and wherein, when the first connector component of the first panel and the second connector component of the second panel are in the locked configuration, the at least one secondary protrusion extends into the at least one secondary recess and the at least one projection extends into the at least one concavity.

10. A form according to claim 9 wherein the extension of the at least one secondary protrusion into the at least one secondary recess provides an interleaving between parts of the first connector component of the first panel and the second connector component of the second panel.

11. A form according to claim 10 wherein the extension of the at least one projection into the at least one concavity provides an interleaving between parts of the first connector component of the first panel and the second connector component of the second panel.

12. A form according to claim 9 wherein one of the at least one secondary recess and one of the at least one concavity are coated with a sealing material.

13. A form according to claim 12 wherein the sealing material is co-extruded with a remainder of the first and second panels.

14. A form according to claim 1 wherein the portion of the perimeter of the form comprises a portion of one side of the resultant structure and wherein the form is used to fabricate a wall which is cast in a generally horizontal orientation and which is tilted, after casting, into a generally vertical orientation.

15. A form according to claim 1 wherein the portion of the perimeter comprises at least one of: an exterior surface of a column; and an interior surface and an exterior surface of a column having a bore therethrough.

16. A first elongate panel for use with a form assembly for casting structures from concrete or similar curable construction materials, the first panel comprising complementary connector components on its longitudinal edges for interconnection in edge-to-edge relationship with other similar panels, the complementary connector components comprising a first connector component comprising a protrusion on a first longitudinal edge of the first panel and a second connector component comprising a receptacle on a second longitudinal edge of the first panel, wherein the first panel is connectable in an edge-to-edge relationship to a second similar panel to form an edge-to-edge connection therebetween, wherein the first connector component and the second connector component comprise shapes contoured such that relative pivotal motion between the first connector component of the first panel and the second connector component of the second similar panel about an axis generally parallel to at least one of the longitudinal edges creates the edge-to-edge connection by causing:

extension of the protrusion of the first connector component of the first panel in to the receptacle of the second connector component of the second similar panel;

deformation of at least one of: the first connector component of the first panel and the second connector component of the second similar panel; and restorative deformation forces created by the deformation of the at least one of the first connector component of the first panel and the second connector component of the second similar panel to at least partially restore the deformation and to thereby retain the connector components in a locked configuration.

17. A panel according to claim 16 wherein the first and second connector components are shaped such that the first and second panels are slidable in a longitudinal direction relative to one another to effect a loose-fit connection wherein a distal portion of the protrusion of the first connector component of the first panel extends into the receptacle of the second connector component of the second panel.

18. A panel according to claim 17 wherein the first connector component of the first panel and the second connector component of the second panel are shaped to effect the loose-fit connection without deformation of the connector components.

19. A panel according to claim 17 wherein the first connector component of the first panel and the second connector component of the second panel are shaped to effect the loose-fit connection without substantial friction between the connector components.

20. A panel according to claim 17 wherein the first connector component of the first panel and the second connector component of the second panel are shaped for partial engagement with one another in the loose-fit connection, the partial engagement preventing separation of the connector components under an application of force in a transverse direction, the transverse direction generally orthogonal to the longitudinal direction.

21. A panel according to claim 16 wherein projection of the protrusion of the first connector component of the first panel into the receptacle of the second connector component of the second panel initially causes deformation of at least one of the first connector component of the first panel and the second connector component of the second panel and subsequently permits restorative deformation forces to lock the first connector component of the first panel to the second connector component of the second panel in the locked configuration.

22. A panel according claim 16 wherein the relative pivotal motion between the first connector component of the first panel and the second connector component of the second panel comprises relative pivotal motion between the first and second panels about the axis generally parallel to the at least one of the longitudinal edges.

23. A panel according to claim 16 wherein the first connector component of the first panel comprises:

a secondary protrusion for projecting into a secondary recess of the second connector component of the second panel; and a concavity for receiving a projection of the second connector component of the second panel.

24. A panel according to claim 23 wherein the first connector component of the first panel and the second connector component of the second panel are shaped such that the projecting of the secondary protrusion into the secondary recess provides an interleaving between parts of the first connector component of the first panel and second connector component of the second panel.

25. A panel according to claim 23 wherein the first connector component of the first panel and the second connector component of the second panel are shaped such that the receiving of the projection in the concavity provides an interleaving between parts of the first connector component of the one of the first and second panels and the second connector component of the other one of the first and second panels.

26. A panel according to claim 23 wherein the concavity of the first connector component of the first panel is coated with a sealing material, the sealing material co-extruded with a remainder of the one of the first and second panels.

* * * * *

UNITED STATES PATENT AND TRADEMARK OFFICE

CERTIFICATE OF CORRECTION

PATENT NO. : 8,555,590 B2
APPLICATION NO. : 12/742082
DATED : October 15, 2013
INVENTOR(S) : Richardson et al.

It is certified that error appears in the above-identified patent and that said Letters Patent is hereby corrected as shown below:

In the Specification

At column 20, line 9, "Nov. 7, 2008" is deleted.

At column 25, line 36, "1171" is amended to --1178--.

At column 26, line 62, "1130B" is amended to --1130C--.

At column 28, line 13, "11228" is amended to --1228--.

At column 28, line 21, "1428" is amended to --1328--.

At column 28, line 39, "1171" is amended to --1178--.

At column 28, line 44, "1171" is amended to --1178--.

At column 30, line 41, "5130" is amended to --1530--.

At column 30, line 65, "534" is amended to --1534--.

At column 32, line 56, "1929" is amended to --1928--.

Signed and Sealed this
Twenty-ninth Day of July, 2014

Michelle K. Lee

Michelle K. Lee
*Deputy Director of the United States Patent and Trademark Office*